US010219642B2

(12) United States Patent
Savenok

(10) Patent No.: US 10,219,642 B2
(45) Date of Patent: Mar. 5, 2019

(54) CONTAINER LID ASSEMBLIES FOR DIRECTING LIQUID FLOW

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 0 days.

(21) Appl. No.: 14/852,411

(22) Filed: Sep. 11, 2015

(65) Prior Publication Data

US 2017/0071379 A1 Mar. 16, 2017

(51) Int. Cl.

| | |
|---|---|
| ***A47G 19/22*** | (2006.01) |
| ***B65D 43/02*** | (2006.01) |
| ***B65D 43/14*** | (2006.01) |
| ***B65D 43/26*** | (2006.01) |
| ***B65D 51/18*** | (2006.01) |

(52) U.S. Cl.

CPC ..... *A47G 19/2272* (2013.01); *B65D 43/02* (2013.01); *B65D 43/14* (2013.01); *B65D 43/26* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2543/00046* (2013.01)

(58) Field of Classification Search

CPC .... A47G 19/2272; B65D 43/14; B65D 43/02; B65D 43/26; B65D 51/18; B65D 2543/00046; B65D 2251/009; B65D 2251/0081; B65D 2251/0018; B65D 2251/0028

USPC ..... 220/256.1, 521, 523, 711–718; 229/404, 229/906.1

See application file for complete search history.

(56) References Cited

U.S. PATENT DOCUMENTS

| | | | | |
|---|---|---|---|---|
| 4,074,827 | A * | 2/1978 | Labe, III | B65D 51/28 206/217 |
| 5,873,493 | A | 2/1999 | Robinson | |
| 6,176,390 | B1 | 1/2001 | Kemp | |
| 6,488,173 | B2 | 12/2002 | Milan | |
| 6,528,105 | B1 * | 3/2003 | Gerhart | A47G 19/02 206/217 |
| 6,732,895 | B2 | 5/2004 | Poliquin et al. | |
| 7,448,510 | B2 | 11/2008 | Pavlopoulos | |

(Continued)

FOREIGN PATENT DOCUMENTS

WO 2004/047596 6/2004

*Primary Examiner* — James N Smalley

(74) *Attorney, Agent, or Firm* — Christopher J. Scott

(57) ABSTRACT

A beverage container lid assembly and insert enable a user to selectively control contained beverage movements when outfitted upon a beverage container. The lid assemblies all include a primary lid form having a primary beverage outlet and a secondary lid attachment cooperably engaged with the primary lid form for providing certain beverage flow diversion structure. The secondary lid attachments may be attachable to select surfacing of the primary lid forms for forming a beverage-receiving compartment intermediate the primary lid form and the secondary lid attachment in which compartment heat transfer is effected by the structural characteristics of the defined space. The lid assembly may be attached to a beverage container such that the user may manually position the secondary lid attachment relative to the primary lid form for manually and selectively position beverage flow diversion structures relative to the primary beverage outlet.

18 Claims, 49 Drawing Sheets

(56) References Cited

U.S. PATENT DOCUMENTS

| | | | | |
|---|---|---|---|---|
| 8,528,768 | B2 | 9/2013 | D'Amato | |
| 9,238,529 | B1 * | 1/2016 | Newman | B65D 43/12 |
| 2002/0074337 | A1 * | 6/2002 | Melton | B65D 51/245 220/713 |
| 2006/0180028 | A1 * | 8/2006 | Burchard | B65D 51/24 99/275 |
| 2007/0062943 | A1 | 3/2007 | Bosworth | |
| 2010/0264150 | A1 | 10/2010 | Leon | |
| 2010/0320220 | A1 | 12/2010 | Hussey | |
| 2011/0248033 | A1 * | 10/2011 | Mehrvijeh | B65D 43/02 220/254.3 |
| 2013/0256394 | A1 | 10/2013 | Moutty | |
| 2014/0209613 | A1 * | 7/2014 | Freeman | B65D 51/28 220/521 |

* cited by examiner

C

CONTAINER LID ASSEMBLIES FOR DIRECTING LIQUID FLOW

PRIOR HISTORY

This application claims the benefit of or priority to pending (1) U.S. patent application Ser. No. 14/547,287 filed in the United States Patent and Trademark Office (USPTO) on 19 Nov. 2014 and (2) U.S. patent application Ser. No. 14/838,343 filed in the USPTO on 27 Aug. 2015, the specifications of which are hereby incorporated by reference thereto.

BACKGROUND OF THE INVENTION

Field of the Invention

The present invention relates generally to a lid construction or assembly for outfitting a hot beverage container. More particularly, the present invention relates to a combination lid-insert construction or assembly for outfitting a hot beverage container for enabling the drinker to selectively transfer heat from a hot beverage prior to consumption, controlling beverage movements from a lid-outfitted beverage container and preventing spillage of beverage from such an outfitted beverage container.

Brief Description of the Prior Art

The broad field of lids for hot beverage containers and hot beverage container assemblies inclusive of lids is exceedingly well-developed. The art relating to means for cooling hot beverages prior to consumption by way of a lid construction or assembly is a bit more limited. In any case, it is most difficult to pinpoint with precision the most pertinent art relevant to the present invention given the wide swath of art swept by beverage container constructions and developments in the field of art generally. Nevertheless, some of the more pertinent prior is believed to be briefly described hereinafter.

U.S. Pat. No. 5,873,493 ('493 patent), which issued to Robinson, for example, discloses an Integrally Molded Measurer Dispenser. The '493 patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 patent), which issued to Kemp, discloses a Container Lid with Cooling Reservoir. The '390 patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 6,488,173 ('173 patent), issued to Milan, discloses a Beverage container lid having baffle arrangement for liquid cooling. The '173 patent describes a removable beverage container lid wherein the lid has a substantially enclosed space defined between an exterior cover and an interior cover. At least one inlet opening is formed in the interior cover directing a hot beverage to flow into the substantially enclosed space. Attached to the interior cover at the forward edge of the inlet opening is a partition or wall assembly having a height extending to be located substantially against the exterior cover and a length at least equal to the length of the inlet opening. Between the partition or wall assembly and the peripheral edge of the exterior cover is located a gap area. Connected with the gap area is a dispensing opening formed in the exterior cover. Hot beverage is required to flow around the partition or wall assembly and into the gap area prior to flowing through the dispensing opening exteriorly of a beverage container.

U.S. Pat. No. 6,732,895 ('895 patent), issued to Smith et al., discloses a Reclosable Container Lid. The '895 patent describes a reclosable lid for a beverage container comprising a first piece or cover, and a movable second piece or disk. The cover has a top wall, a side wall and a mounting portion for connecting the lid on the container. The cover has an opening adapted to permit the flow of the substance through the lid. The cover further includes a slot located in the top wall. The disk has at least one aperture, a post, and a projection.

The aperture and the projection are each cooperatively dimensioned with the opening. The post is adapted to be received by the slot in the cover. The disk is movable between a first position wherein at least a portion of the projection is received in the opening in the first position, and a second position wherein the aperture is aligned with the opening in the second position. A support ledge and a support edge on an inner surface of the cover are adapted to provide rotatable support to the disk.

U.S. Pat. No. 7,448,510 ('510 patent), which issued to Pavlopoulos, discloses a Cup Assembly having a Cooling Compartment. The '510 patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

U.S. Pat. No. 8,528,768 ('768 patent), issued to D'Amato, discloses a Reclosable Lid for a Container. The '768 patent describes a lid for a paper cup type container. The lid is detachably mountable onto the edge of an opening of the container. The lid comprises a lower lid part with an inner outlet opening, and an upper lid part with an outer outlet opening. In an assembled position, the upper lid part is mounted rotatable relative to the lower lid part between at least two positions, such that the outlet openings are mutually aligned in one position and are without any overlap in the other position. The lower lid part has a circumferential mounting flange for overlapping the opening edge of the container, and the upper lid part has a circumferential mounting flange for overlapping the mounting flange of the lower lid part.

United States Patent Application Publication No. 2007/0062943, authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

United States Patent Application Publication No. 2010/0264150, authored by Leon et al., describes a disposable beverage cup a disposable beverage cup that comprises a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

United States Patent Application Publication No. 2010/0320220, which was authored by Hussey et al., describes a plastic lid for a drinks container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover.

The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure.

United States Patent Application Publication No. 2013/0256394, authored by Moutty, describes a paper cup comprising a sidewall member having an upper edge, a lower edge, a pair of opposite side edges, a front surface and a back surface. Each of the side edges and the upper edge define upper corners. The side edges are overlapped and are sealed together along an overlapping side seam. A bottom member comprises a peripheral lip sealed to the lower edge of the sidewall member. The Moutty paper cup construction is remarkable in that it further comprises at least one rigid or semi-rigid rim structure attached to the upper edge of the side wall member and in that the paper weight of the bottom member is greater than the paper weight of the sidewall member.

From a consideration of the foregoing, it will be noted that the prior art perceives a need for a low cost lid assembly and/or container insert usable in combination with a hot beverage container so as to enable the user to selectively transfer heat from the hot beverage via the lid elements outfitted upon the container prior to beverage consumption and for preventing spillage of (hot) beverage from the container. More particularly, the prior art further perceives a need for a beverage container lid assembly or assemblies comprising low cost secondary lid attachments cooperable with primary lid forms for enabling the user to more effectively control beverage movements through such an assembly for causing heat transfer therefrom prior to consumption.

SUMMARY OF THE INVENTION

Among the many objectives of this invention is the provision of a number of beverage container lid assemblies or container insert constructions for enabling a user to selectively and/or manually control beverage movement(s) from the stage of beverage containment to beverage consumption. The various lid assembly embodiments attempt to provide a user with an enhanced ability to control beverage movements for the purpose of effecting enhanced heat transfers and spillage prevention.

To achieve these and other readily identifiable objectives, the present invention provides a number of different embodiments of lid assemblies and/or container inserts or attachments with unifying structural characteristics of themes. In all embodiments, the basic invention may be said to essentially teach or disclose a beverage or liquid container lid assembly for enabling a user to selectively control beverage or liquid movement(s) therethrough.

Various beverage container lid assemblies according to the present invention may be said to essentially comprise a primary lid form, a secondary lid attachment, and certain container attachment means for attaching the primary lid form to an upper rim of a beverage container. The secondary lid attachments or inserts are tightly or snugly nested into a depression formed in the main body of the primary lid form of the lid assembly.

The lid assemblies depicted in FIGS. 1-81 and 86-112 depict relatively complicated structural formations (e.g. depressions, channels, diversion/damming means, etc.) formed in the primary lid forms. The secondary lid attachments or inserts are of a relatively simpler design as compared to the primary lid forms and are designed in most cases to form a beverage-receiving compartment or to cap preformed structures. The design choices exemplified by the lid assemblies depicted in this application simplify manufacturing and attachment/assembly processes.

The primary lid form in certain embodiments preferably and essentially comprises a beverage outlet depression formed at upper surfacing of the primary lid form, which beverage outlet depression has at least one primary beverage outlet and a depression periphery. The secondary lid attachments of these embodiments preferably and essentially comprises an attachment-to-form contact edge and at least one letting aperture. The attachment-to-form contact edge is engaged with the depression periphery in superior adjacency to the primary beverage outlet for forming a beverage-receiving compartment at the beverage outlet depression.

The container attachment means attach the primary lid form(s) to an upper rim of a beverage container, which beverage container contains beverage of liquid. Beverage or liquid from the beverage container is directable through the primary beverage outlet into the beverage-receiving compartment in which beverage-receiving compartment heat transfer is effected from the beverage prior to outletting via the at least one letting aperture of the secondary lid attachment for beverage consumption.

Certain lid assemblies may all further be preferably defined by comprising primary lid forms having a beverage pooling structure in adjacency to the at least one primary beverage outlet for pooling beverage within the beverage-receiving compartment prior to consumption. The at least one letting aperture formed in the secondary lid attachment(s) may preferably be non-aligned relative to the at least one primary beverage outlet such that the secondary lid attachment thereby provides certain beverage flow diversion structure.

Certain secondary lid attachment removal means may be further provided for enabling the user to selectively remove the secondary lid attachment(s) from engagement with the primary lid form(s) and consume beverage directly via the at least one primary beverage outlet. The secondary lid attachment removal means may be defined or exemplified in part by a secondary depression formed in adjacency to the beverage outlet depression.

The secondary depressions enable a user to manually engage an underside of the secondary lid attachment(s) for manually removing those secondary lid attachments. The primary lid forms may further preferably comprise a depression-interconnecting channel extending intermediate the beverage outlet depression and the secondary depression for venting the beverage-receiving compartment.

Viewed from a broader perspective, various container lid assemblies according to the present invention may be said to essentially each comprise a primary lid form, a secondary lid attachment, and certain container attachment means for enabling a user to selectively control liquid movement from a lid-outfitted container through the lid assemblies. The primary lid forms in certain embodiments preferably and essentially comprises a liquid outlet formation having at least one primary liquid outlet and a formation periphery.

The secondary lid attachments comprises an attachment-to-form contact edge and at least one letting aperture. The attachment-to-form contact edges are engaged with the formation peripheries in adjacency to the primary liquid outlet for forming a liquid-receiving compartment at the liquid outlet formation. The container attachment means attach the primary lid form to a liquid container such that liquid from the liquid container is directable into the liquid-receiving compartment.

The liquid-receiving compartment effects heat transfer from the liquid prior to outletting via a select letting aperture as selected from the group consisting of at least one primary beverage outlet of the primary lid formations and at least one letting aperture of the secondary lid attachments depending on the placement of the secondary lid attachments relative to the primary lid forms.

Certain lid assemblies according to the present invention, for example, may be said to represent a first subset of those lid assemblies wherein the secondary lid attachments are cooperably engaged with the primary lid forms in inferior adjacency to the primary liquid outlet. The liquid is directable (a) into the liquid-receiving compartment via the at least one letting aperture formed in the secondary lid attachment(s), and (b) from the liquid-receiving compartment via the primary liquid outlet formed in the primary lid formation(s).

The primary lid form or formations of lid assemblies may further preferably and essentially comprise laterally opposed liquid-damming structures at the liquid outlet formation. The laterally opposed liquid-damming structures are laterally offset from the primary liquid outlet for redirecting liquid movements prior to outletting via the primary liquid outlet for effecting heat transfer from redirected liquid movements, and thereby enhancing the cooling effect of the lid assemblies.

The primary lid forms may further preferably and essentially comprise at least one push button structure for enabling the user to selectively remove the secondary lid attachment from select engagement(s) with the primary lid form(s) (e.g. partial or entire removals or disengagements). The primary lid forms may further preferably comprise certain structural indentations or depressions in adjacency to the push button structure(s) for increasing liquid-to-material contact surface area within the liquid-receiving compartment and enhancing heat transfer from liquid received therein.

Certain other lid assemblies may be said to represent a second subset of the broader based definitions of the lid assemblies wherein the secondary lid attachments are cooperably engaged with the primary lid forms in superior adjacency to the primary liquid outlet such that liquid is directable (a) into the liquid-receiving compartment via the at least one primary liquid outlet of the primary lid form(s); and (b) from the liquid-receiving compartment via the at least one letting aperture of the secondary lid attachment(s).

The primary lid forms may preferably further comprise a liquid pooling structure in adjacency to the at least one primary liquid outlet for pooling liquid within the liquid-receiving compartment prior to outletting via the at least one letting aperture. The at least one letting aperture(s) are preferably non-aligned relative to the at least one primary liquid outlet. The preferred non-alignment of such apertures formed in the secondary lid attachment provide liquid flow diversion structure as liquid is redirected by the material construction(s) of the secondary lid attachment(s).

A container lid shroud embodiment according to the present invention is designed for use in combination with a container lid and enables a user to selectively control liquid flow from the container lid, which container lid essentially comprises a lid wall, upper-outer container lid surfacing, and a primary liquid outlet. The container lid shroud according to the present invention preferably and essentially comprises a shroud wall, lower-inner shroud surfacing, and at least one letting aperture.

The shroud wall and lower-inner shroud surfacing are contoured for respectively mimicking the lid wall and upper-outer lid surfacing of the container lid and are seatable in superior adjacency to the container lid for forming a liquid-receiving compartment intermediate the upper-outer container lid surfacing and the lower-inner shroud surfacing. The primary liquid outlet outlets liquid from a lid-outfitted liquid container into the liquid-receiving compartment, and the at least one letting aperture outlets liquid received in the liquid-receiving compartment.

The at least one letting aperture of the container lid shroud is preferably formed so as to be in non-alignment with the primary liquid outlet for preventing direct liquid flow from the primary liquid outlet through the at least one letting aperture. The lower-inner shroud surfacing of the shroud wall are frictionally engageable with the upper-outer lid surfacing of the lid wall for retaining the lid shroud in engagement with the container lid. The liquid container lid may have a wall-to-rim junction groove, and the container lid shroud may cooperably comprise a shroud wall hem insertable into the wall-to-rim junction groove for enhancing shroud-to-lid frictionally seated engagement.

It will thus be understood that in all embodiments, the basic invention may be said to essentially teach or disclose a beverage or liquid container lid assembly for enabling a user to selectively control beverage or liquid movement(s) therethrough. Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of my invention will become more evident from a consideration of the following brief descriptions of patent drawings.

Figure 68:
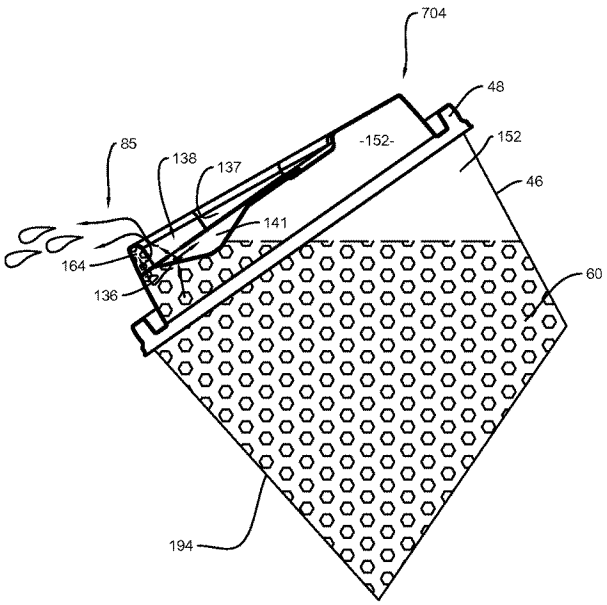

FIG. 68 is a first sequential schematic longitudinal cross-sectional type depiction of a beverage container outfitted with the fifth beverage container lid assembly according to the present invention shown in a first angle of inclination off of a vertical orientation for inletting beverage via letting apertures formed in the fifth secondary lid attachment into a beverage-receiving compartment of the fifth beverage container lid assembly.

Figure 68A:
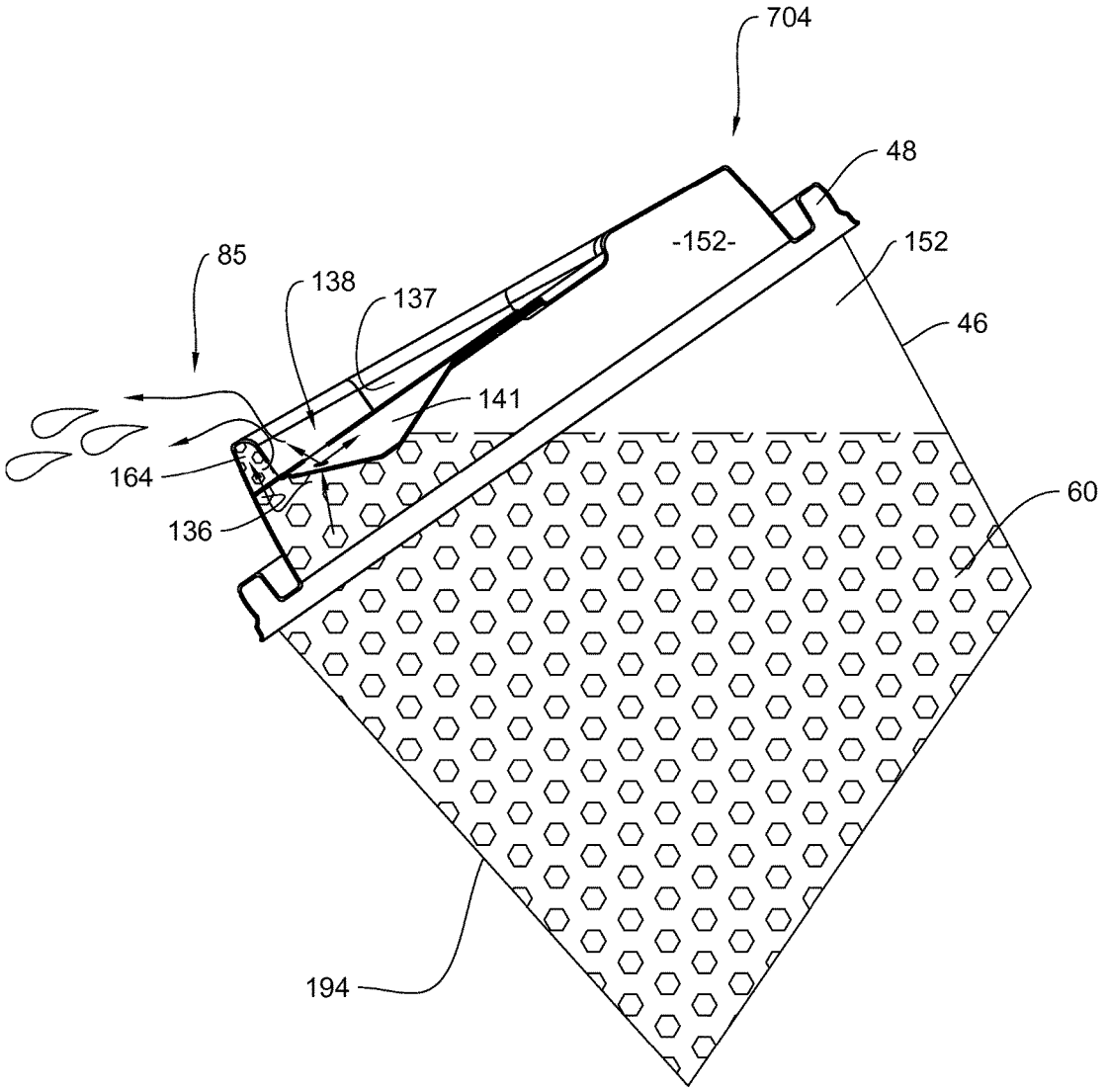

FIG. 68A is an enlarged view of the content otherwise shown in FIG. 68, enlarged to show in greater detail those structures depicted in FIG. 68.

Figure 69:
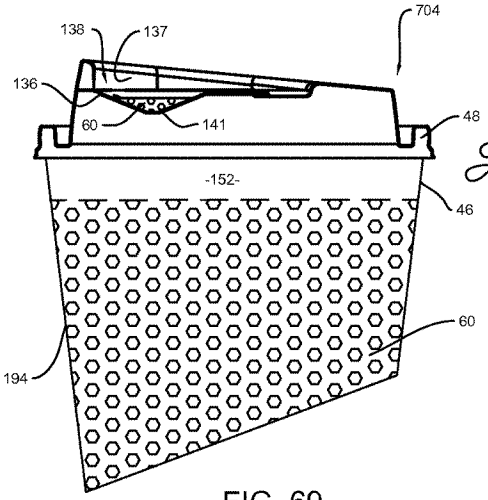

FIG. 69 is a second sequential schematic longitudinal cross-sectional type depiction of a beverage container outfitted with the fifth beverage container lid assembly according to the present invention shown in a vertical orientation with beverage received and pooled within the beverage-receiving compartment of the fifth beverage container lid assembly.

Figure 69A:
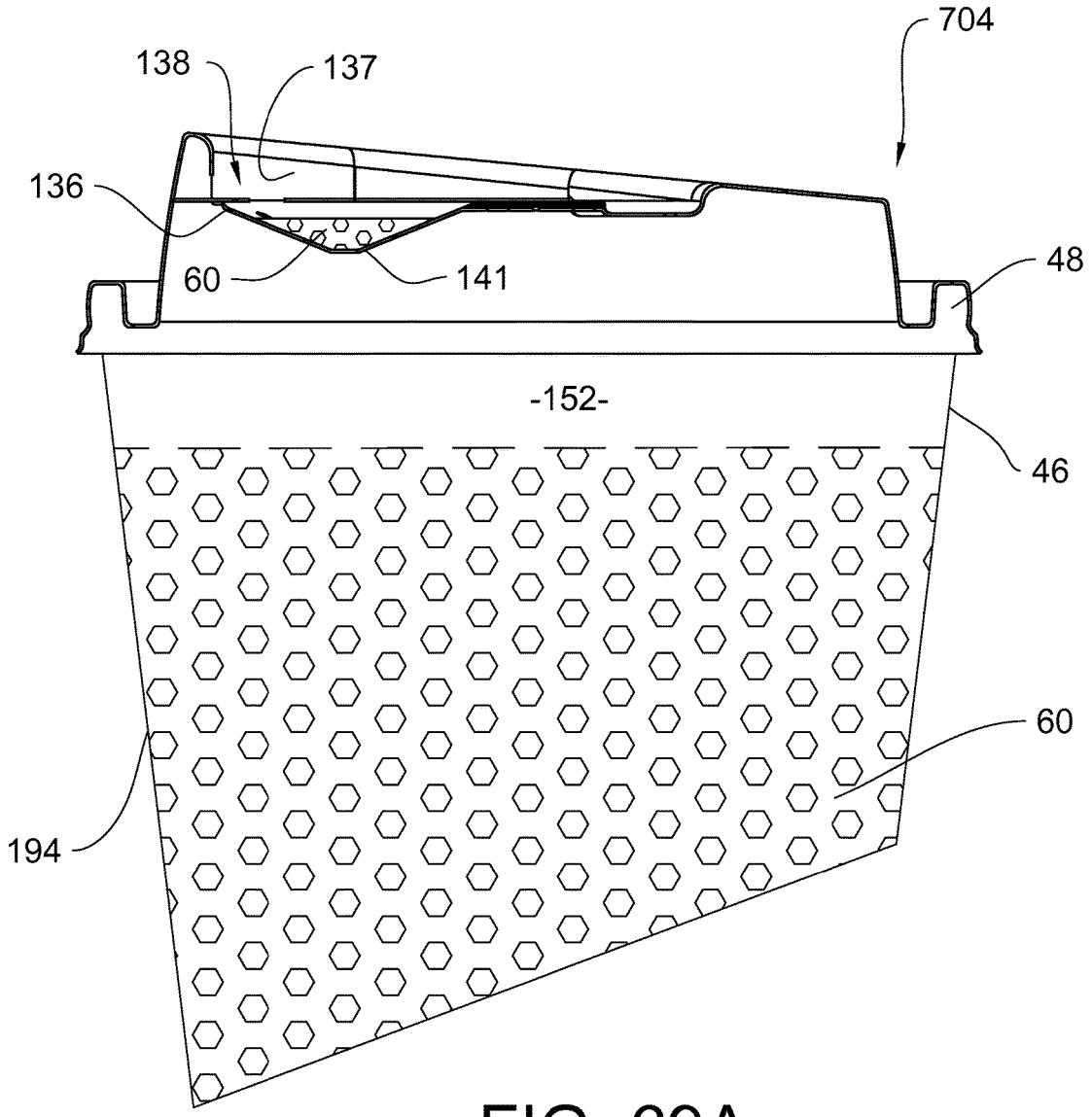

FIG. 69A is an enlarged view of the content otherwise shown in FIG. 69, enlarged to show in greater detail those structures depicted in FIG. 69.

Figure 70:
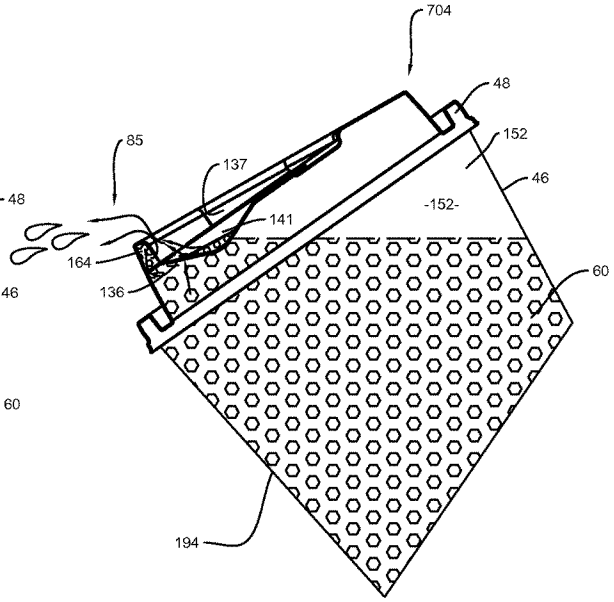

FIG. 70 is a third sequential schematic longitudinal cross-sectional type depiction of a beverage container outfitted with the fifth beverage container lid assembly according to the present invention shown in a second angle of inclination off of a vertical orientation for outletting cooled beverage via the primary beverage outlet of the primary lid form of the fifth beverage container lid assembly.

Figure 70A:
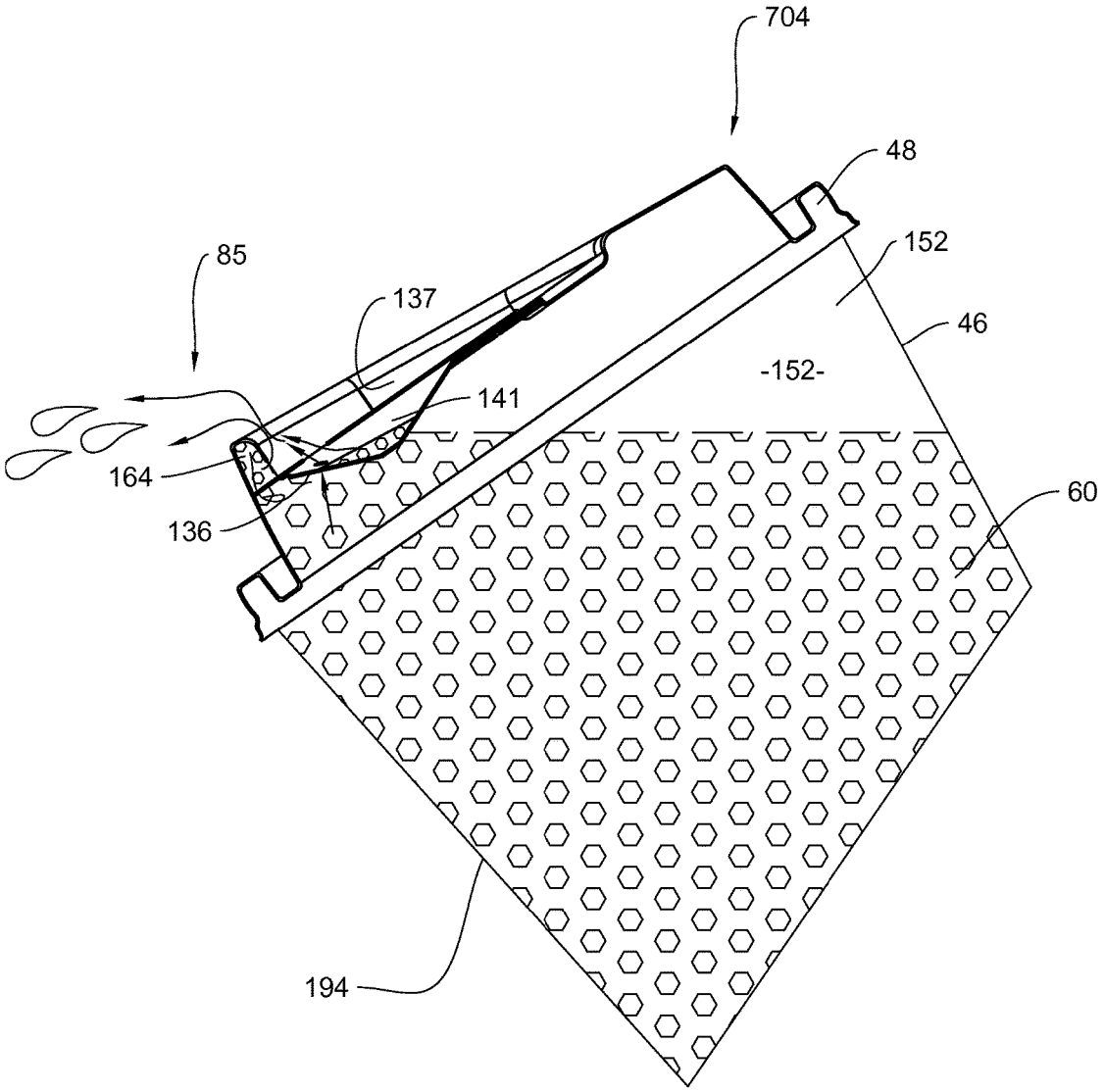

FIG. 70A is an enlarged view of the content otherwise shown in FIG. 70, enlarged to show in greater detail those structures depicted in FIG. 70.

Figure 71:
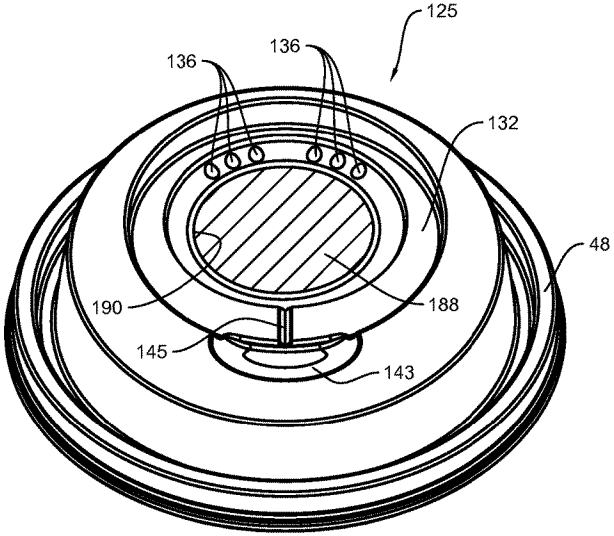

FIG. 71 is a top perspective view of an alternative slightly modified second primary lid form of the second beverage container lid assembly according to the present invention.

Figure 72:
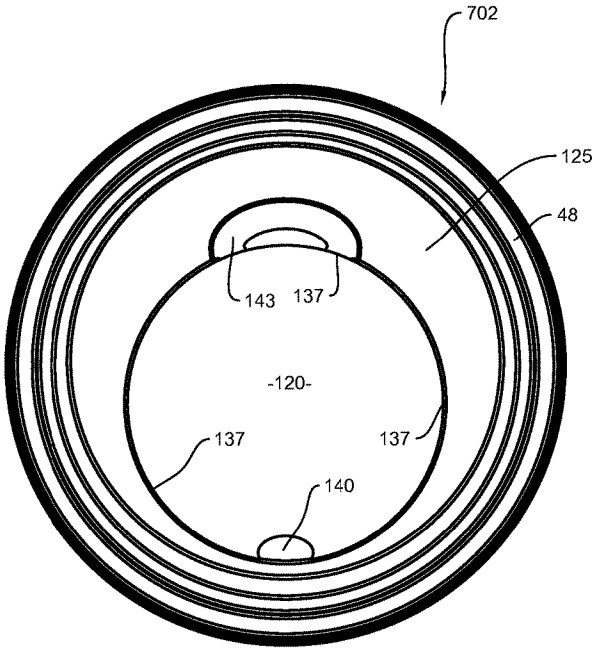

FIG. 72 is a top plan view of the second beverage container lid assembly according to the present invention.

Figure 74:
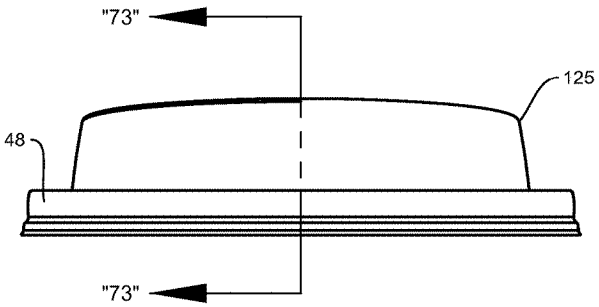
Figure 73:
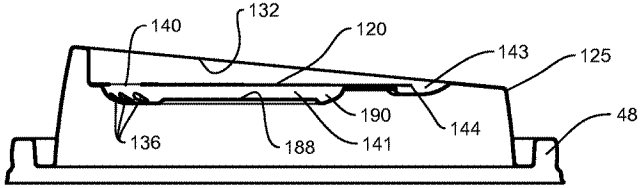

FIG. 73 is an anterior-posterior longitudinal cross-sectional view of the second beverage container lid assembly according to the present invention as sectioned from FIG. 74 and shown with the alternative slightly modified second primary lid form.

FIG. 74 is a top plan view of the second beverage container lid assembly according to the present invention.

Figure 75:
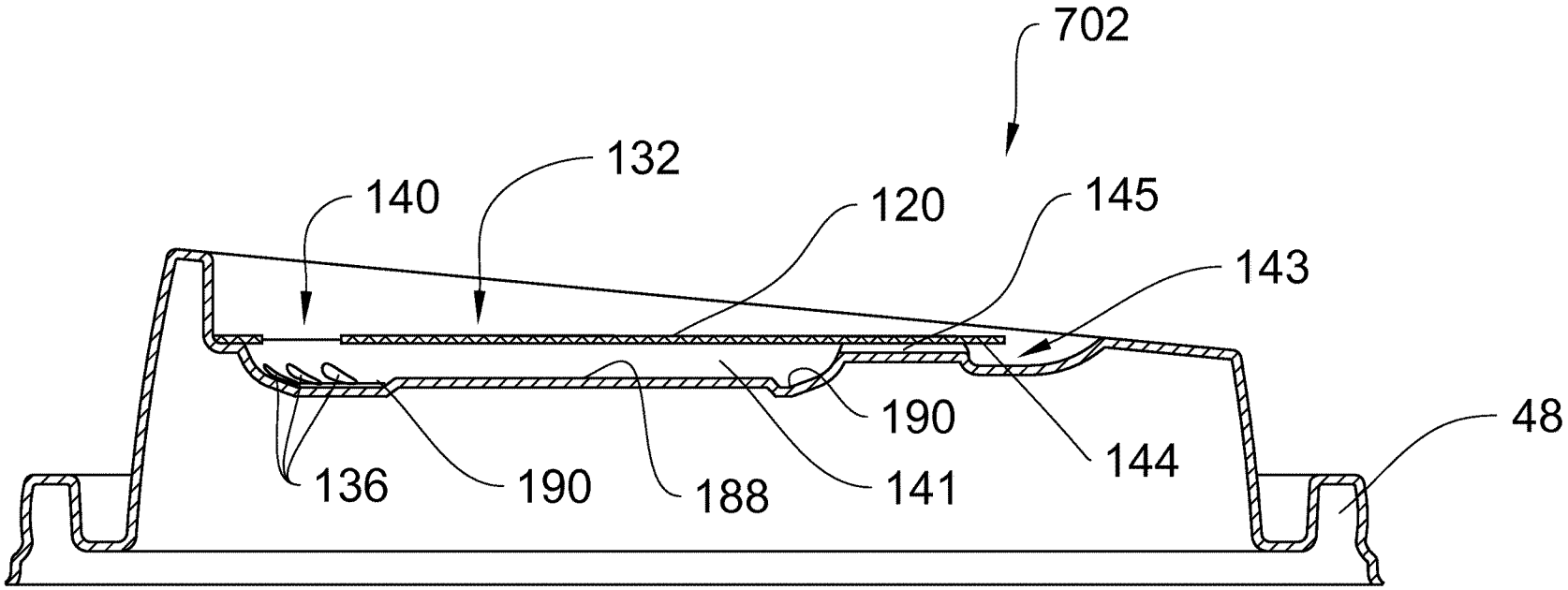

FIG. 75 is an enlarged anterior-posterior longitudinal cross-sectional view of the second beverage container lid assembly according to the present invention shown with the alternative slightly modified second primary lid form and enlarged to show in greater detail the structures associated with the beverage outlet depression.

Figure 76:
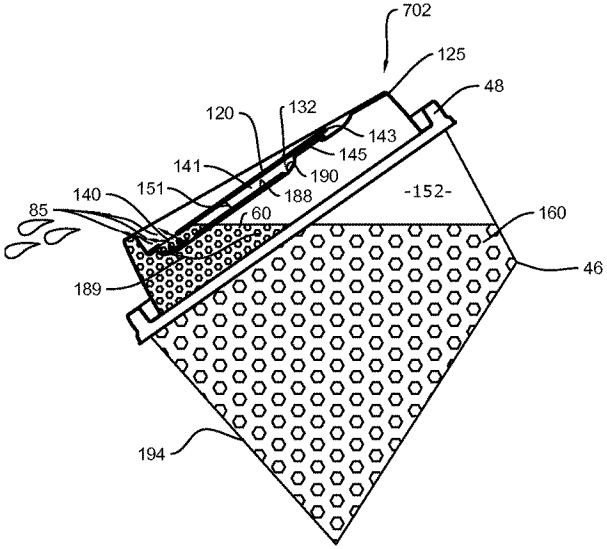

FIG. 76 is a first sequential schematic longitudinal cross-sectional type depiction of a beverage container outfitted with the second beverage container lid assembly according to the present invention shown in a first angle of inclination off of a vertical orientation for inletting beverage via letting apertures formed in the second secondary lid attachment into a beverage-receiving compartment of the second beverage container lid assembly.

Figure 77:
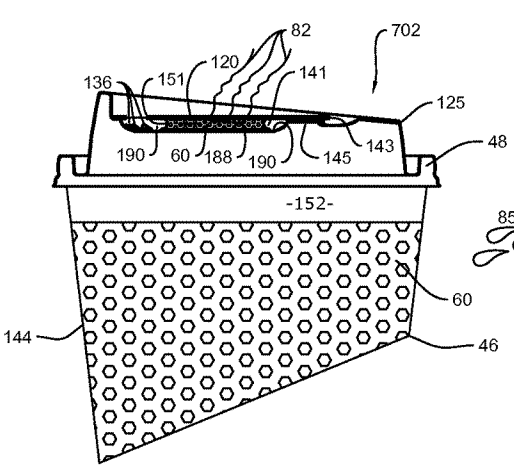

FIG. 77 is a second sequential schematic longitudinal cross-sectional type depiction of a beverage container outfitted with the second beverage container lid assembly according to the present invention shown in a vertical orientation with beverage received and pooled within the beverage-receiving compartment of the second beverage container lid assembly.

Figure 78:
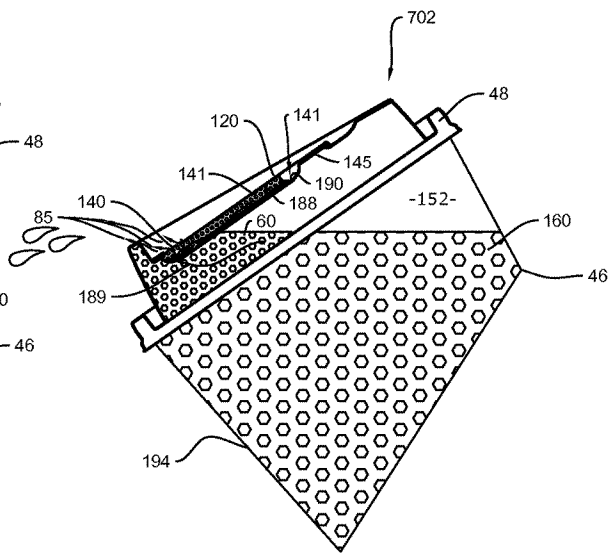

FIG. 78 is a third sequential schematic longitudinal cross-sectional type depiction of a beverage container outfitted with the second beverage container lid assembly according to the present invention shown in a second angle of inclination off of a vertical orientation for outletting cooled beverage via the primary beverage outlet of the primary lid form of the second beverage container lid assembly.

Figure 79:
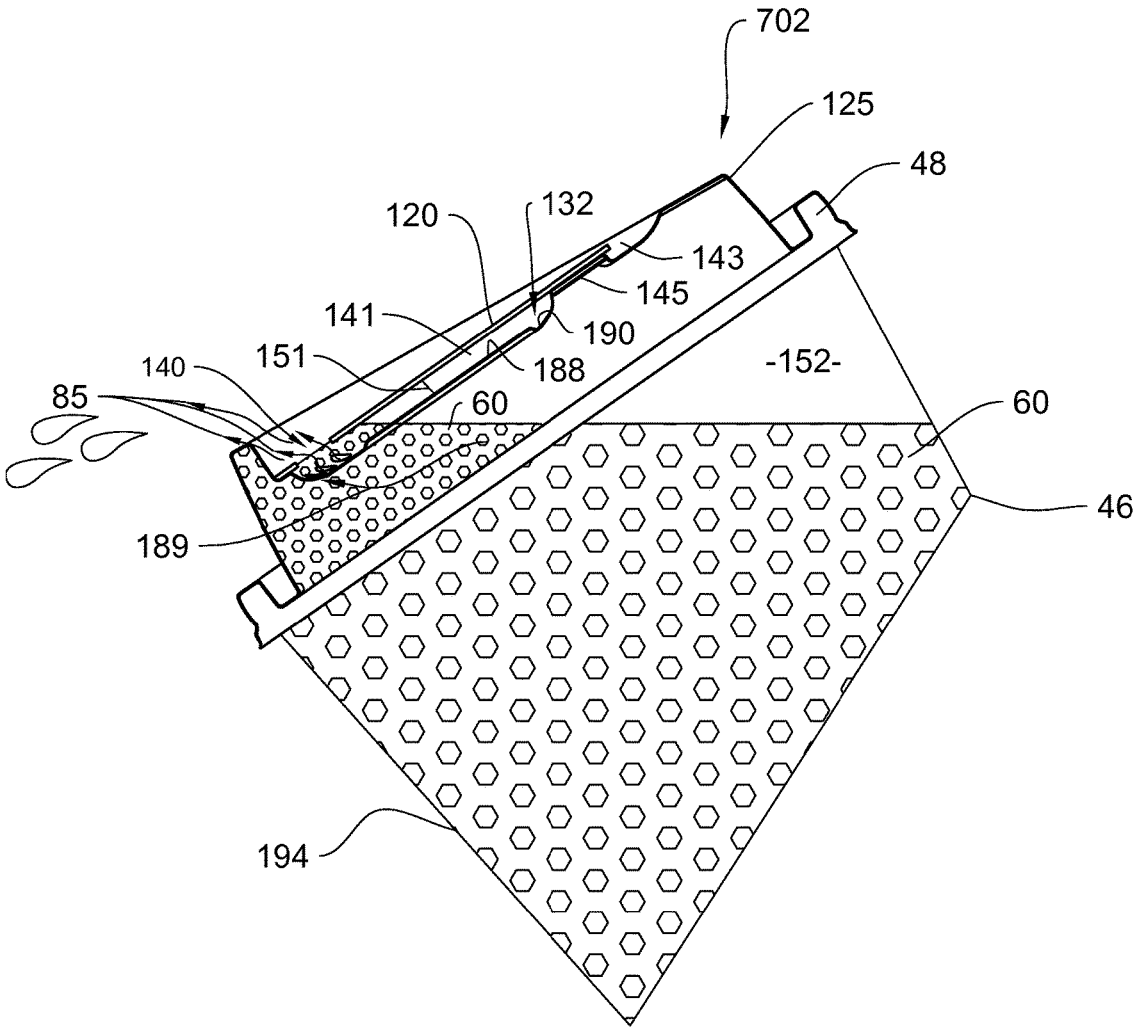

FIG. 79 is an enlarged first sequential schematic longitudinal cross-sectional type depiction of a beverage container outfitted with the second beverage container lid assembly according to the present invention shown in a first angle of inclination off of a vertical orientation for inletting beverage via letting apertures formed in the second secondary lid attachment into a beverage-receiving compartment of the second beverage container lid assembly.

Figure 80:
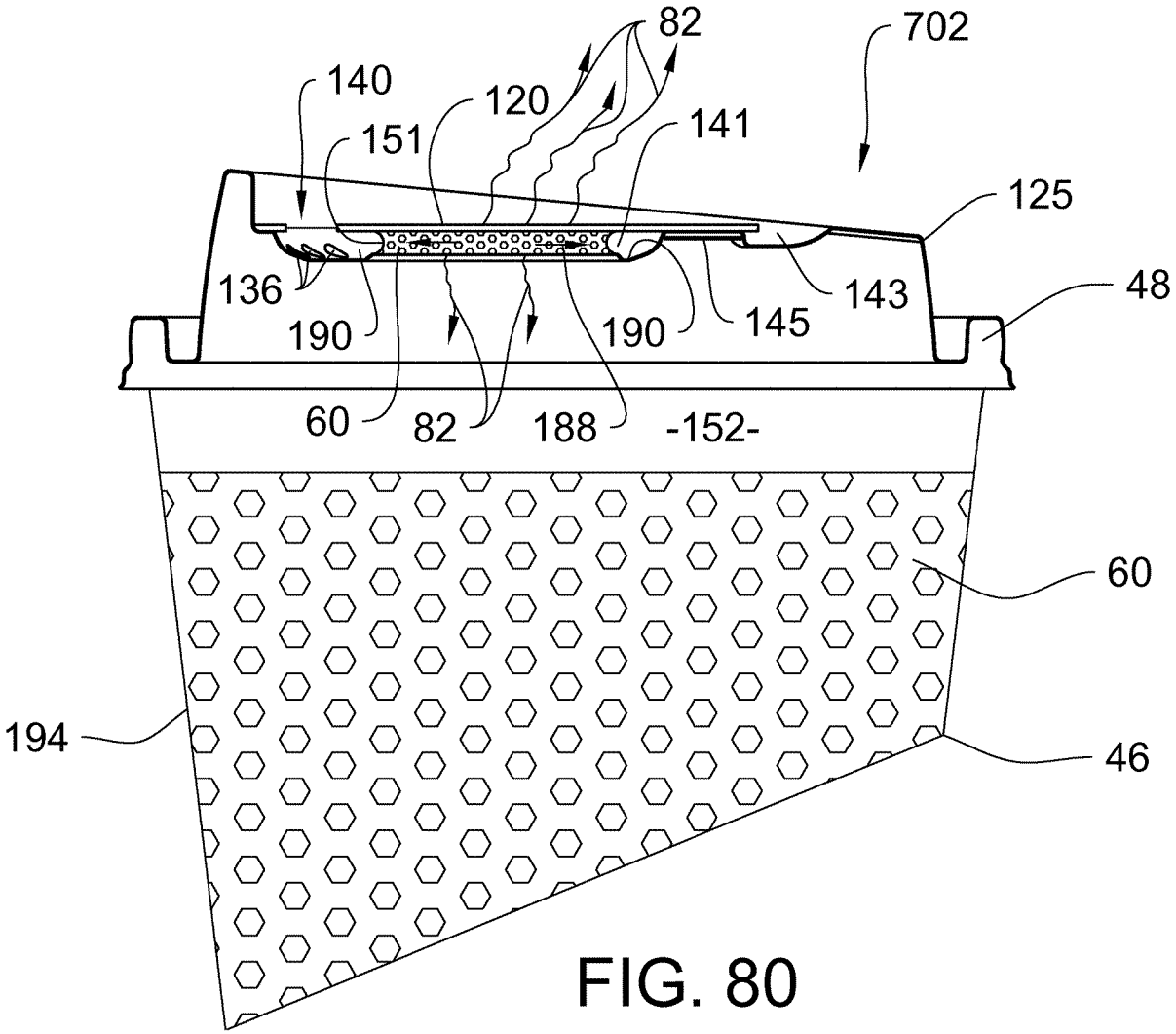

FIG. 80 is an enlarged second sequential schematic longitudinal cross-sectional type depiction of a beverage container outfitted with the second beverage container lid assembly according to the present invention shown in a vertical orientation with beverage received and pooled within the beverage-receiving compartment of the second beverage container lid assembly.

Figure 81:
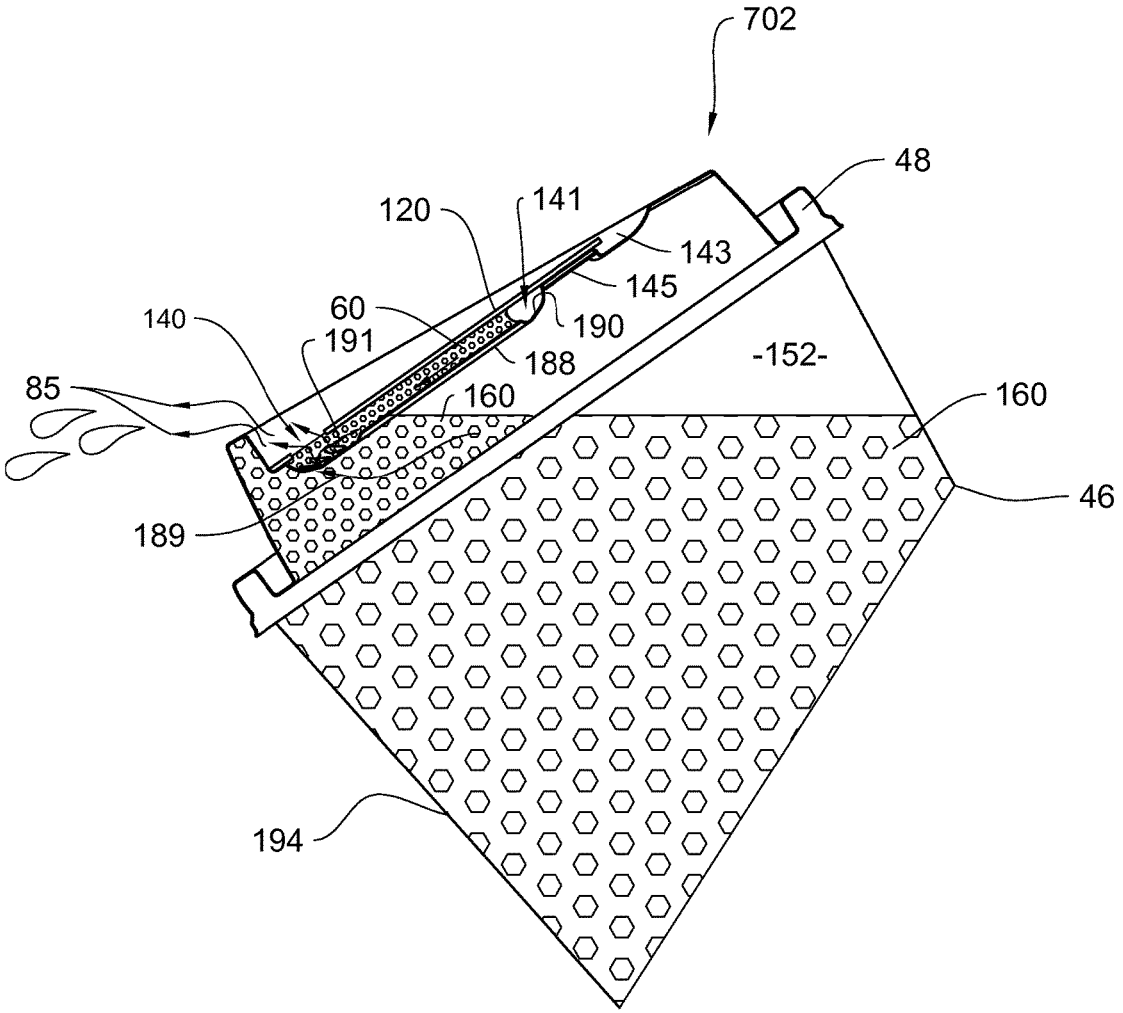

FIG. 81 is an enlarged third sequential schematic longitudinal cross-sectional type depiction of a beverage container outfitted with the second beverage container lid assembly according to the present invention shown in a second angle of inclination off of a vertical orientation for outletting cooled beverage via the primary beverage outlet of the primary lid form of the second beverage container lid assembly.

Figure 82:
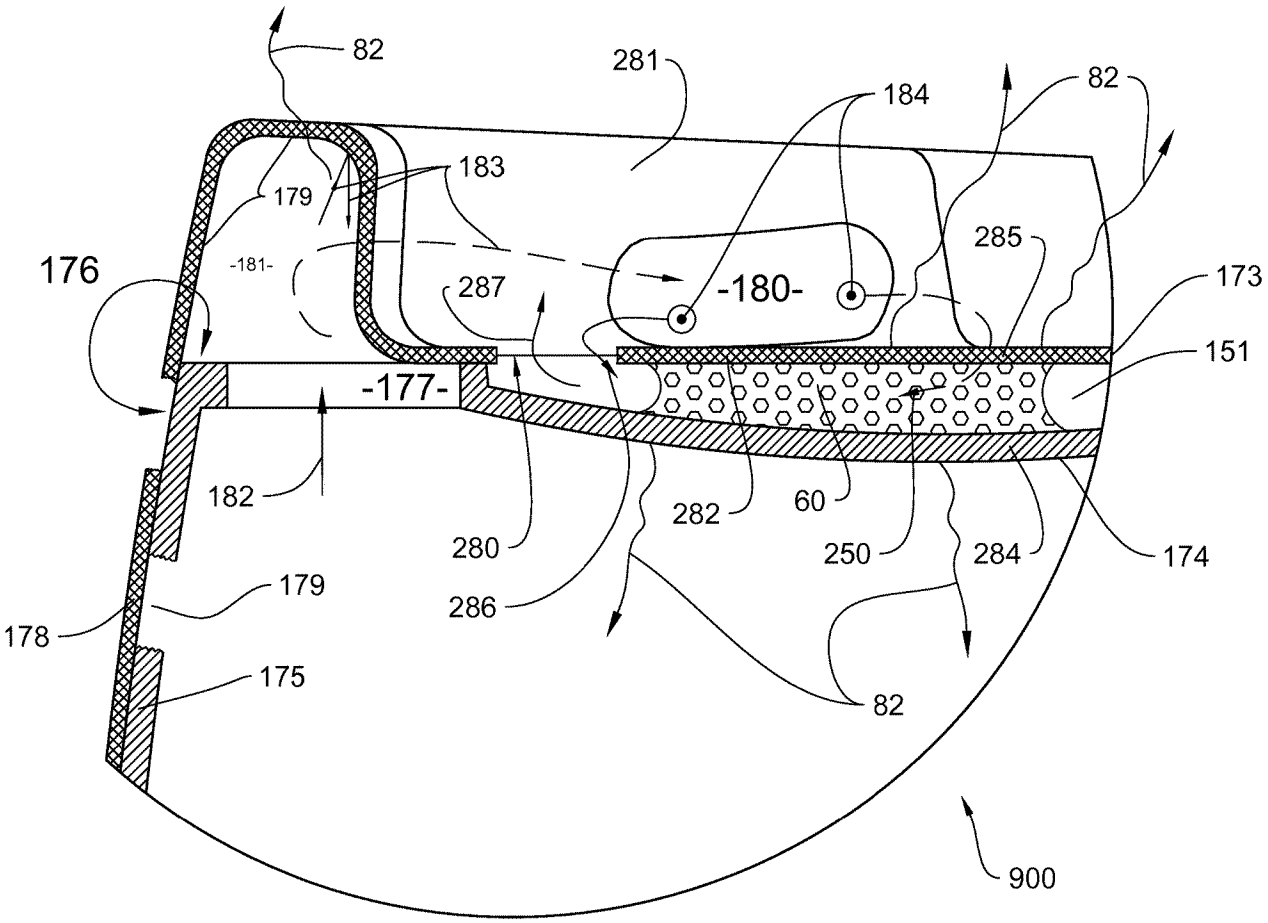
Figure 83:
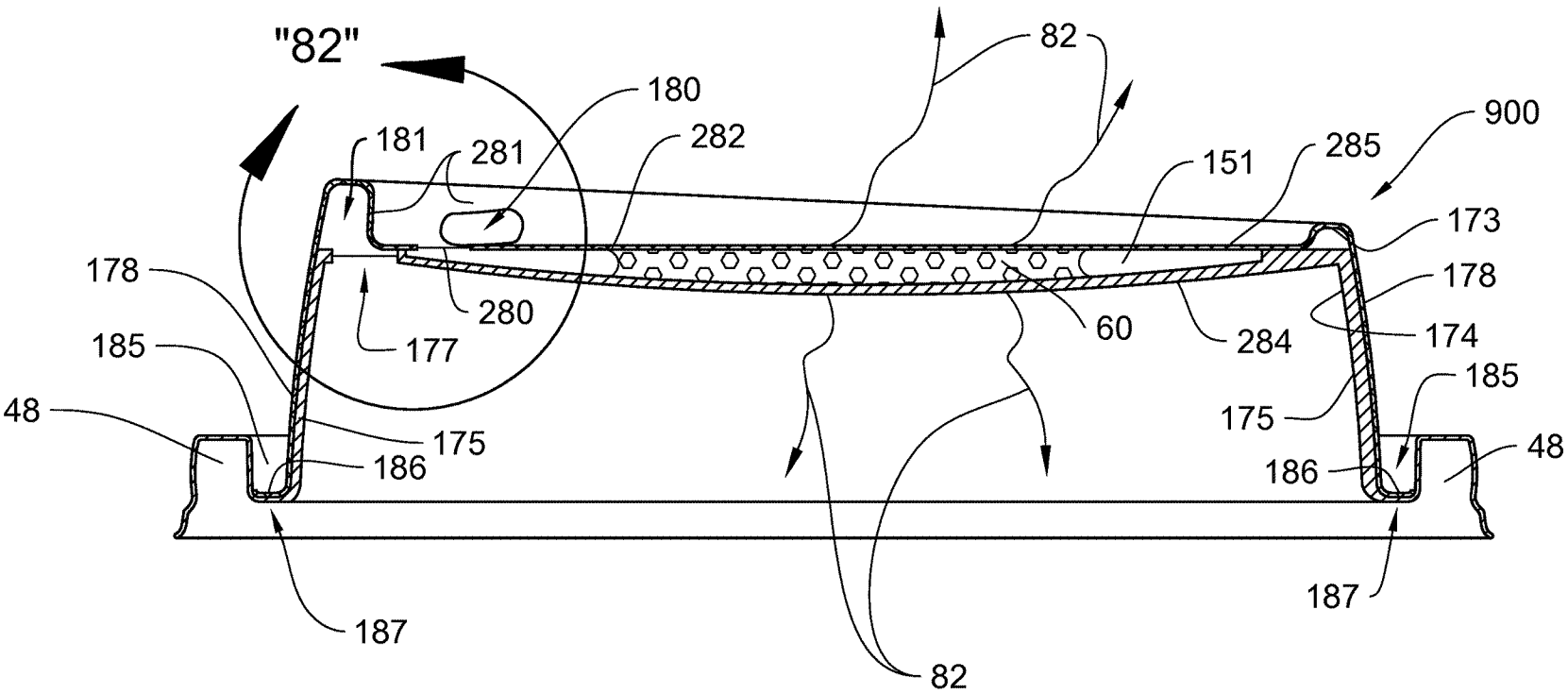

FIG. 82 is an enlarged fragmentary sectional view of a shroud-to-lid junction site of a sixth beverage container lid assembly according to the present invention as sectioned from FIG. 83 and enlarged to show in greater detail those structures of the shroud-to-lid junction site.

FIG. 83 is an anterior-posterior longitudinal cross-sectional view of the sixth beverage container lid assembly according to the present invention depicting a beverage-receiving compartment intermediate an upper lid shroud and a lower container lid.

Figure 84:
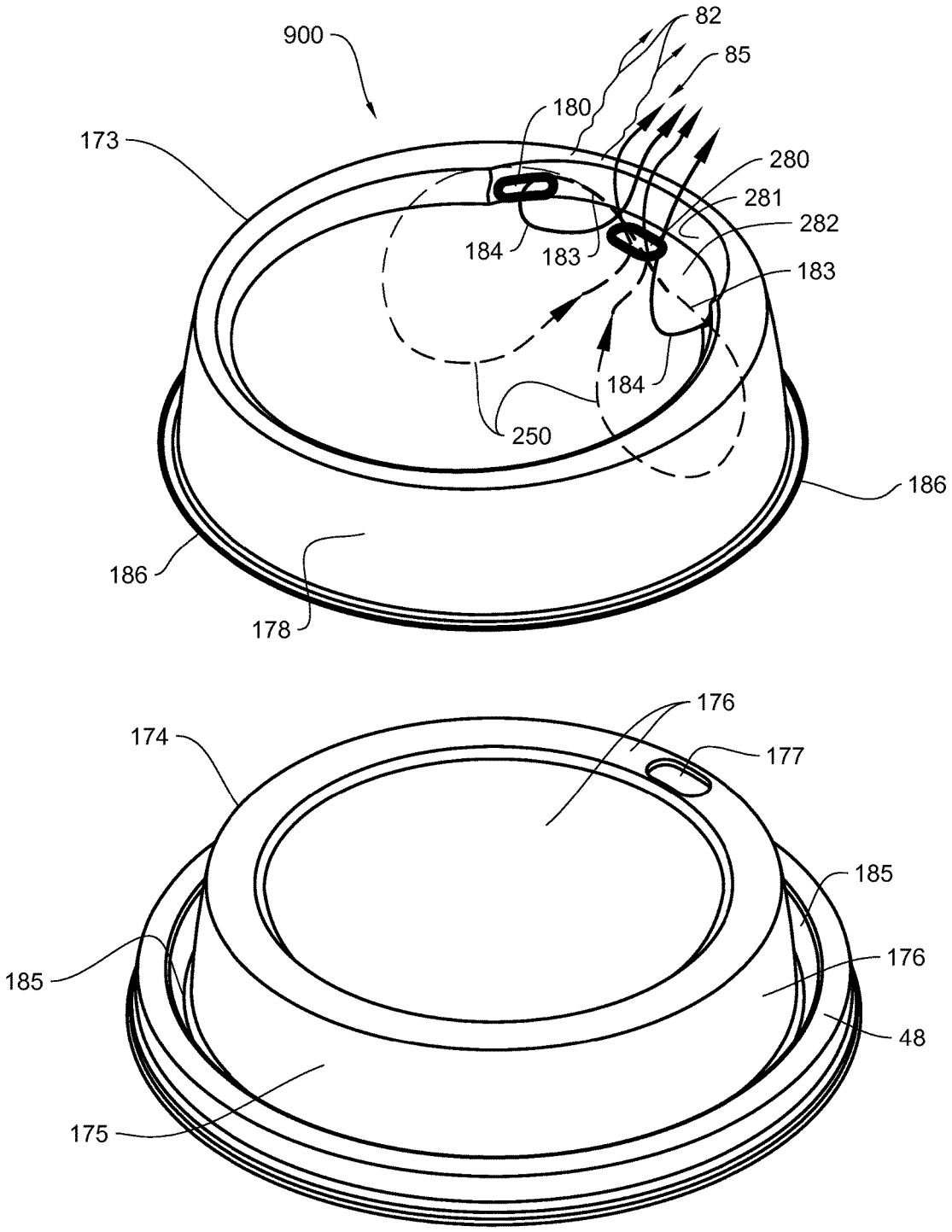

FIG. 84 is an exploded top perspective view of the sixth beverage container lid assembly according to the present invention depicting a lid shroud exploded in superior adjacency to a container lid.

Figure 85:
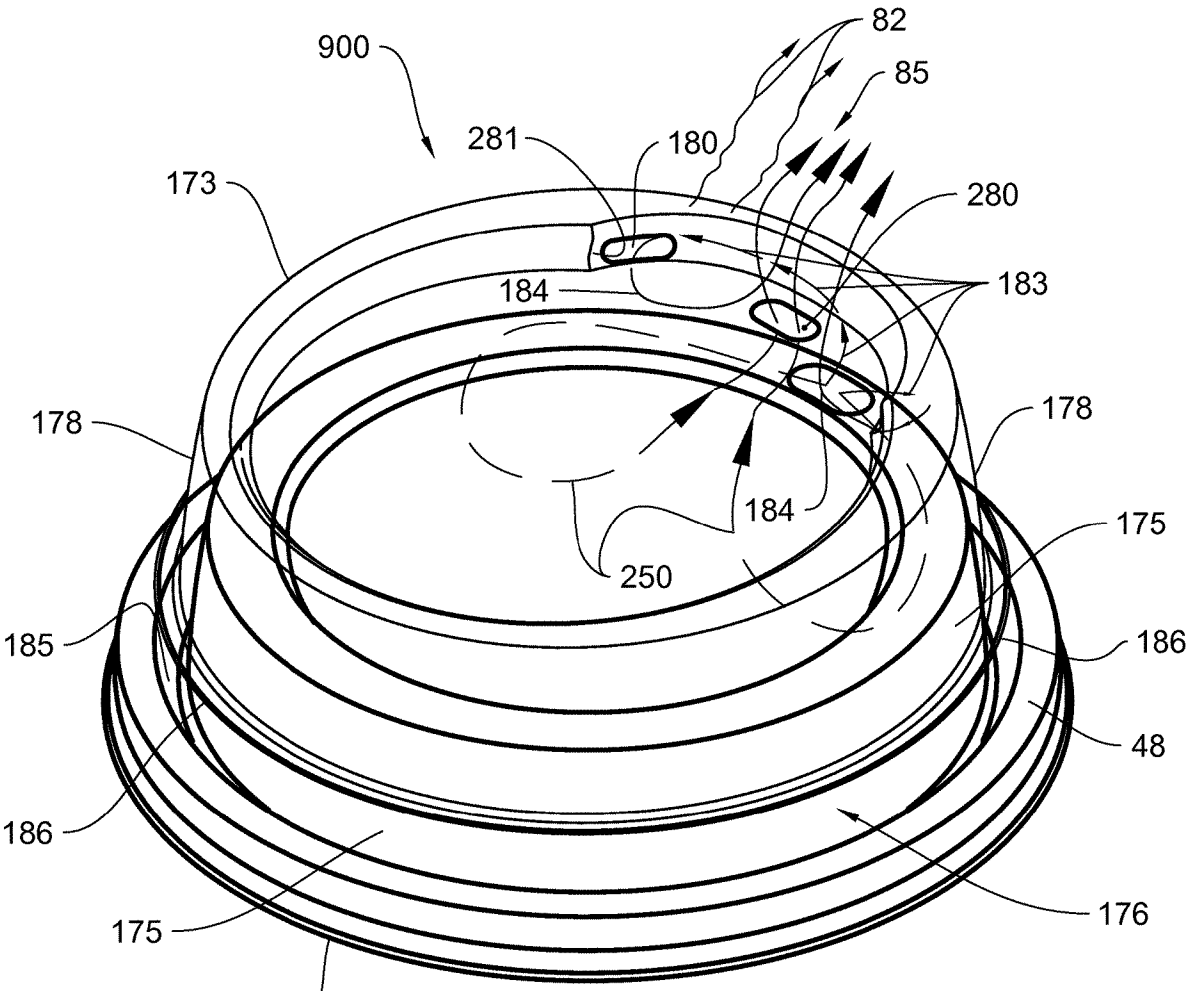

FIG. 85 is an assembled top perspective view of the sixth beverage container lid assembly according to the present invention.

Figure 86:
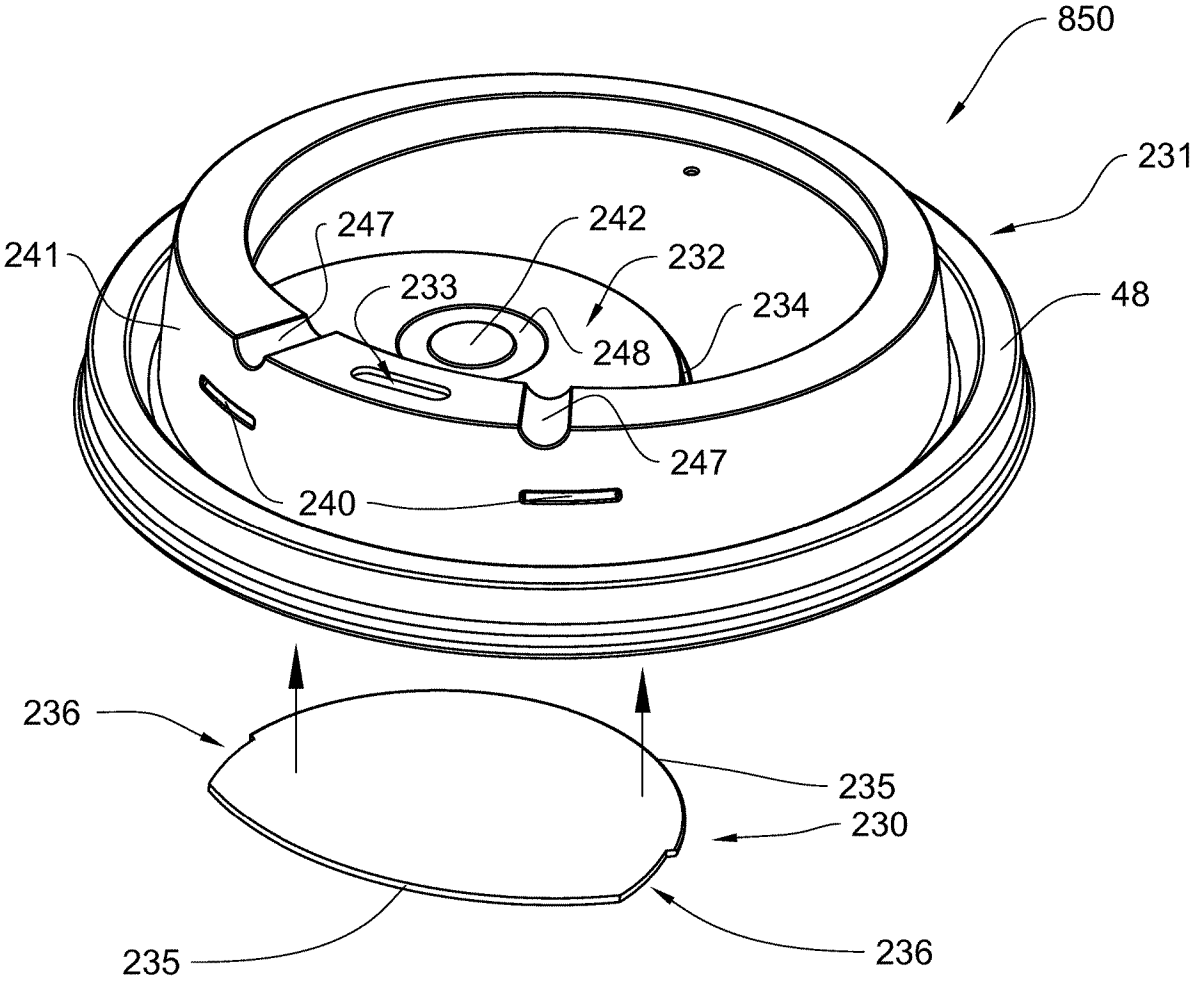

FIG. 86 is an exploded top perspective view of a seventh beverage container lid assembly according to the present invention depicting a seventh primary lid form exploded in superior adjacency to a seventh secondary lid attachment.

Figure 86A:
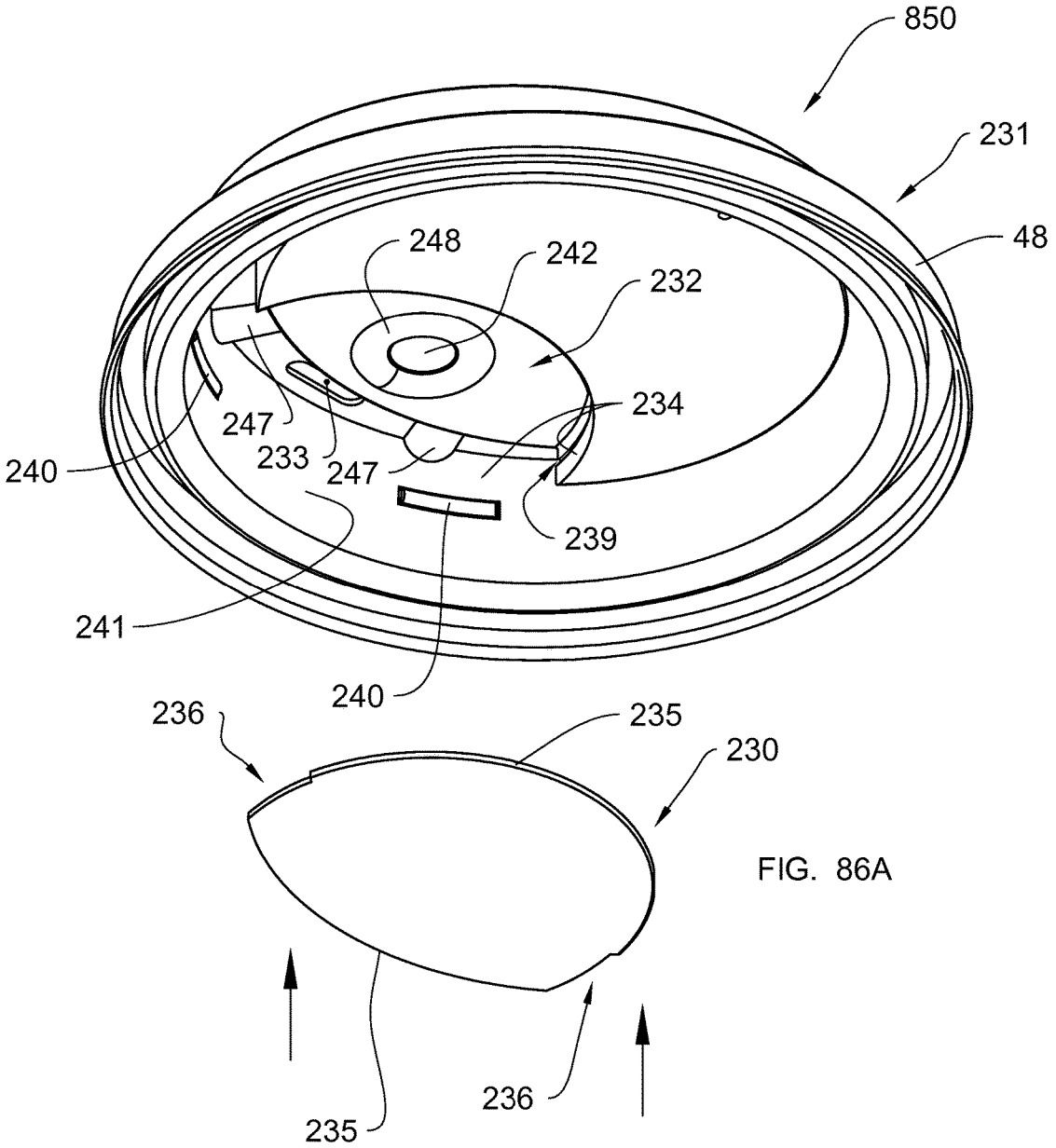

FIG. 86A is an exploded bottom perspective view of the seventh beverage container lid assembly according to the present invention depicting the seventh primary lid form exploded in superior adjacency to the seventh secondary lid attachment.

Figure 87:
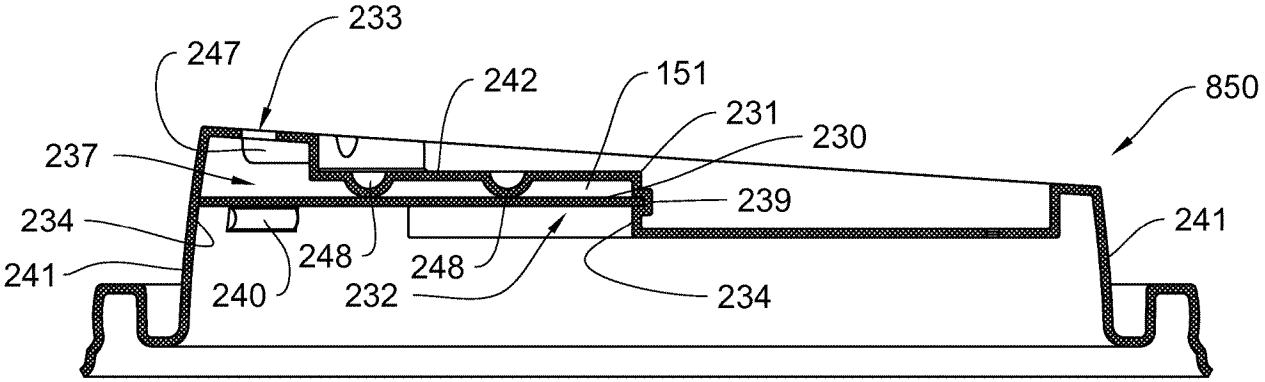

FIG. 87 is a sequentially first anterior-posterior longitudinal cross-sectional view of the seventh beverage container lid assembly according to the present invention depicting a beverage-receiving compartment intermediate the upper seventh primary lid form and the lower seventh secondary lid attachment, a push button of the seventh secondary lid attachment being shown in an non-actuated attachment-retentive position.

Figure 88:
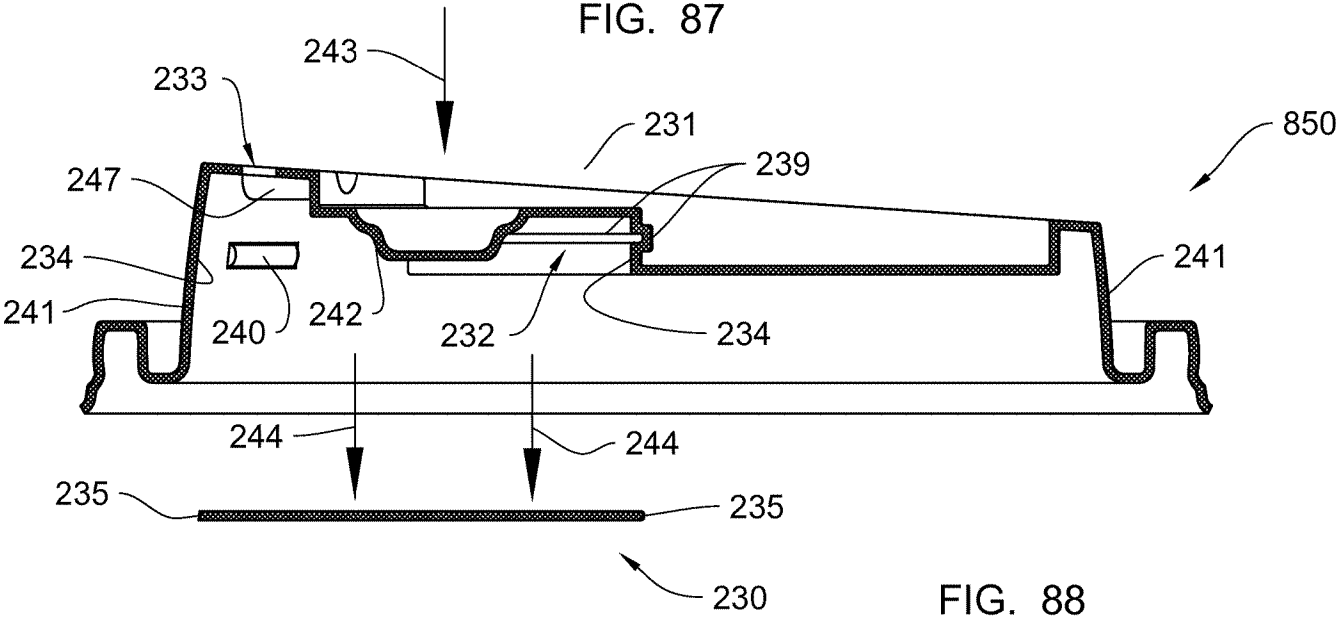

FIG. 88 is a sequentially second anterior-posterior longitudinal cross-sectional view of the seventh beverage container lid assembly according to the present invention depicting the push button of the seventh secondary lid attachment being shown in an actuated attachment-removing position, the seventh secondary lid attachment being exploded from the seventh primary lid form.

Figure 89:
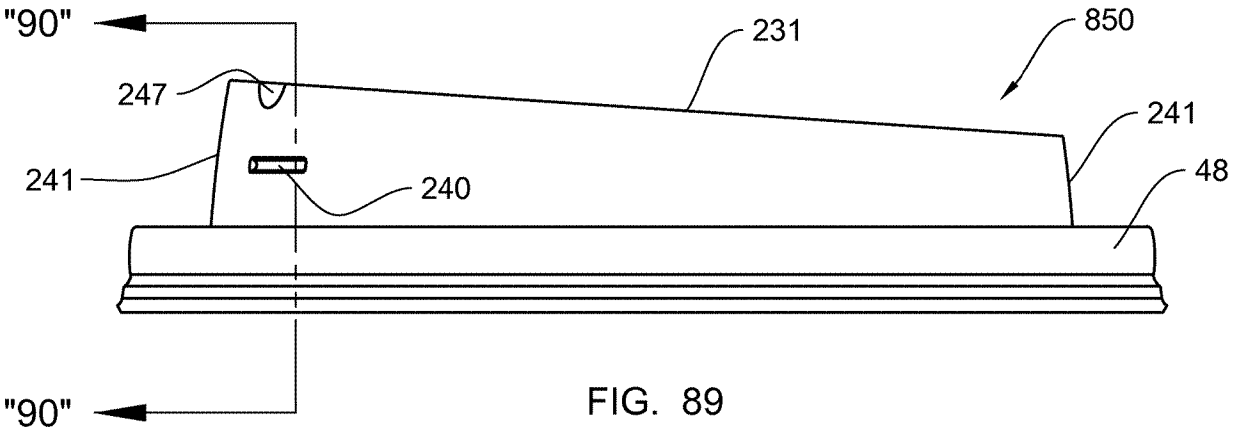

FIG. 89 is a first lateral elevational view of the seventh beverage container lid assembly according to the present invention.

Figure 90:
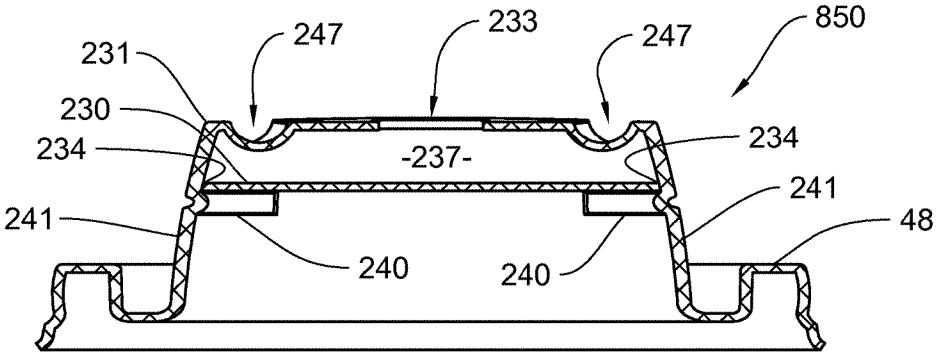

FIG. 90 is a lateral cross-sectional view of the seventh beverage container lid assembly according to the present invention as sectioned from FIG. 89.

Figure 91:
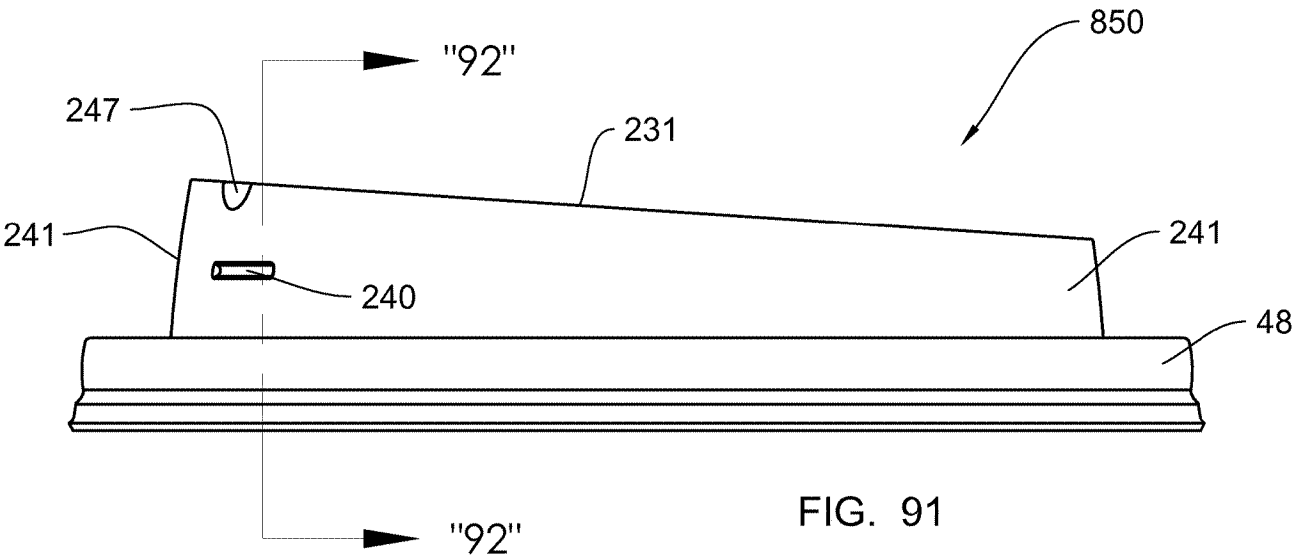

FIG. 91 is a second lateral elevational view of the seventh beverage container lid assembly according to the present invention.

Figure 92:
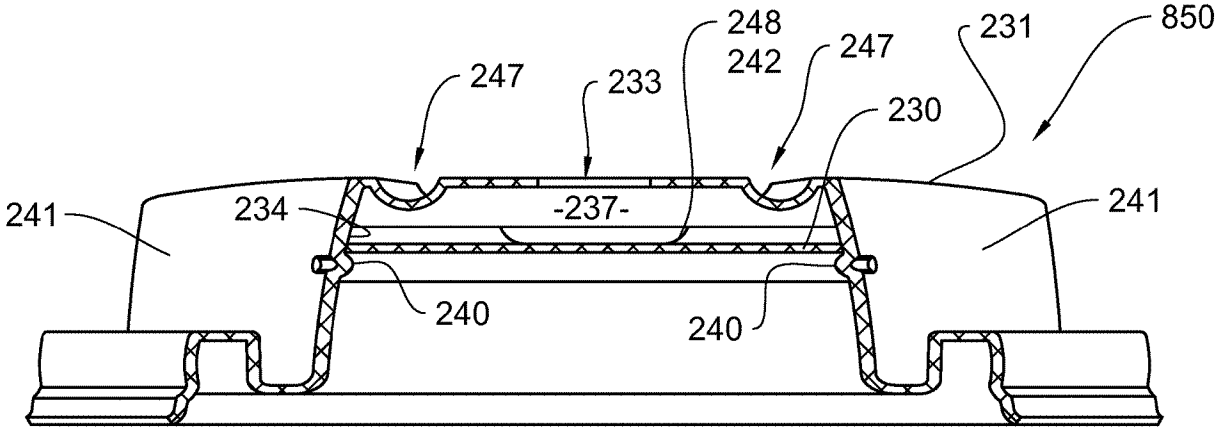

FIG. 92 is a lateral cross-sectional view of the seventh beverage container lid assembly according to the present invention as sectioned from FIG. 91.

Figure 93:
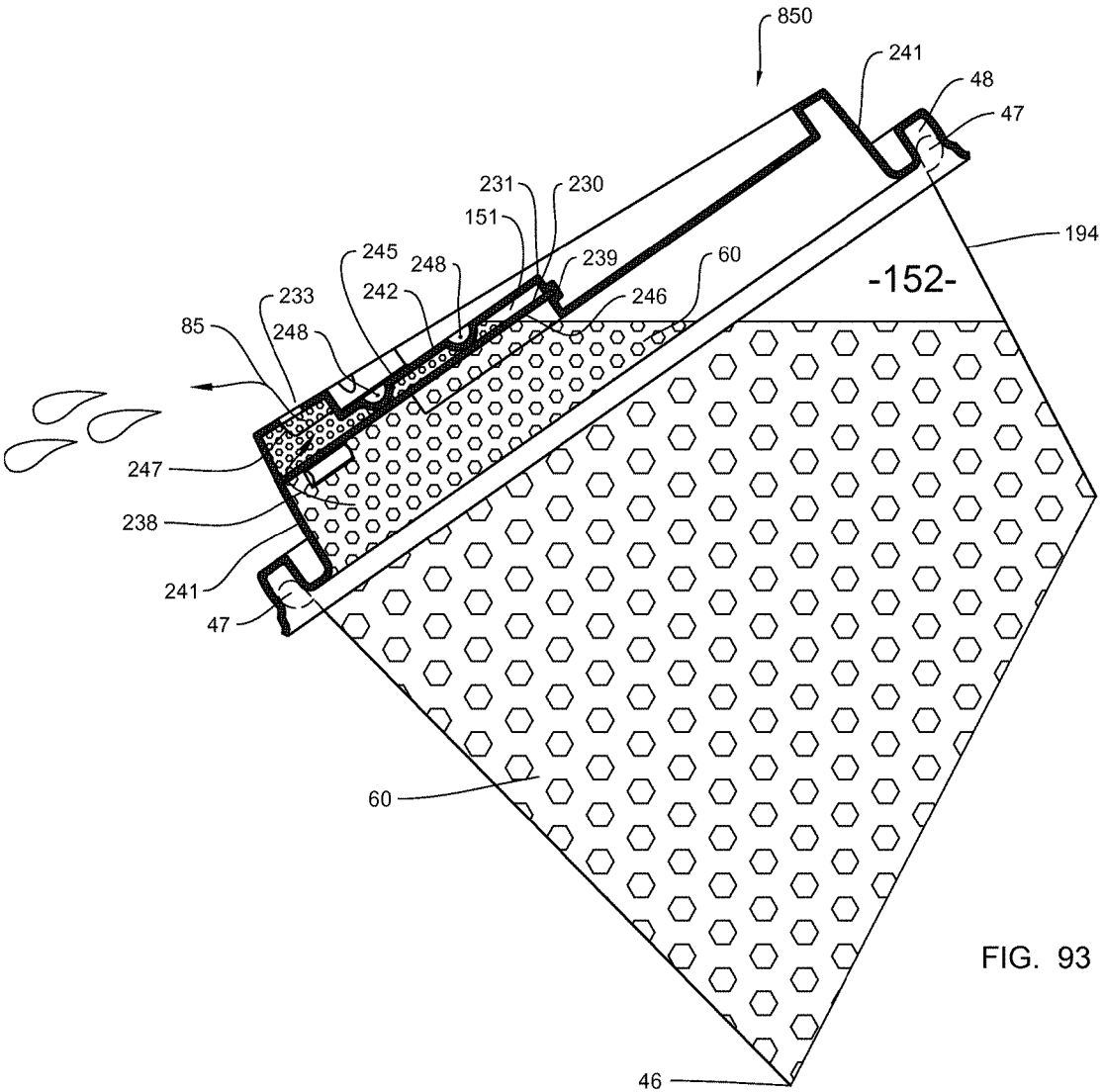

FIG. 93 is an enlarged first sequential schematic longitudinal cross-sectional type depiction of a beverage container outfitted with the seventh beverage container lid assembly according to the present invention shown in a first angle of inclination off of a vertical orientation for inletting beverage via letting apertures formed in the seventh secondary lid attachment into a beverage-receiving compartment of the seventh beverage container lid assembly.

Figure 94:
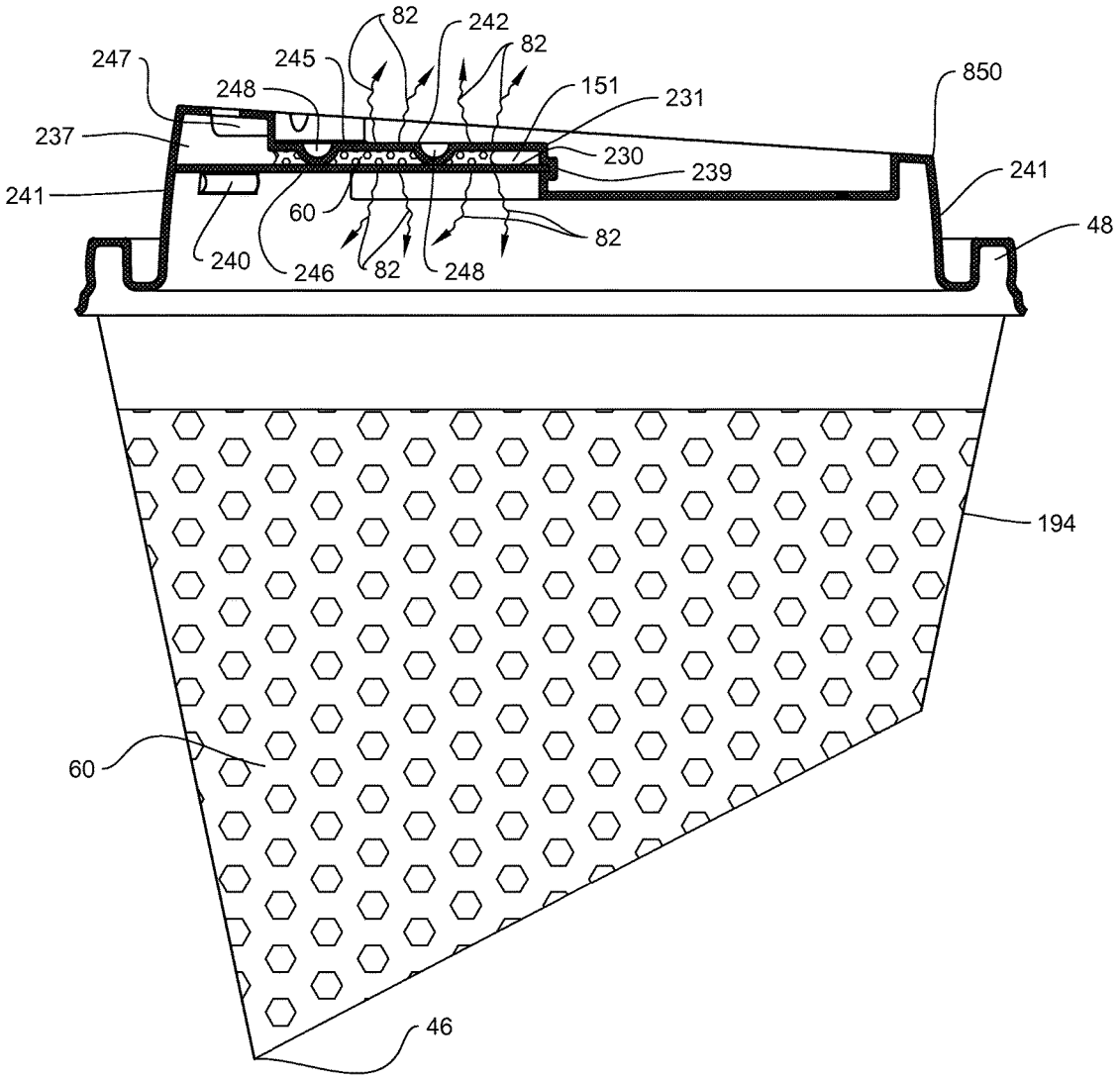

FIG. 94 is an enlarged second sequential schematic longitudinal cross-sectional type depiction of a beverage container outfitted with the seventh beverage container lid assembly according to the present invention shown in a vertical orientation with beverage received and pooled within the beverage-receiving compartment of the seventh beverage container lid assembly.

Figure 95:
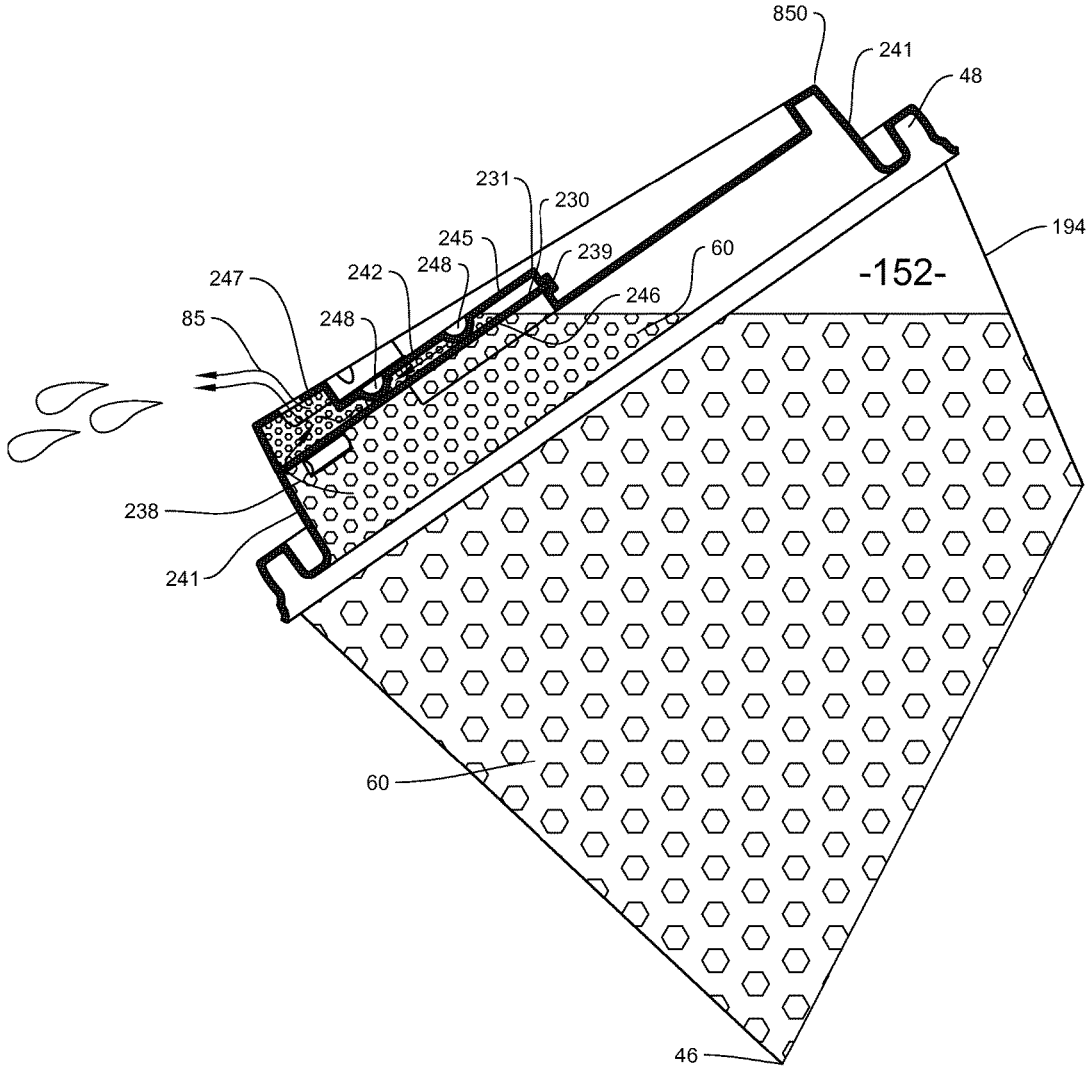

FIG. 95 is an enlarged third sequential schematic longitudinal cross-sectional type depiction of a beverage container outfitted with the seventh beverage container lid assembly according to the present invention shown in a second angle of inclination off of a vertical orientation for outletting cooled beverage via the primary beverage outlet of the primary lid form of the seventh beverage container lid assembly.

Figure 96:
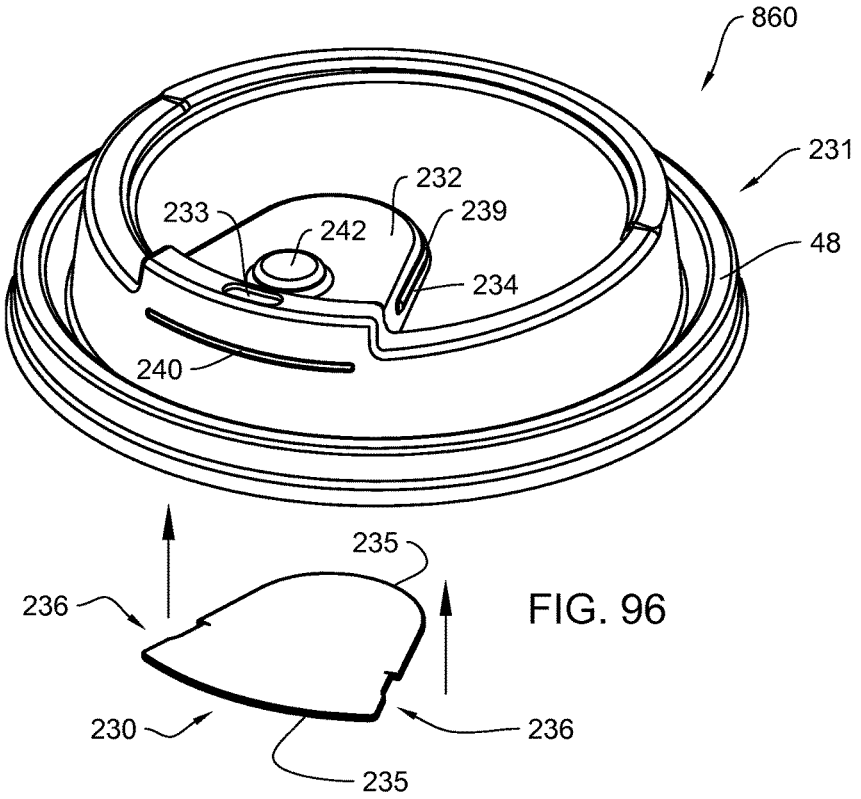

FIG. 96 is an exploded top perspective view of an eighth beverage container lid assembly according to the present invention depicting an eighth primary lid form exploded in superior adjacency to an eighth secondary lid attachment.

Figure 96A:
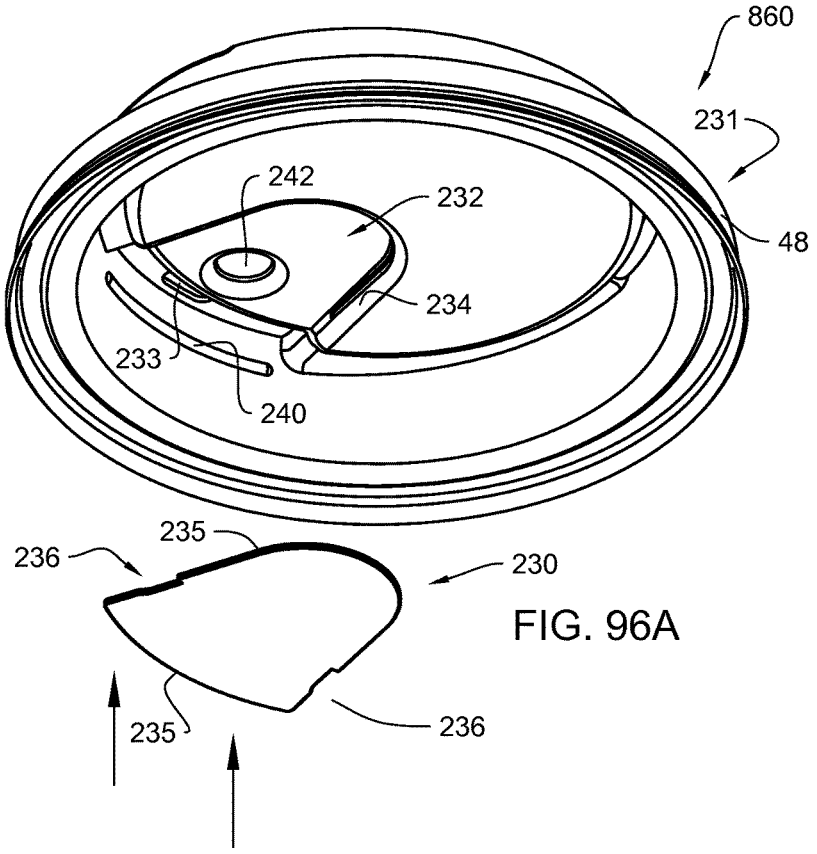

FIG. 96A is an exploded bottom perspective view of the eighth beverage container lid assembly according to the present invention depicting the eighth primary lid form exploded in superior adjacency to the eighth secondary lid attachment.

Figure 97:
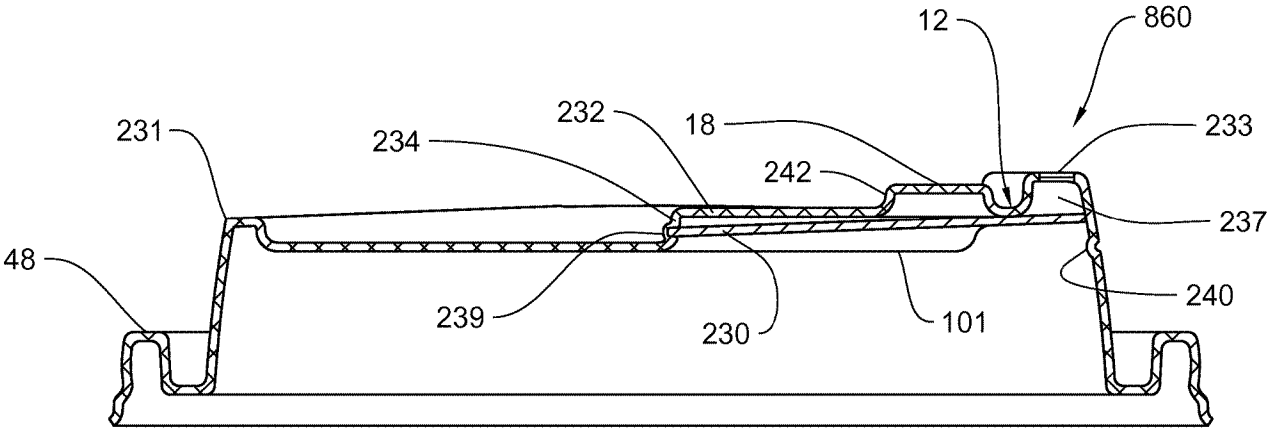

FIG. 97 is a sequentially first anterior-posterior longitudinal cross-sectional view of the eighth beverage container lid assembly according to the present invention depicting a beverage-receiving compartment intermediate the upper eighth primary lid form and the lower eighth secondary lid attachment, a push button structure of the eighth secondary lid attachment being shown in an non-actuated attachment-retentive position.

Figure 98:
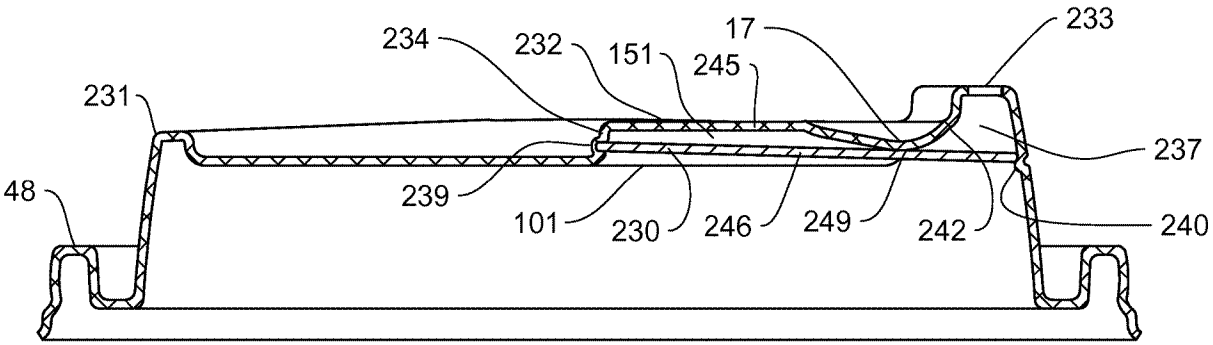

FIG. 98 is a sequentially second anterior-posterior longitudinal cross-sectional view of the eighth beverage container lid assembly according to the present invention depicting the push button structure of the eighth secondary lid attachment being shown in an actuated attachment-deflecting position, the eighth secondary lid attachment being deflected relative to the eighth primary lid form.

Figure 99:
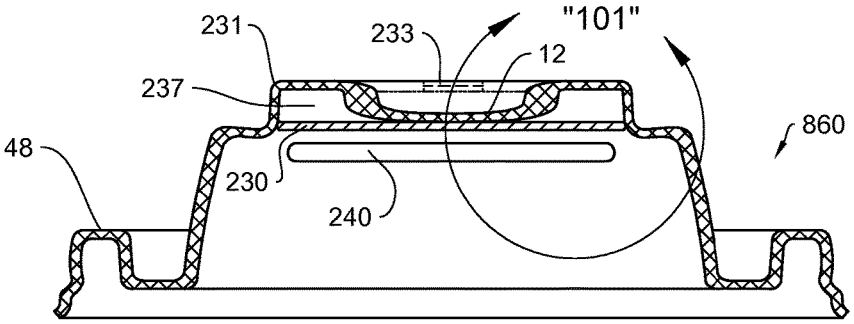
Figure 100:
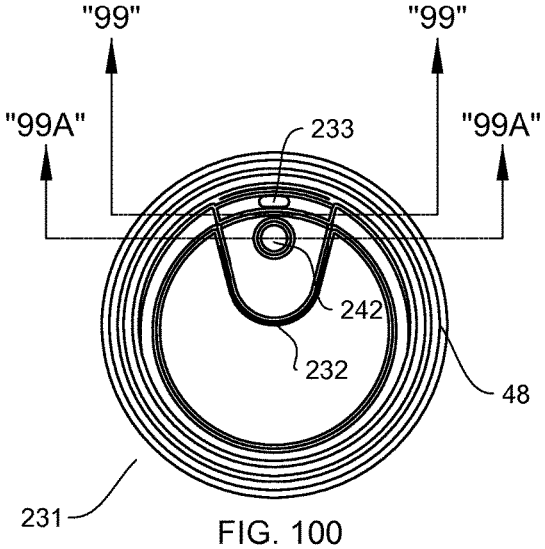

FIG. 99 is a first lateral cross-sectional view of the eighth beverage container lid assembly according to the present invention as sectioned from FIG. 100 depicting a depression of a push button structure of the eighth primary lid formation engaged with the eighth secondary lid attachment.

Figure 99A:
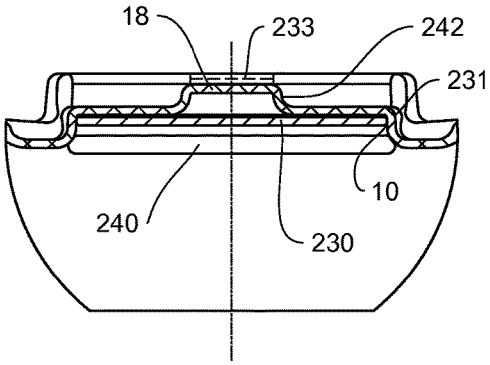

FIG. 99A is a second lateral cross-sectional view of the eighth beverage container lid assembly according to the present invention as sectioned from FIG. 100 depicting the push button structure of the eighth primary lid formation in an upright relaxed configuration.

FIG. 100 is a first top plan view of the eighth beverage container lid assembly according to the present invention.

Figure 101:
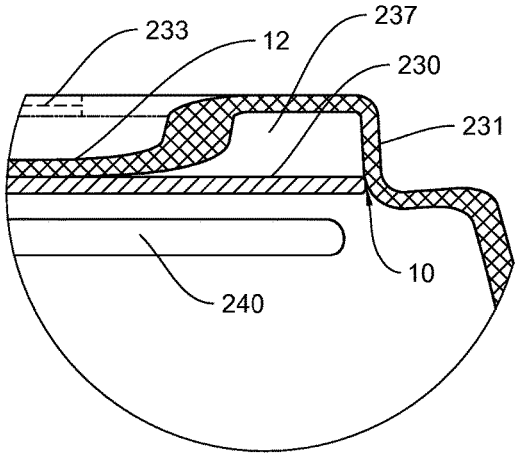

FIG. 101 is an enlarged, fragmentary sectional view of the junction site of the eighth secondary lid attachment and the eighth primary lid formation as sectioned and enlarged from FIG. 99 to show in greater detail structures at the junction site.

Figure 102:
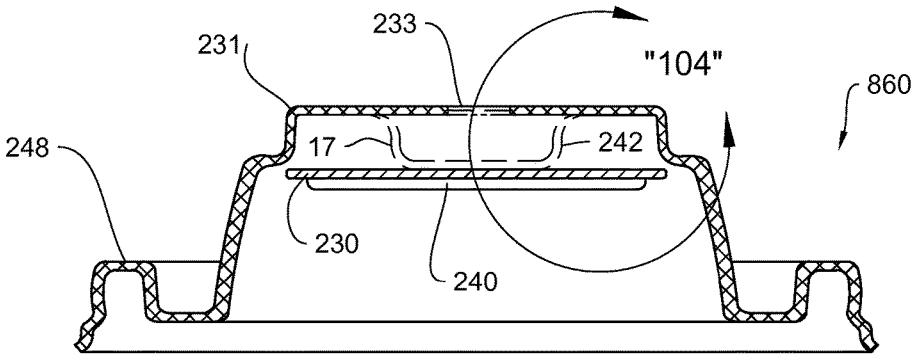
Figure 103:
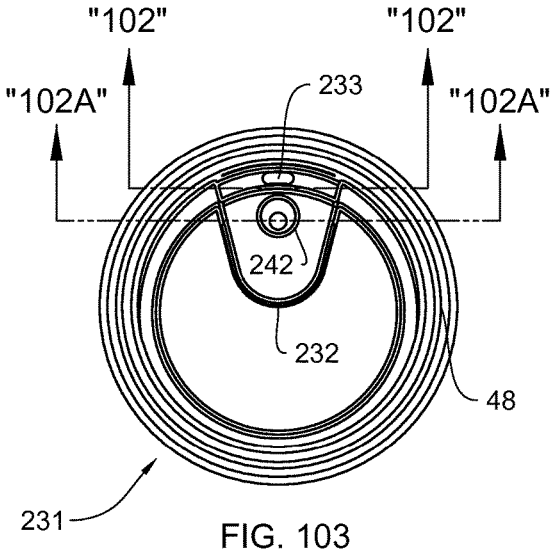

FIG. 102 is a first lateral cross-sectional view of the eighth beverage container lid assembly according to the present invention as sectioned from FIG. 103 depicting a downward position of the push button structure of the eighth primary lid formation deflecting the eighth secondary lid attachment in a downward direction.

Figure 102A:
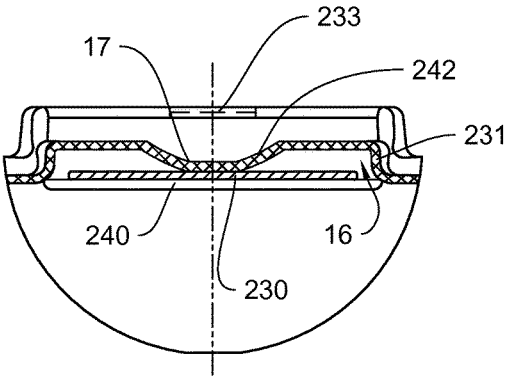

FIG. 102A is a second lateral cross-sectional view of the eighth beverage container lid assembly according to the present invention as sectioned from FIG. 103 depicting a downward position of the push button structure of the eighth primary lid formation deflecting the eighth secondary lid attachment in a downward direction.

FIG. 103 is a second top plan view of the eighth beverage container lid assembly according to the present invention.

Figure 104:
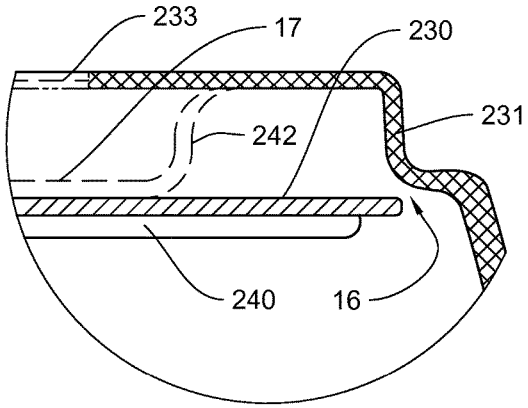

FIG. 104 is an enlarged, fragmentary sectional view of the junction site of the eighth secondary lid attachment and the eighth primary lid formation as sectioned and enlarged from FIG. 102 to show in greater detail structures at the junction site.

Figure 105:
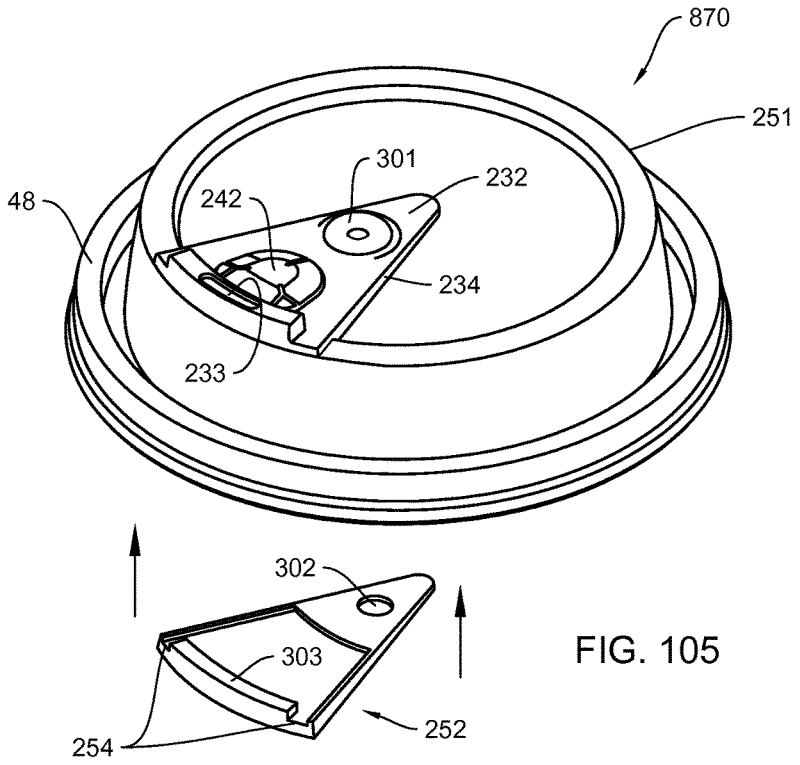

FIG. 105 is an exploded top perspective view of a ninth beverage container lid assembly according to the present invention depicting a ninth primary lid form exploded in superior adjacency to a ninth secondary lid attachment.

Figure 106:
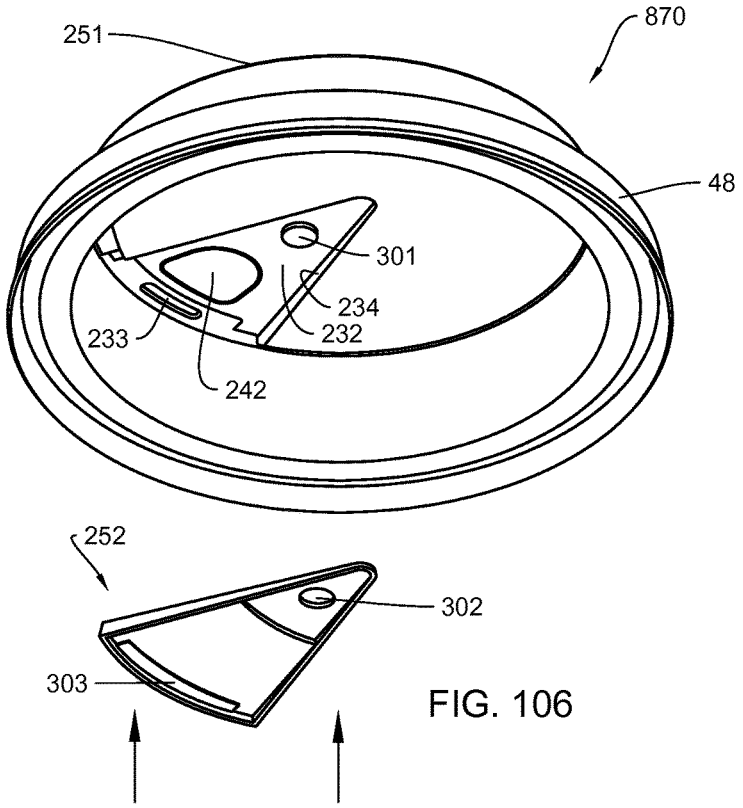

FIG. 106 is an exploded bottom perspective view of the ninth beverage container lid assembly according to the present invention depicting the ninth primary lid form exploded in superior adjacency to the ninth secondary lid attachment.

Figure 107:
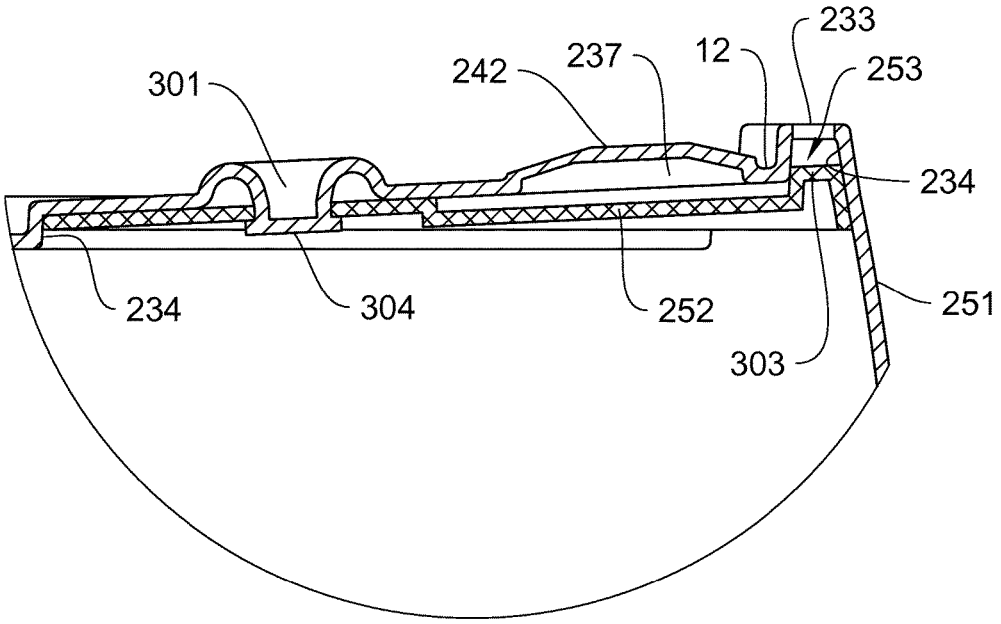
Figure 108:
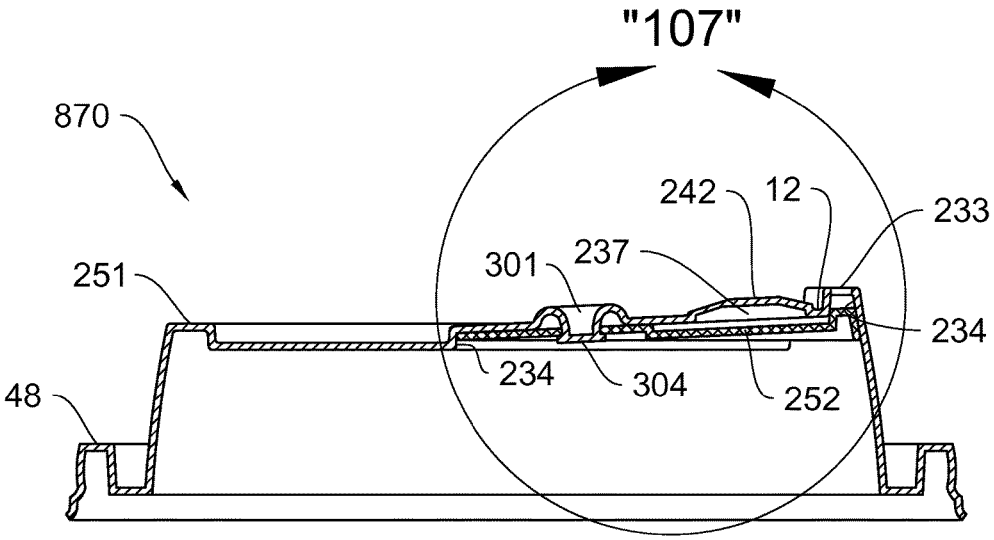

FIG. 107 is an enlarged, fragmentary sectional view of the junction site of the ninth secondary lid attachment and the ninth primary lid formation as sectioned and enlarged from FIG. 108 to show in greater detail structures at the junction site.

FIG. 108 is a sequentially first anterior-posterior longitudinal cross-sectional view of the ninth beverage container lid assembly according to the present invention depicting a beverage-receiving compartment intermediate the upper ninth primary lid form and the lower ninth secondary lid attachment, and first and second push button structures of the ninth secondary lid attachment being shown in non-actuated positions.

Figure 109:
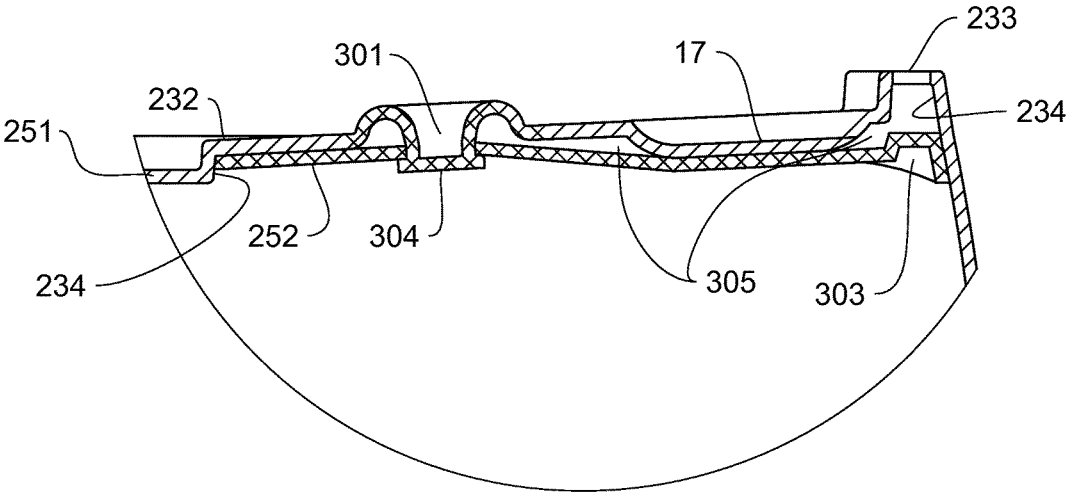
Figure 110:
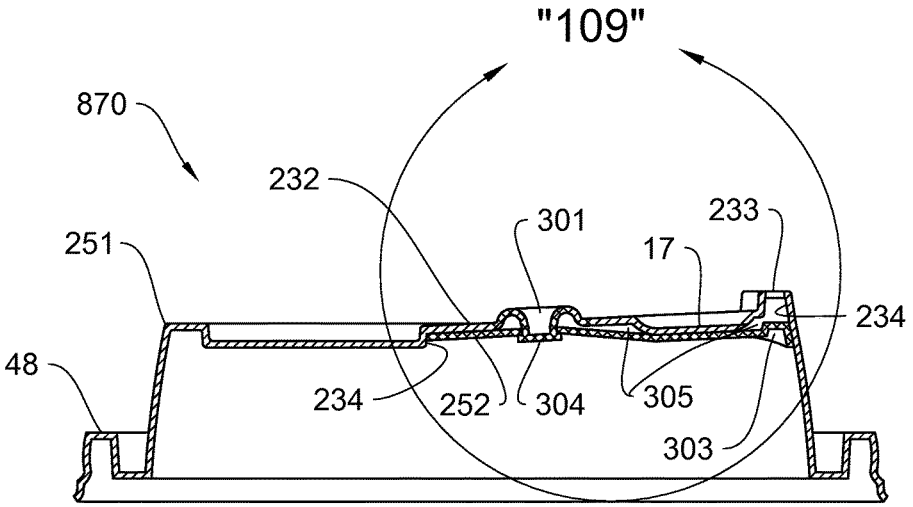

FIG. 109 is an enlarged, fragmentary sectional view of the junction site of the ninth secondary lid attachment and the ninth primary lid formation as sectioned and enlarged from FIG. 110 to show in greater detail structures at the junction site.

FIG. 110 is a sequentially second anterior-posterior longitudinal cross-sectional view of the ninth beverage container lid assembly according to the present invention depicting the first push button structure of the ninth secondary lid attachment being shown in an actuated attachment-deflecting position.

Figure 111:
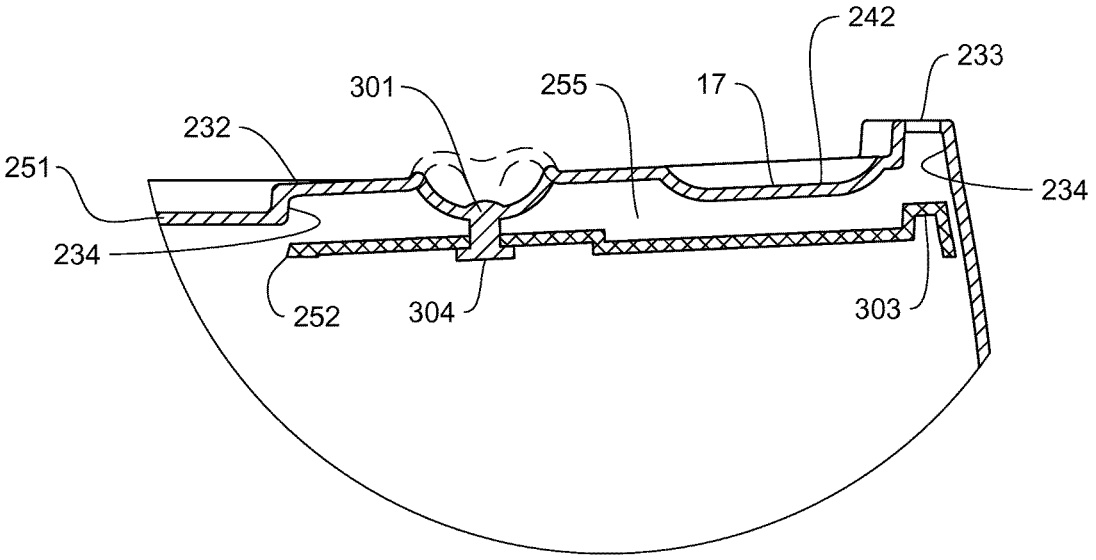
Figure 112:
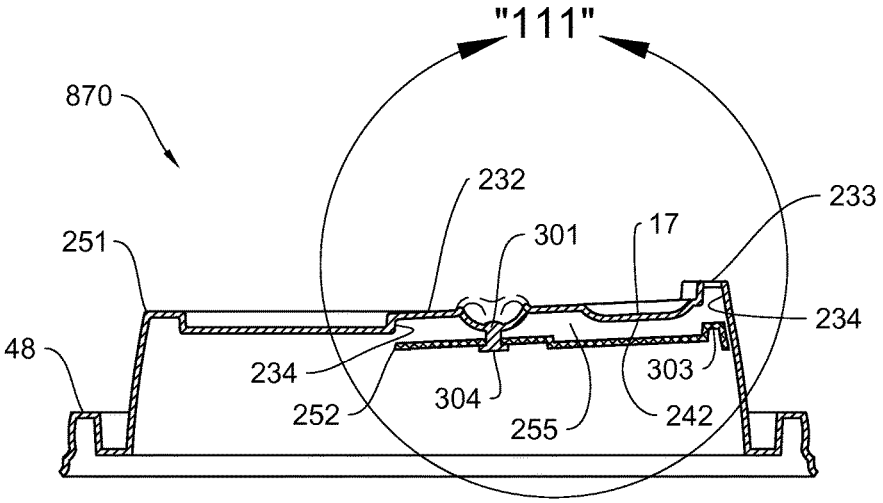

FIG. 111 is an enlarged, fragmentary sectional view of the junction site of the ninth secondary lid attachment and the ninth primary lid formation as sectioned and enlarged from FIG. 112 to show in greater detail structures at the junction site.

FIG. 112 is a sequentially third anterior-posterior longitudinal cross-sectional view of the ninth beverage container lid assembly according to the present invention depicting the second push button structure of the ninth secondary lid attachment being shown in an actuated attachment-separating position.

DETAILED DESCRIPTION OF THE PREFERRED EMBODIMENTS

Referring now to the drawings with more specificity, the following specifications generally describe a number of categorical (hot) beverage container lid assemblies or insert constructions for enabling a user to selectively and/or manually control beverage movement(s) from the stage of beverage containment to beverage consumption. The key aspects of all embodiments attempt thus to impart to the user an ability to more effectively control beverage movements for the purpose of effecting enhanced heat transfers and spillage prevention.

Key categorical embodiments described hereinafter include a number of embodiments incorporating tightly or snugly held lid inserts or attachments cooperable with primary lid forms; a number of embodiments incorporating concealed beverage-receiving and/or beverage-redirecting chamber(s); and a number of means for damping beverage oscillations or redirecting beverage movements within an outfitted beverage container.

Figure 1:
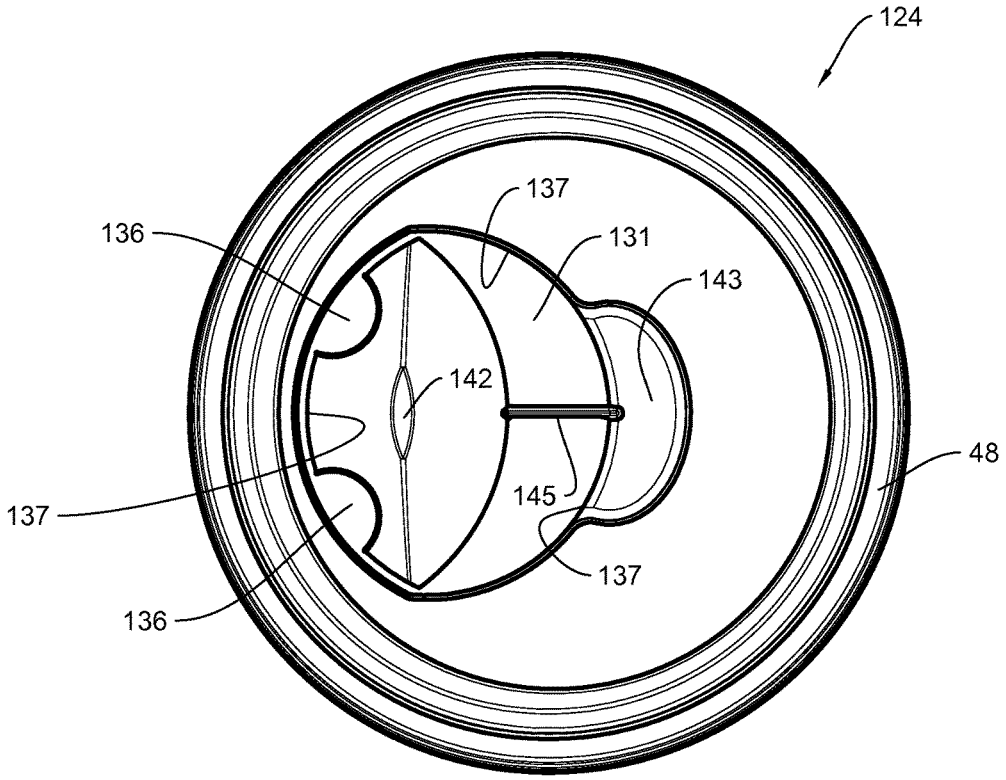
FIG. 1 is a top plan view of a first primary lid form of a first beverage container lid assembly according to the present invention.
Figure 2:
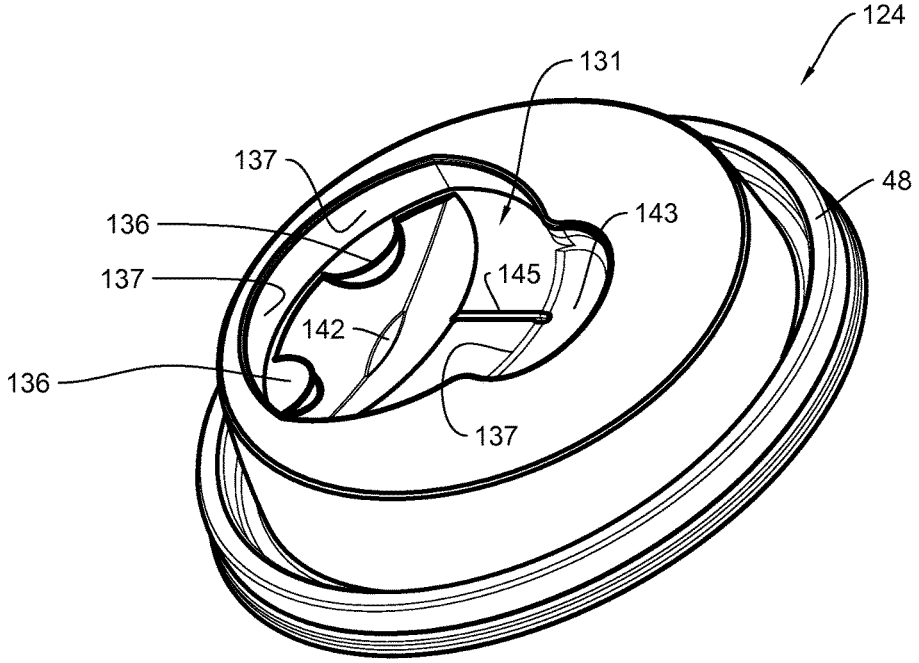
FIG. 2 is a first top perspective view of the first primary lid form of the first beverage container lid assembly according to the present invention.
Figure 3:
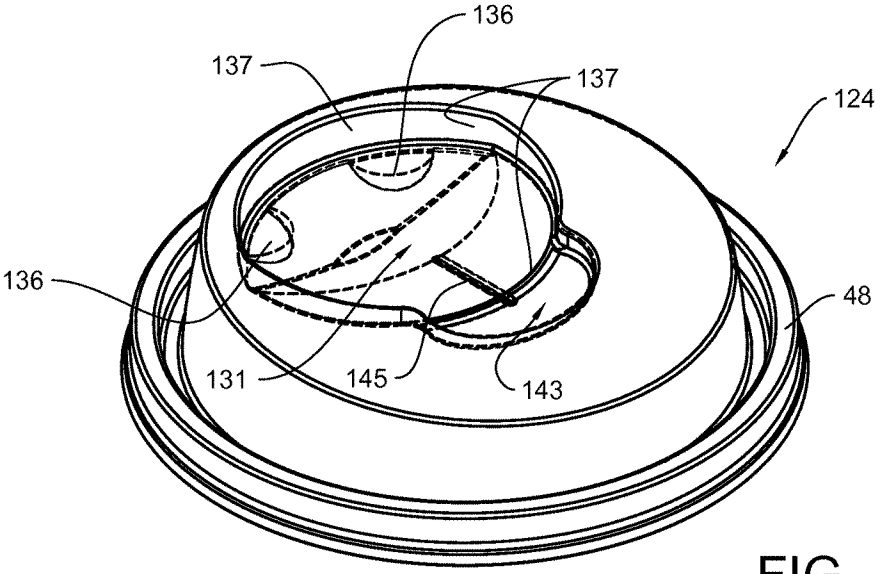
FIG. 3 is a second top perspective view of the of the first primary lid form of the first beverage container lid assembly according to the present invention depicting hidden content in broken lines.
Figure 5:
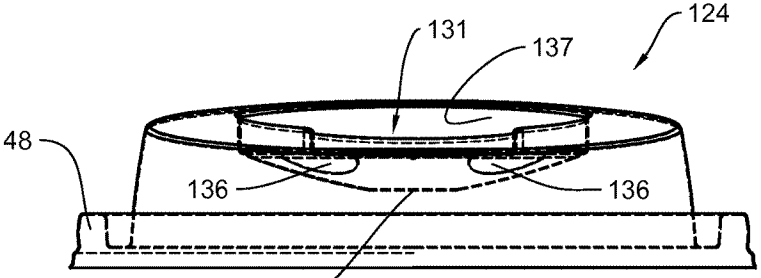
FIG. 5 is a posterior elevational view of the of the first primary lid form of the first beverage container lid assembly according to the present invention depicting hidden content in broken lines.
Figure 4:
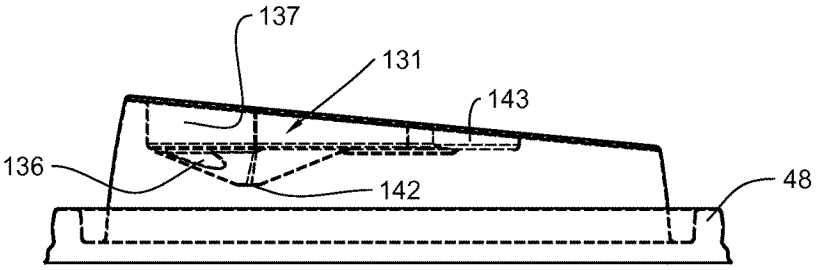
FIG. 4 is a lateral elevational view of the of the first primary lid form of the first beverage container lid assembly according to the present invention depicting hidden content in broken lines.
Figure 6:
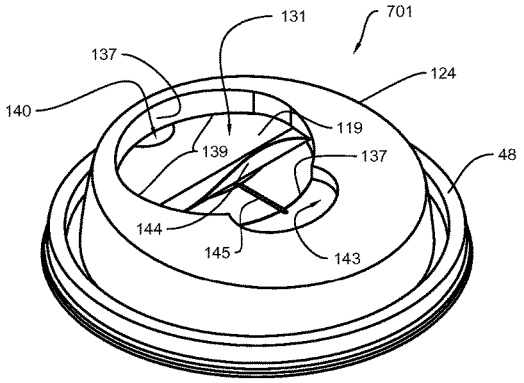
FIG. 6 is an assembled first top perspective view of the first beverage container lid assembly according to the present invention depicting a first secondary lid attachment in a partially raised position to reveal otherwise hidden content.
Figure 7:
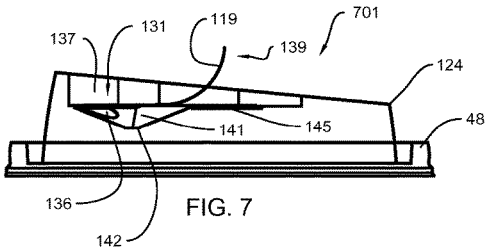
FIG. 7 is a first anterior-posterior longitudinal cross-sectional view of the first beverage container lid assembly according to the present invention showing a beverage-receiving compartment intermediate the first secondary lid attachment and the first primary lid form.
Figure 8:
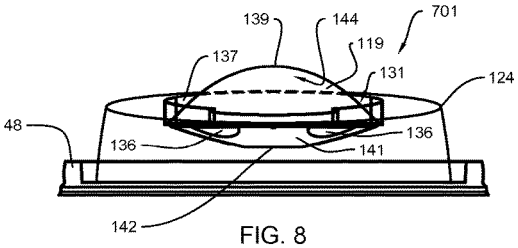
FIG. 8 is an assembled posterior elevational view of the first beverage container lid assembly according to the present invention depicting hidden content in broken lines depicting the first secondary lid attachment in a partially raised position.
Figure 9:
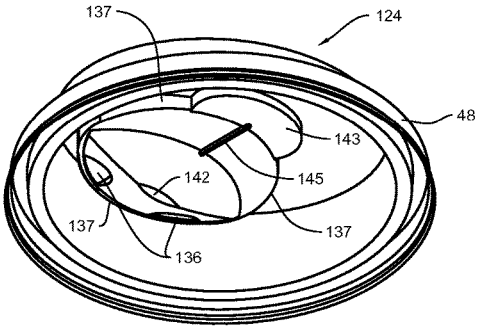
FIG. 9 is a first bottom perspective view of the first primary lid form of the first beverage container lid assembly according to the present invention.
Figure 10:
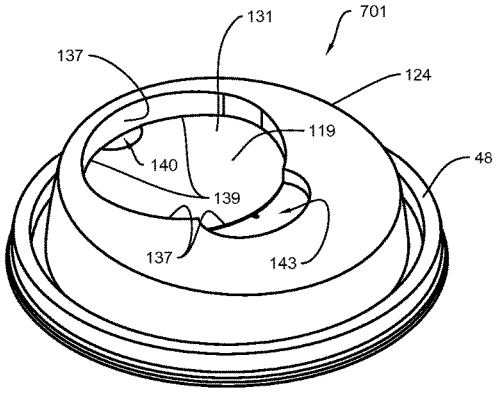
FIG. 10 is an assembled second top perspective view of the first beverage container lid assembly according to the present invention depicting the first secondary lid attachment in a seated or form-engaged, compartment-forming position.
Figure 11:
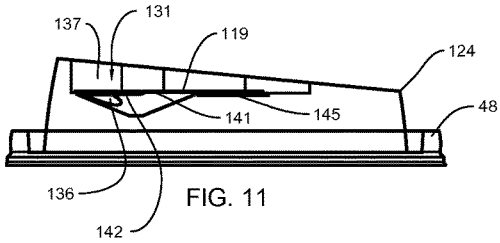
FIG. 11 is a second anterior-posterior longitudinal cross-sectional view of the first beverage container lid assembly according to the present invention showing a beverage-receiving compartment intermediate the first secondary lid attachment and the first primary lid form.
Figure 12:
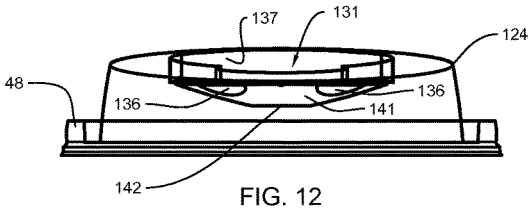
FIG. 12 is an assembled posterior elevational view of the first beverage container lid assembly according to the present invention.
Figure 13:
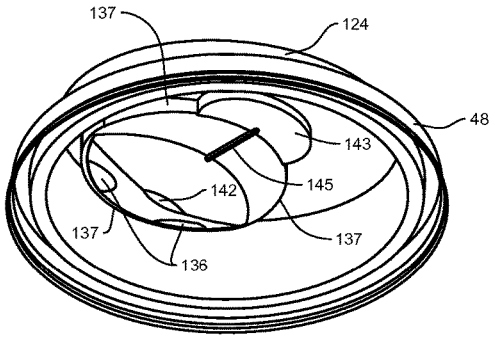
FIG. 13 is a second bottom perspective view of the first primary lid form of the first beverage container lid assembly according to the present invention.
Figure 14:
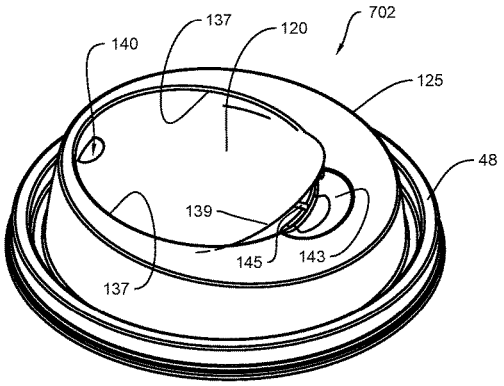
FIG. 14 is an assembled first top perspective view of the second beverage container lid assembly according to the present invention depicting a second secondary lid attachment in a partially raised position to reveal otherwise hidden content.
Figure 15:
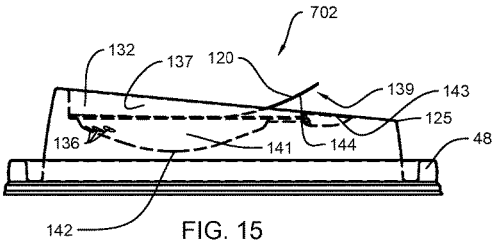
FIG. 15 is a first anterior-posterior longitudinal cross-sectional view of the second beverage container lid assembly according to the present invention showing a beverage-receiving compartment intermediate the second secondary lid attachment and the second primary lid form.
Figure 16:
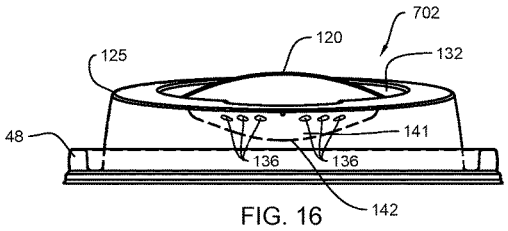
FIG. 16 is an assembled posterior elevational view of the second beverage container lid assembly according to the present invention depicting the second secondary lid attachment in a partially raised position.
Figure 17:
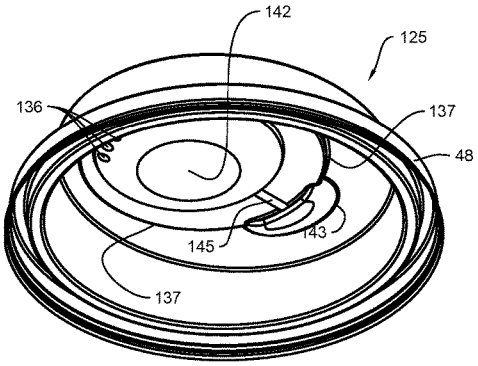
FIG. 17 is a first bottom perspective view of the second primary lid form of the second beverage container lid assembly according to the present invention.
Figure 18:
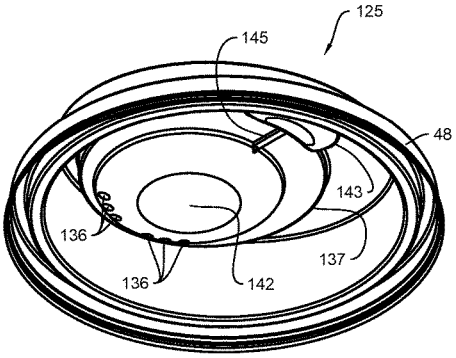
FIG. 18 is a second bottom perspective view of the second primary lid form of the second beverage container lid assembly according to the present invention.
Figure 19:
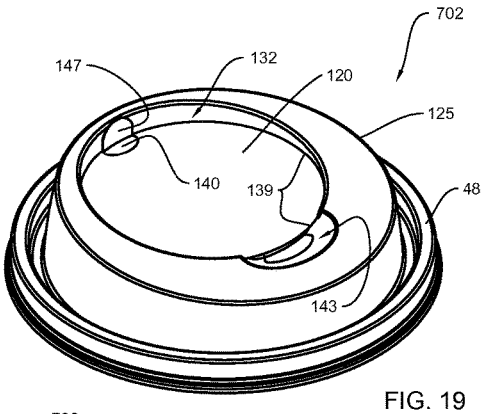
FIG. 19 is an assembled second top perspective view of the second beverage container lid assembly according to the present invention depicting the second secondary lid attachment in a seated or form-engaged, compartment forming position.
Figure 20:
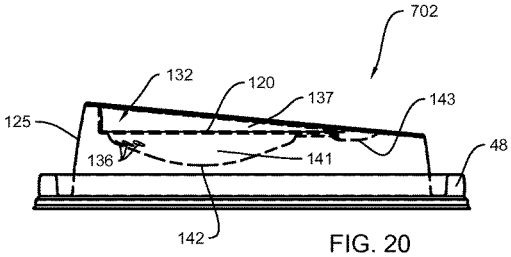
FIG. 20 is a second anterior-posterior longitudinal cross-sectional view of the second beverage container lid assembly according to the present invention showing the beverage-receiving compartment intermediate the second secondary lid attachment and the second primary lid form.
Figure 21:
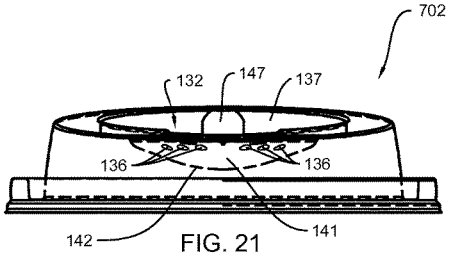
FIG. 21 is an assembled posterior elevational view of the second beverage container lid assembly according to the present invention.
Figure 22:
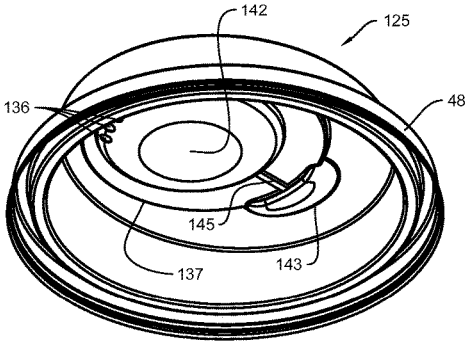
FIG. 22 is a third bottom perspective view of the second primary lid form of the second beverage container lid assembly according to the present invention.
Figure 23:
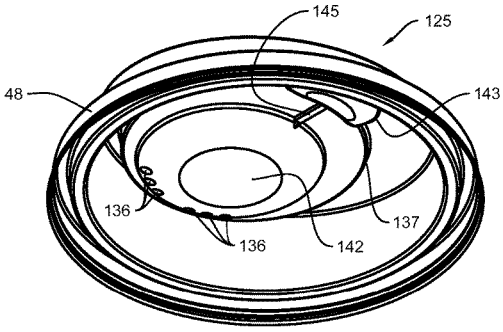
FIG. 23 is a fourth bottom perspective view of the second primary lid form of the second beverage container lid assembly according to the present invention.
Figure 24A:
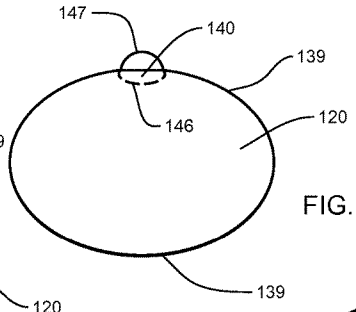
FIG. 24A is a top perspective view of an alternative slightly modified second secondary lid attachment comprising a pull tab and perforated structure.
Figure 25:
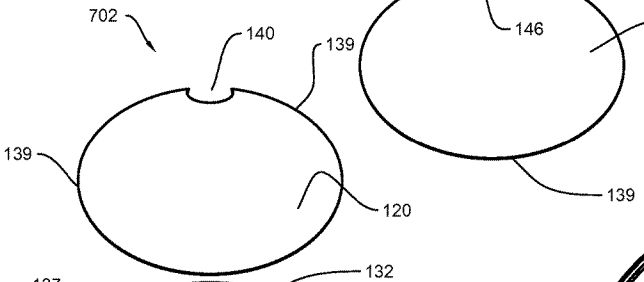
FIG. 25 is a top plan view of the second beverage container lid assembly according to the present invention.
Figure 25:
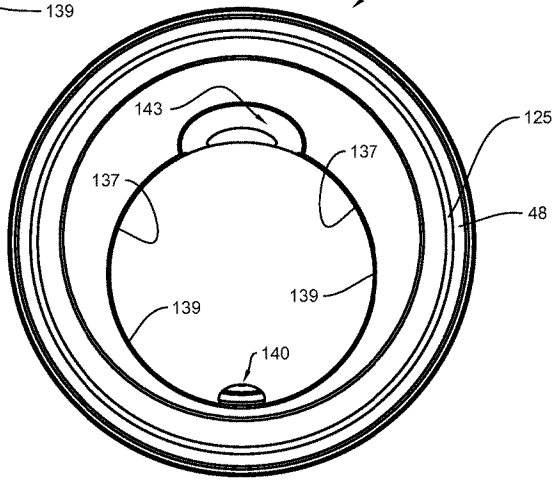
Figure 24:
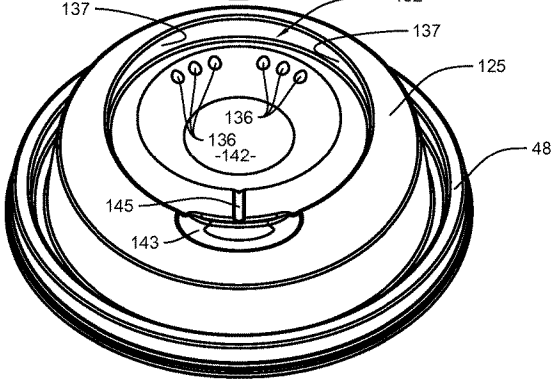
FIG. 24 is an exploded top perspective view of the second beverage container lid assembly according to the present invention, the second secondary lid attachment being exploded in superior adjacency to the second primary lid form.
Figure 27:
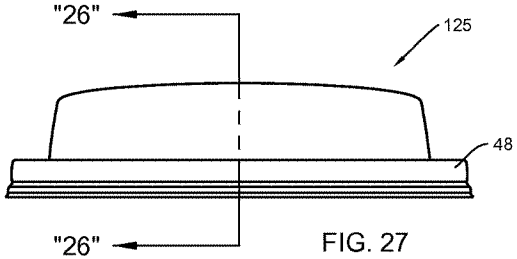
FIG. 27 is an anterior elevational view of the second beverage container lid assembly according to the present invention.
Figure 26:
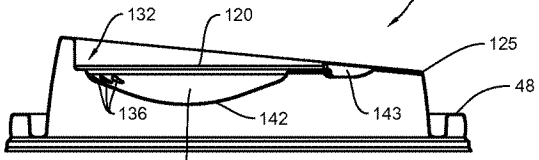
FIG. 26 is a third anterior-posterior longitudinal cross-sectional view of the second beverage container lid assembly according to the present invention as sectioned from FIG. 27 and showing the beverage-receiving compartment intermediate the second secondary lid attachment and the second primary lid form.
Figure 29:
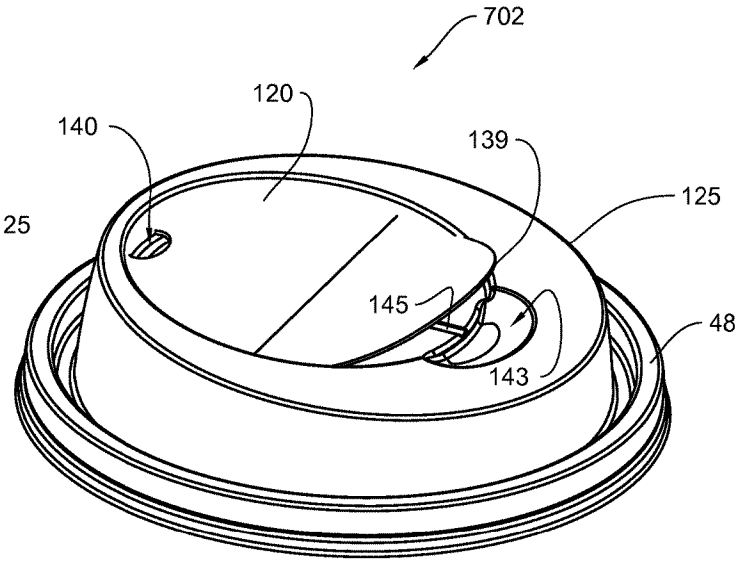
FIG. 29 is an assembled third top perspective view of the second beverage container lid assembly according to the present invention depicting the second secondary lid attachment in a partially raised position to reveal otherwise hidden content.
Figure 31:
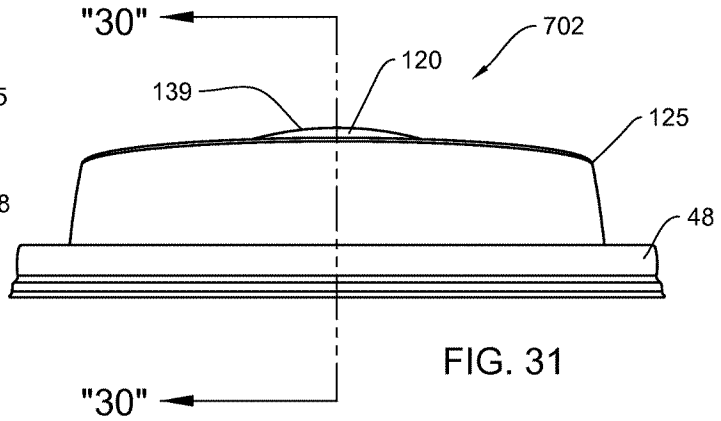
FIG. 31 is an anterior elevational view of the second beverage container lid assembly according to the present invention depicting the second secondary lid attachment in a partially raised position.
Figure 28:
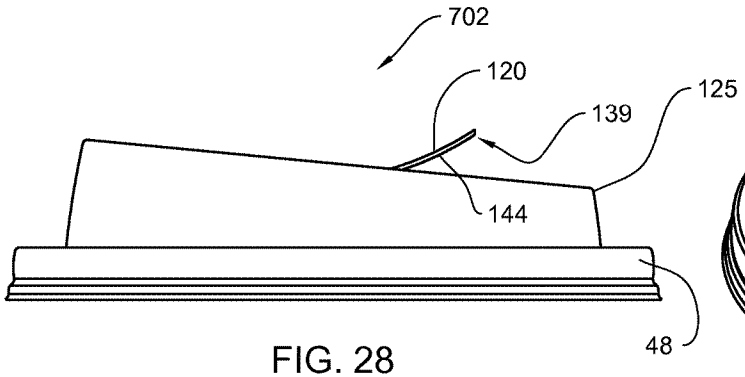
FIG. 28 is a lateral elevational view of the second beverage container lid assembly according to the present invention showing the second secondary lid attachment in a partially raised position.
Figure 30:
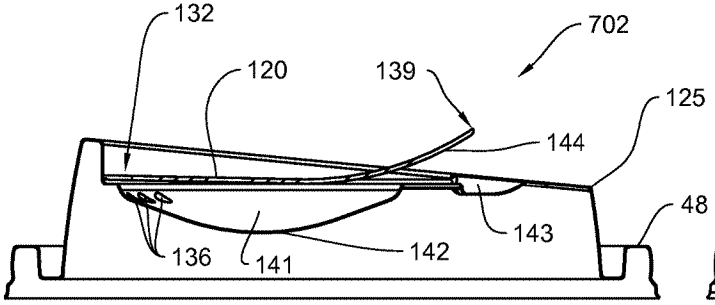
FIG. 30 is a fourth anterior-posterior longitudinal cross-sectional view of the second beverage container lid assembly according to the present invention as sectioned from FIG. 31 and showing the beverage-receiving compartment intermediate the second secondary lid attachment in a partially raised position and the second primary lid form.

In keeping with the notion of insatiability or attachment of a beverage-redirecting structure into engagement with a primary lid form for forming a beverage-damming or beverage-diverting feature, a first category of embodiments is contemplated as generally depicted and referenced at assemblies 701, 702, 703, 704, and 800. Assemblies 701, 702, 703, 704, and 800 depart from incorporating a key rotational function or feature as in assemblies 100, 200, 300, 400, 500, and 600 of the '343 application; and instead capitalize or refocus upon the respective insertability of secondary lid attachment(s) 119, 120, 121, 122, and 123 into primary lid form(s) as at 124, 125, 126, 127, and 128. Assemblies 701, 702, 703 and 800 are generally and comparatively depicted in FIGS. 1-59. Assembly 704 is generally depicted in FIGS. 61-67.

Figure 40:
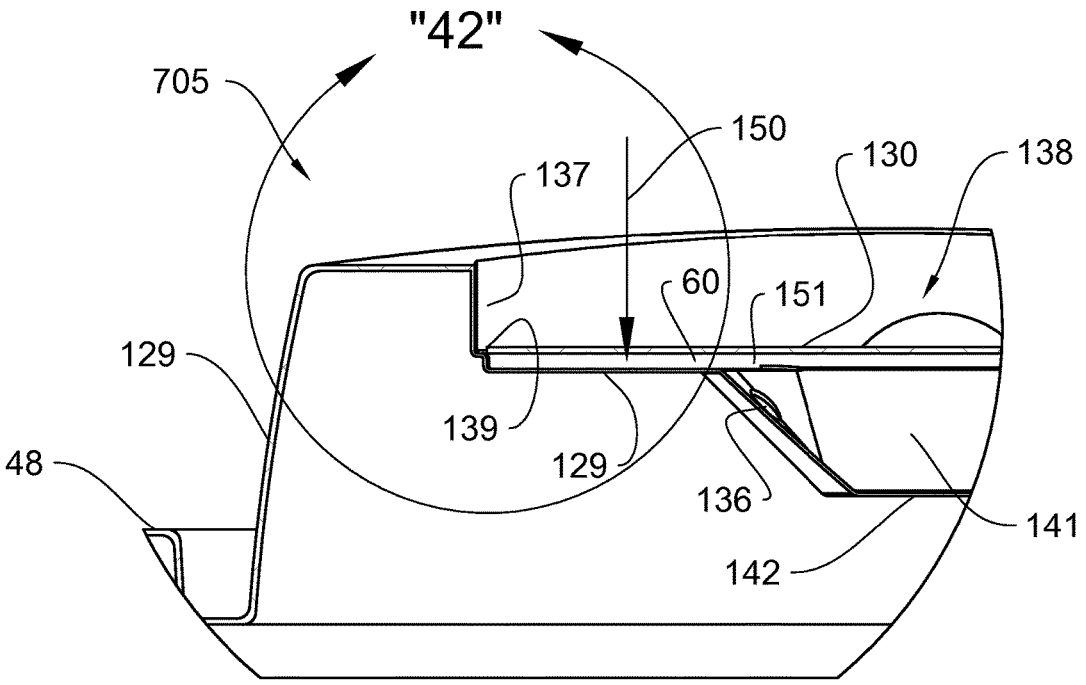
FIG. 40 is a first enlarged, fragmentary sectional view of an attachment-to-form junction site of a generic secondary lid attachment and primary lid form as sectioned from FIG. 41 to depict in greater detail structures at the attachment-to-form junction site.
Figure 41:
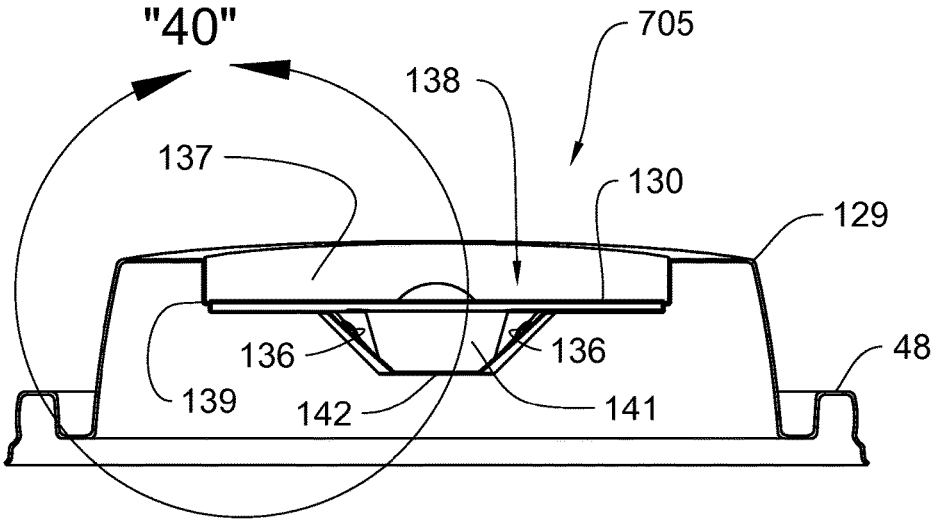
FIG. 41 is a lateral cross-sectional view of the generic secondary lid attachment and primary lid form to generally show a beverage-receiving compartment intermediate the generic secondary lid attachment and primary lid.
Figure 42:
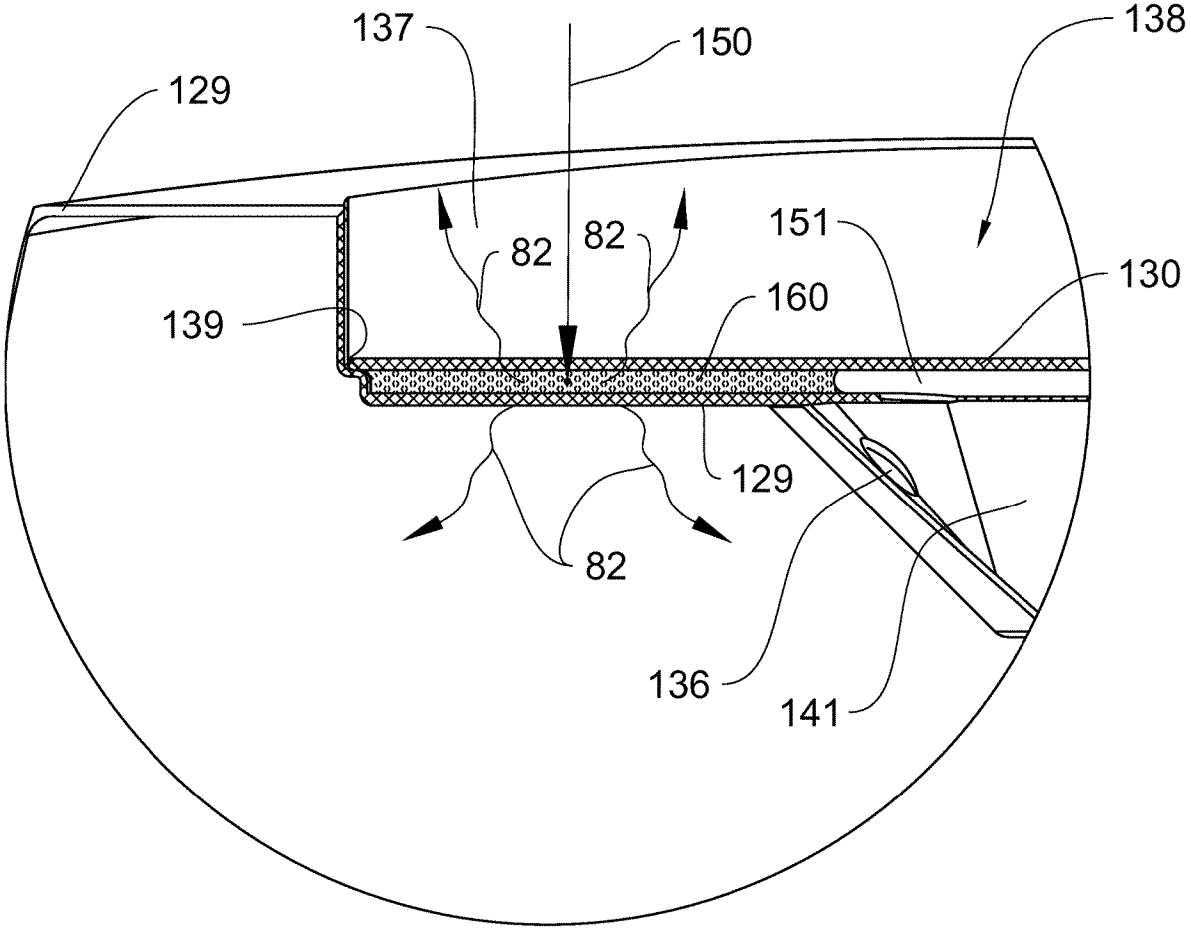
FIG. 42 is a second enlarged, fragmentary sectional view of the attachment-to-form junction site of the generic secondary lid attachment and primary lid form as sectioned from FIG. 40 to depict in greater detail structures at the attachment-to-form junction site with beverage received in the beverage-receiving compartment.
Figure 43:
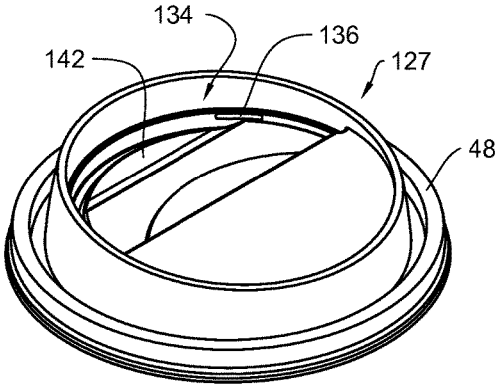
FIG. 43 is a top perspective view of a fourth primary lid form of a fourth beverage container lid assembly according to the present invention.
Figure 44:
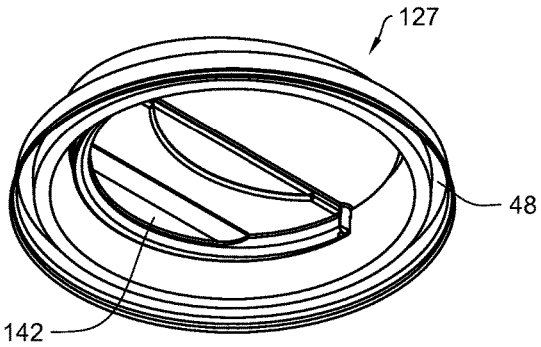
FIG. 44 is a bottom perspective view of the fourth primary lid form of the fourth beverage container lid assembly according to the present invention.
Figure 45:
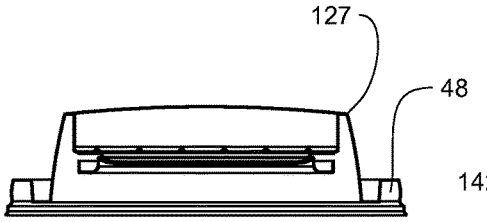
FIG. 45 is a lateral cross-sectional view of the fourth primary lid form of the fourth beverage container lid assembly according to the present invention as sectioned from FIG. 46.
Figure 46:
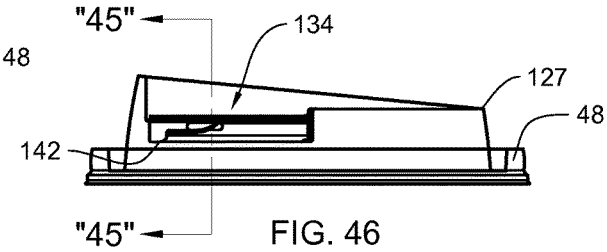
FIG. 46 is an anterior-posterior longitudinal cross-sectional view of the fourth primary lid form of the fourth beverage container lid assembly according to the present invention.
Figure 47:
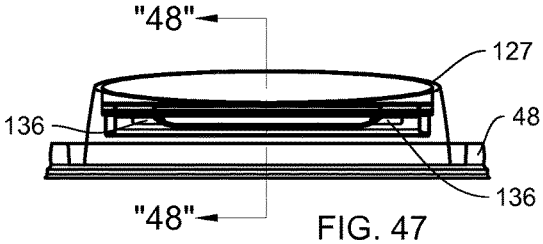
FIG. 47 is a posterior elevational view of the fourth primary lid form of the fourth beverage container lid assembly according to the present invention.
Figure 48:
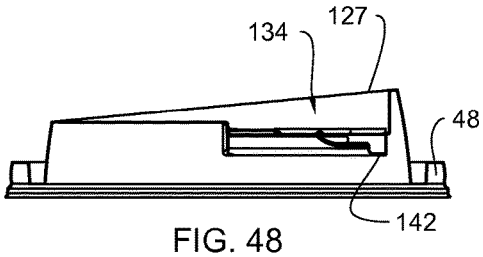
FIG. 48 is an anterior-posterior longitudinal cross-sectional view of the fourth primary lid form of the fourth beverage container lid assembly according to the present invention as sectioned from FIG. 47.
Figure 49:
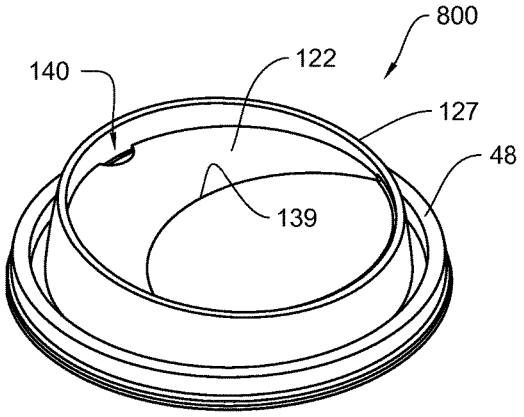
FIG. 49 is a first assembled top perspective view of the fourth beverage container lid assembly according to the present invention.
Figure 50:
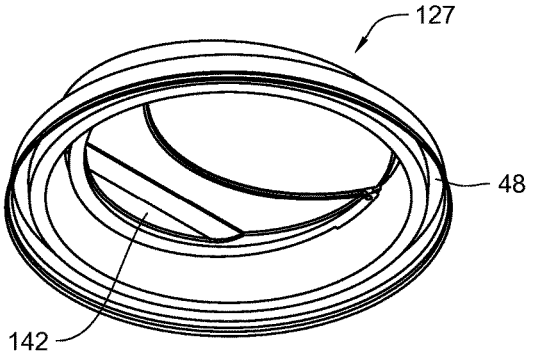
FIG. 50 is a bottom perspective view of the fourth beverage container lid assembly according to the present invention.
Figure 51:
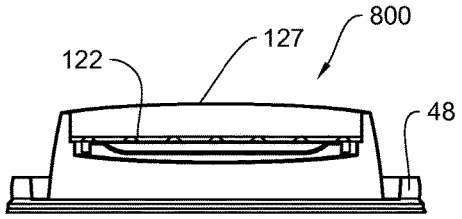
FIG. 51 is a lateral cross-sectional view of the fourth beverage container lid assembly according to the present invention as sectioned from FIG. 52.
Figure 52:
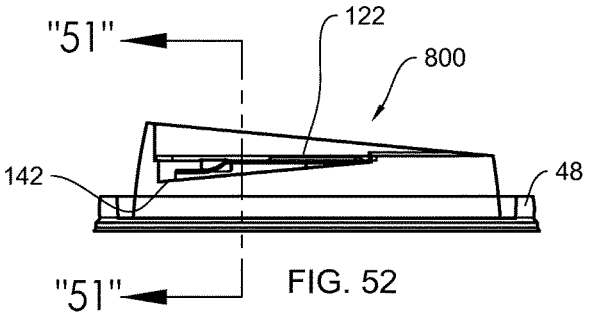
FIG. 52 is an anterior-posterior longitudinal cross-sectional view of the fourth beverage container lid assembly according to the present invention.
Figure 53:
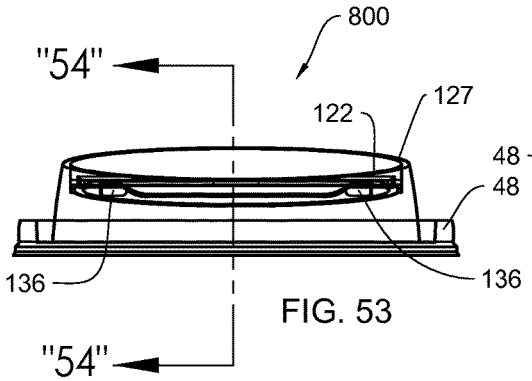
FIG. 53 is a posterior elevational view of the fourth beverage container lid assembly according to the present invention.
Figure 54:
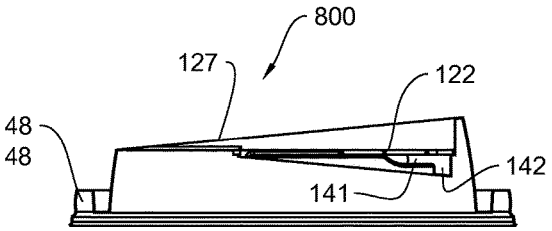
FIG. 54 is an anterior-posterior longitudinal cross-sectional view of the fourth beverage container lid assembly according to the present invention as sectioned from FIG. 53.
Figure 55:
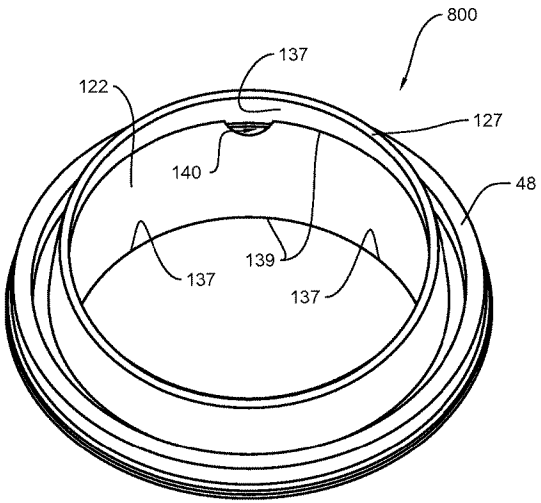
FIG. 55 is a second assembled top perspective view of the fourth beverage container lid assembly according to the present invention.
Figure 56:
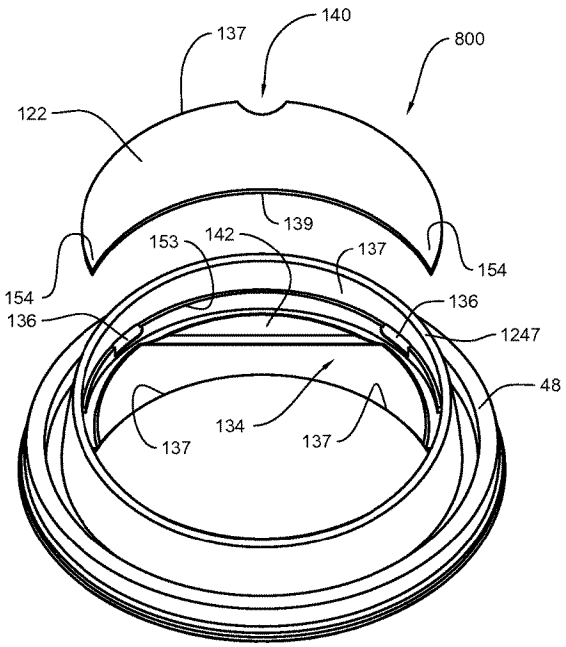
FIG. 56 is a first exploded top perspective view of the fourth beverage container lid assembly according to the present invention showing a fourth secondary lid attachment exploded in superior adjacency to the fourth primary lid form.
Figure 57:
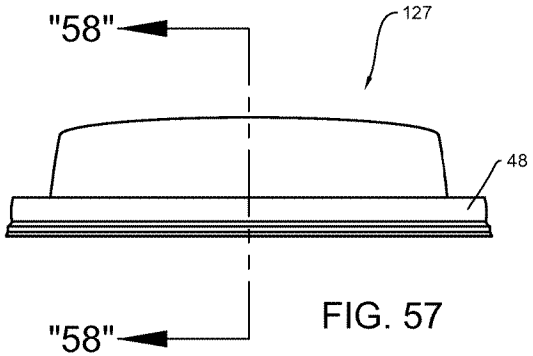
FIG. 57 is an anterior elevational view of the fourth beverage container lid assembly according to the present invention.
Figure 58:
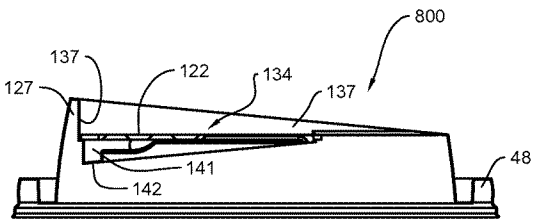
FIG. 58 is an anterior-posterior longitudinal cross-sectional view of the fourth beverage container lid assembly according to the present invention as sectioned from FIG. 57.
Figure 59A:
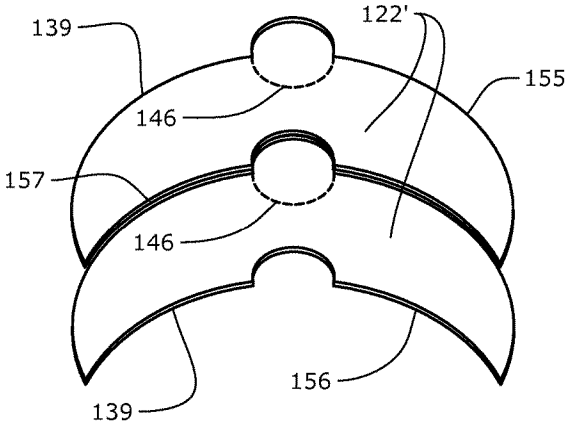
FIG. 59A is a perspective view of a first and second alternative slightly modified fourth secondary lid attachments attached at a junction seam along which seam the first and second alternative slightly modified fourth secondary lid attachments may be separated in one cutting motion by a cutting implement.
Figure 59B:
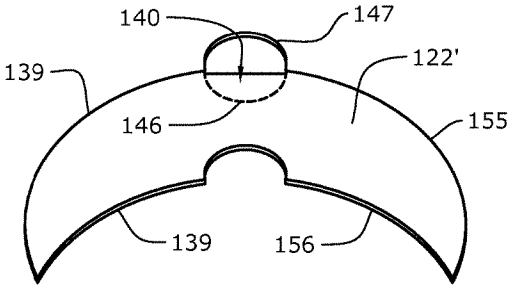
FIG. 59B is a perspective view of the alternative slightly modified fourth secondary lid attachment according to the present invention showing a pull tab and perforated structure.

A series of generic cross-sectional views are depicted in FIGS. 40-42 that attempt to show in greater detail certain general or generic key features of assemblies 701, 702, 703, 704, and 800. A generic primary lid form, for example, is referenced at 129 and a generic secondary lid attachment, for example, is referenced at 130 in FIGS. 40-42.

Each of the first category embodiments as at assemblies 701, 702, 703, 704 and 800 provide a beverage container lid assembly for enabling a user to selectively control beverage flow rates or movements therethrough, and essentially and respectively comprise foundational, primary lid form as at forms 124, 125, 126, 127 and 128; secondary lid attachments as at attachments 119, 120, 121, 122, and 123; and certain lid-to-container or container attachment means as again exemplified by a primary rim-receiving or engaging groove or structure as at 48.

The primary lid form(s) 124, 125, 126, 127, and 128 each respectively comprise a primary beverage outlet depression as at depressions 131, 132, 133, 134, and 135. A generic beverage outlet depression is referenced at 138. The beverage outlet depressions 131, 132, 133, 134, and 135 are respectively formed at upper surfacing of the primary lid forms 124, 125, 126, 127 and 128 comprise at least one primary beverage outlet as generically referenced at outlet apertures 136 and a primary depression periphery as generically referenced at 137.

The secondary lid attachments 119, 120, 121, 122, and 123 each preferably and essentially comprise an attachment-to-form contact edge as at 139 and at least one letting aperture or cutout as at 140. The attachment-to-form contact edge(s) 139 are shaped to snugly attach to the depression peripheries 137 in superior adjacency to the primary beverage outlets 136 for forming a beverage-receiving compartment 141 at the site of the beverage outlet depressions 138.

The container attachment means as exemplified by a primary rim-receiving or engaging groove or structure as at 48 attach the primary lid forms as at 129 to an upper rim 47 of a beverage container as at 46 containing beverage as at 60. Beverage 60 from the beverage container 46 is directable through the primary beverage outlet as at outlets 136 into the beverage-receiving compartment 141. The beverage-receiving compartment 141 effects or causes heat transfer 82 from the compartmentalized beverage 60 prior to outletting (as at arrows 85) via the letting aperture(s) 140 for beverage consumption.

The primary lid forms as at 129 may all preferably comprises a beverage pooling structure as at 142 in (inferior) adjacency to the primary beverage outlets 136, which beverage pooling structure(s) 142 pooling beverage within certain concavity at the lower portions or the lower most portions of the beverage-receiving compartment 141 prior to consumption. The letting aperture(s) 140 are preferably non-aligned vertically relative to the primary beverage outlets 136 such that the secondary lid attachments as at 130 provide beverage flow diversion structure substantially as previously described.

The set of embodiments referenced at assemblies 701, 702, 703, 704, and 800 may all preferably comprise certain secondary lid attachment removal means for enabling the user to selectively remove portions of or the entire secondary lid attachments as at 130 from the primary lid forms as at 129 for enabling enhanced or more direct beverage consumption directly or in a more direct path from at least one primary beverage outlet 136. It is contemplated that the secondary lid attachment removal means may be variously defined or exemplified.

Firstly, the secondary lid attachment removal means may be defined or exemplified, in part, by a secondary depression as at 143 formed in adjacency to the primary beverage outlet depressions as at 138. The secondary depressions 143 enable a user to manually engage an underside 144 of the secondary lid attachments 130 for manually removing said secondary lid attachments 130. Assemblies 701, 702, 703, and 704 have been illustrated to incorporate secondary depressions 143. In those embodiments incorporating secondary depressions 143, the primary lid forms 129 may further preferably comprise a depression-interconnecting groove (or channel) as at 145. The depression-interconnecting grooves or channels 145 extend intermediate the beverage outlet depressions 138 and the secondary depression 143 for venting the beverage-receiving chamber 141 and enhancing beverage movement therewithin.

Secondly, the secondary lid attachment removal means may be defined or exemplified, in part, by the letting apertures 140, which may or may not be outfitted with certain perforated structure as at 146 for enabling the user to form the letting aperture(s) 140 by breaking through the perforated structure 146. The perforated structure 146 may be positioned upwardly to form a removal tab as at 147 as generally depicted and referenced in FIGS. 24A, 59, 59B, and 60.

Figure 32A:
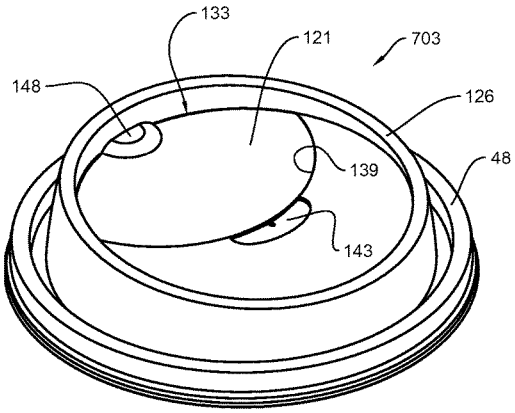
FIG. 32A is an assembled first top perspective view of a third beverage container lid assembly according to the present invention depicting a push button of a third secondary lid attachment in a closed configuration.
Figure 32B:
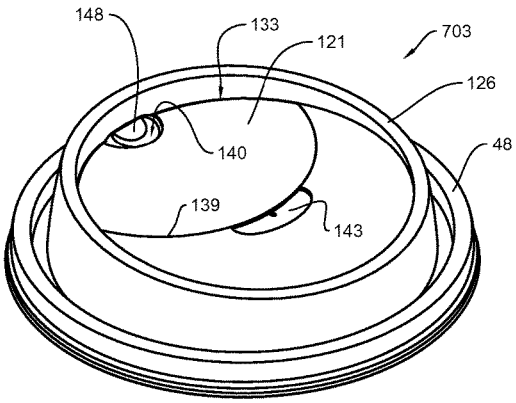
FIG. 32B is an assembled second top perspective view of the third beverage container lid assembly according to the present invention depicting the push button of the third secondary lid attachment in a depressed, open configuration.
Figure 33:
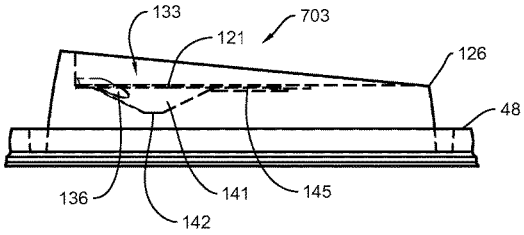
FIG. 33 is an anterior-posterior longitudinal cross-sectional view of the third beverage container lid assembly according to the present invention showing the beverage-receiving compartment intermediate the third secondary lid attachment and the third primary lid form.
Figure 34:
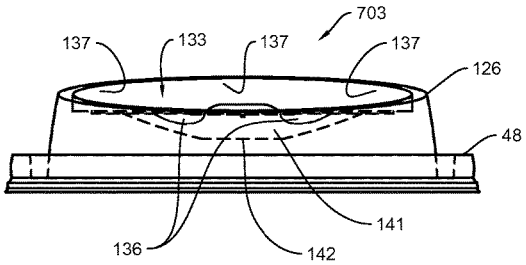
FIG. 34 is a posterior elevational view of the third beverage container lid assembly according to the present invention.
Figure 35:
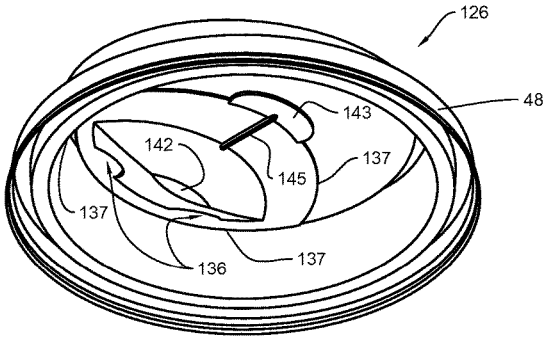
FIG. 35 is bottom perspective view of the third primary lid form of the third beverage container lid assembly according to the present invention.
Figure 36:
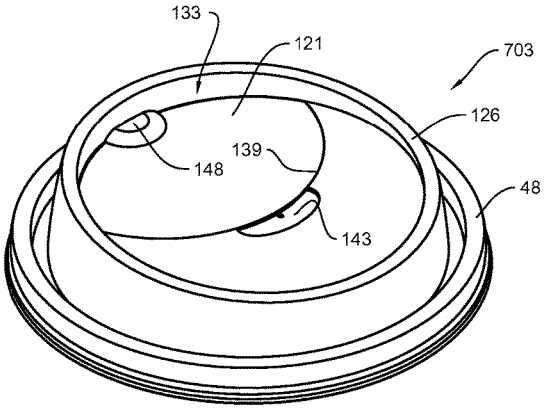
FIG. 36 is an assembled third top perspective view of the third beverage container lid assembly according to the present invention depicting the push button of the third secondary lid attachment in the closed configuration.
Figure 37:
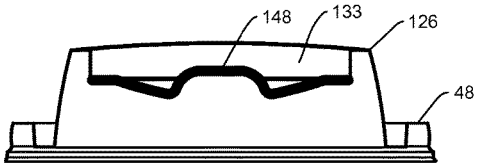
FIG. 37 is an assembled lateral cross-sectional view of the third beverage container lid assembly according to the present invention as sectioned from FIG. 38 to show the push button in the closed configuration.
Figure 38:
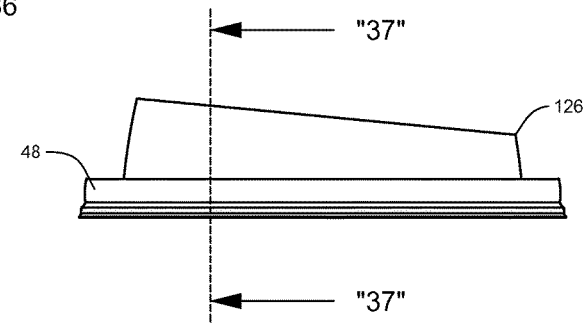
FIG. 38 is a lateral elevational view of the third beverage container lid assembly according to the present invention
Figure 39:
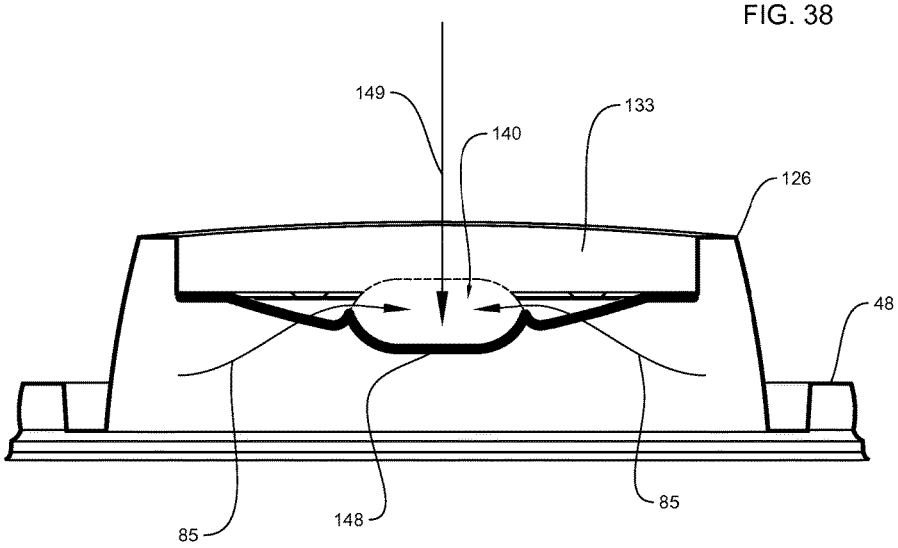
FIG. 39 is an assembled lateral cross-sectional view of the third beverage container lid assembly according to the present invention to show the push button in the depressed, open configuration.

Comparatively, referencing FIG. 32A versus 32B and FIGS. 36 and 37 versus FIG. 39, the reader will further consider that the assemblies 701, 702, 703, 704, and 800 may all further preferably and alternatively be outfitted with a push button structure as at 148. By pressing as at vector arrow 149 the push button structure 148, the user may thereby open the letting aperture 140. FIGS. 32A, 36, and 37 all depict the push button structure 148 in a closed configuration, and FIGS. 32B and 39 both depict the push button structure 148 in an open, letting aperture-forming configuration for letting beverage progress through the aperture as at arrows 85.

Referencing FIGS. 40-42, the reader will further consider cross-sectional generic depictions of basic concepts all supported by assemblies 701, 702, 703, 704, and 800 (i.e. lid assembly 705). Particularly and comparatively referencing FIGS. 40 and 42, arrow 150 references liquid or beverage 60 trapped in a substantially narrow or tight space 151 between the material constructions of the primary lid form 129 and the secondary lid attachment 130.

Physical properties of the liquid (e.g. hydrophilic properties) tend to operate to hold the liquid or beverage 60 in engagement with the hydrophilic upper material layer of the secondary lid attachment 130 and the hydrophilic lower material layer of the primary lid form 129 within the narrow or tight space 151 between the opposed surfaces of the attachment 130 and form 129. When the lid assemblies 705 are in a relatively horizontal position as generally depicted, the liquid or beverage 60 trapped within the substantially tight space 151 is dispersed in a relative wide, thin area around beverage-receiving compartment 141 in relatively great surface contact area with the opposed, hydrophilic, upper and lower material layers. Beverage 60, as received within the beverage-receiving compartment 141, is attractively engaged with the hydrophilic upper and lower material layers for limiting beverage movement.

The volume of liquid or beverage 60 is relatively small, but because it is thinly dispersed within the volume defined between the attachment 130 and form 129 and thus exposed to relatively large material surface areas by virtue of the contacts with the planes of attachment 130 and form 129, the liquid or beverage 60 experiences a rapid heat transfer therefrom as at 82. This principle is also applicable to assemblies 701-704 (as well as assembly 600 of the '343 application) at least insofar as all the noted embodiments may well incorporate a substantially tight space as at 151 to trap liquid or beverage 60 for effecting rapid heat transfer 82.

When the assembly 705 is tilted for consumption, the weight of the liquid 60 under gravitation force sends the liquid 60 rushing towards the letting aperture 140 where it is mixes with incoming diverted liquid flow from the primary beverage compartment 152 of the container 46 and trapped liquid from beverage-receiving compartment 60. Combining these flows in one flow results in substantial drop of temperature of beverage outflowing as at 85 through the letting aperture 140. Secondarily, the physical properties of the secondary lid attachment(s) 130 enable the supplier to print upon the upper surface thereof for providing branding and the like.

Referencing FIGS. 43-59, the reader may more particularly consider lid assembly 800. The primary lid form 127 comprises a crescent-shaped depression 134. The depression 134 acts as or provides lower portions of the beverage-receiving compartment 141. Laterally offset apertures 136 formed in the primary lid form 127 provide liquid flow diversions from main letting aperture 140 preferably located in the middle of the crescent shaped secondary lid attachment 122.

The crescent-shaped secondary lid attachment or insert 122 is preferably constructed from a single ply plastic, cardboard or other material and attached or connected to the primary lid form at the perimeter 137 by snap-in, adhesive attachment, or by other means to the primary lid form 127 thereby lidding or covering a significant portion of the depression 134. An indention as at 153 located at the top of depression 134 formed in the primary lid form 127 allows for a tight or snug fit for crescent-shaped secondary lid attachment 122 in order to hold the attachment or insert 122 in place.

The crescent-shaped insert or secondary lid attachment 122 provides air venting at the tips 154 where the tips 154 may be preferably slightly abbreviated relative to the depression periphery 137. The narrowing feature of the crescent-shaped secondary lid attachment 122 and crescent-shaped depression 134 enhance air movement toward the tips 154 where venting is also enhanced by the overall resulting form of the compartment 141. The overall form further limits the possibility of spillage through the air vents.

Figure 60:
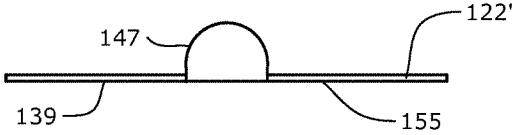
FIG. 60 is an anterior edge view of the alternative slightly modified fourth secondary lid attachment according to the present invention showing an upwardly extending pull tab.
Figure 59:
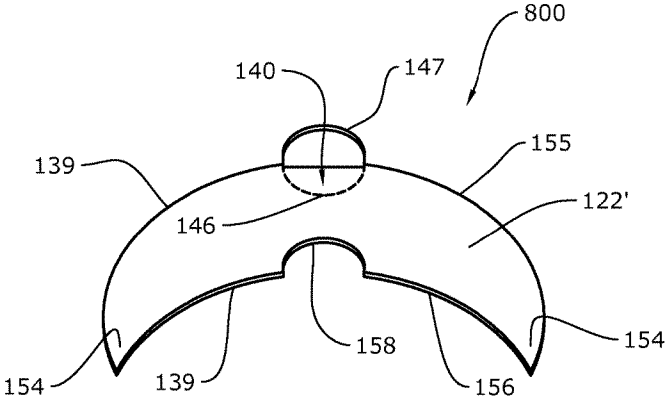
FIG. 59 is a second exploded top perspective view of the fourth beverage container lid assembly according to the present invention showing an alternative slightly modified fourth secondary lid attachment exploded in superior adjacency to the fourth primary lid form.
Figure 59:
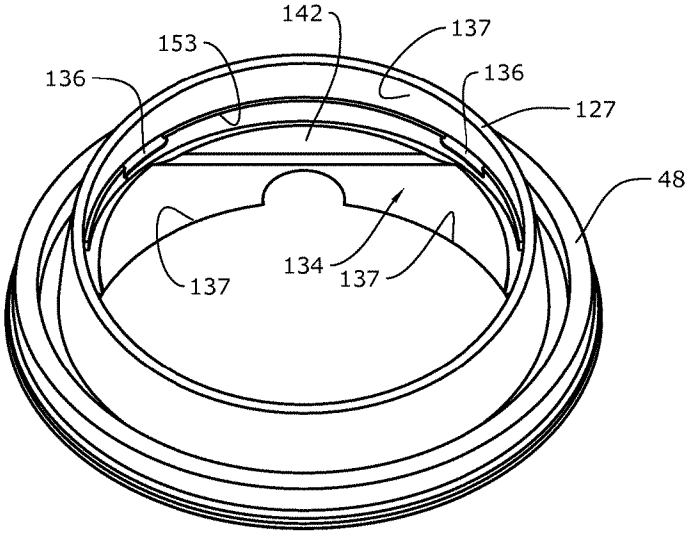
Figure 61:
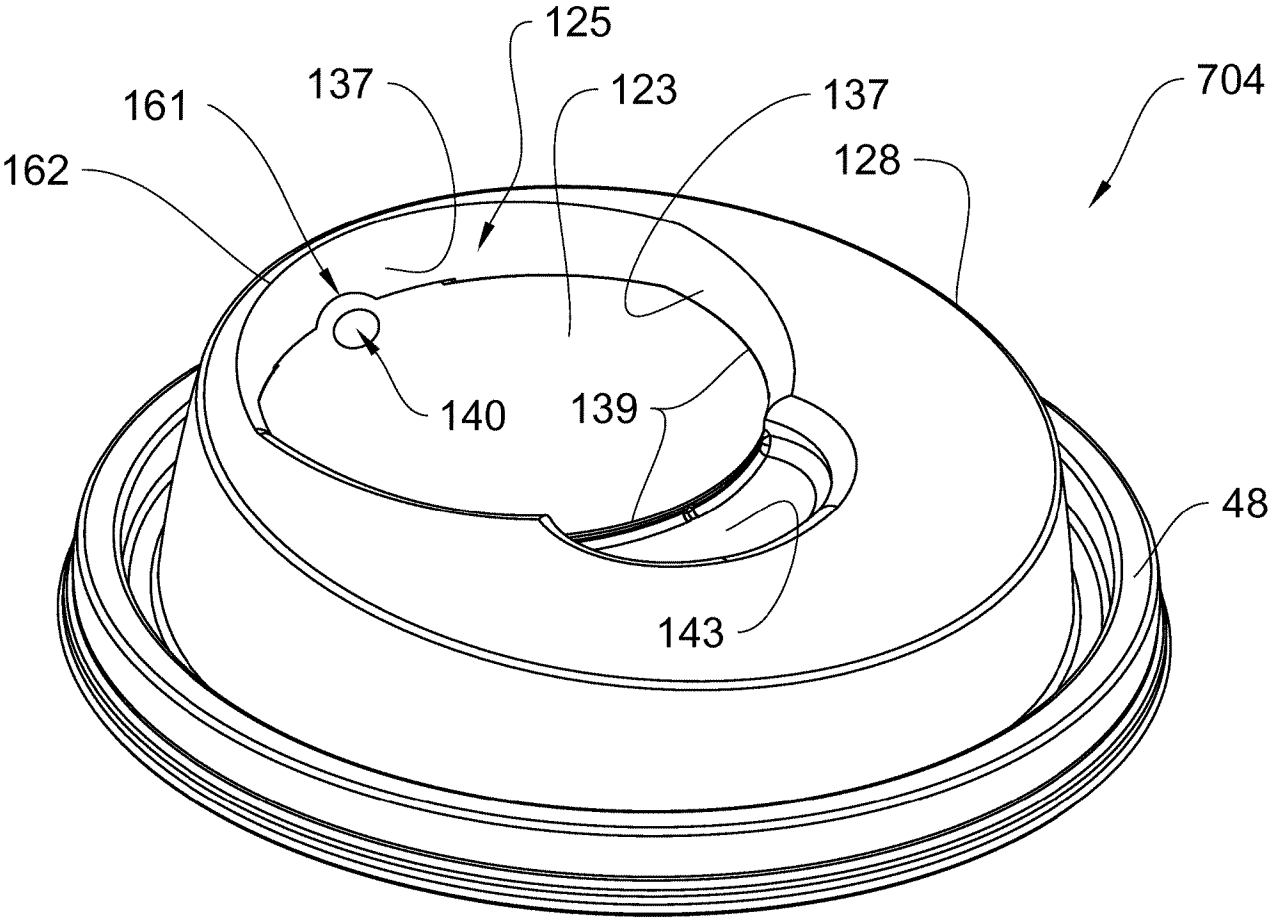
FIG. 61 is an assembled top perspective view of a fifth beverage container lid assembly according to the present invention.
Figure 62:
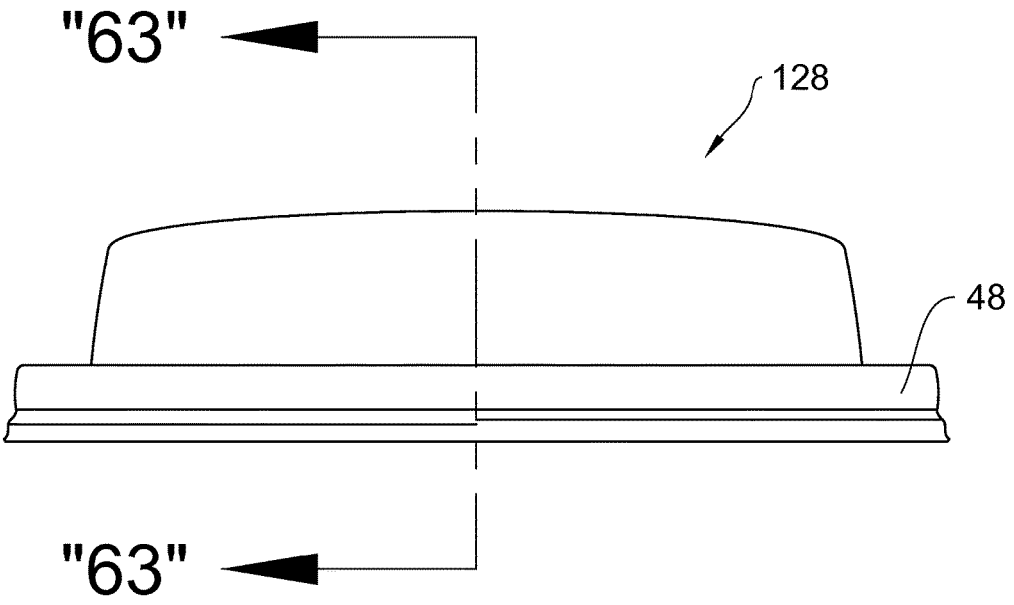
FIG. 62 is a first anterior view of the fifth beverage container lid assembly according to the present invention.
Figure 63:
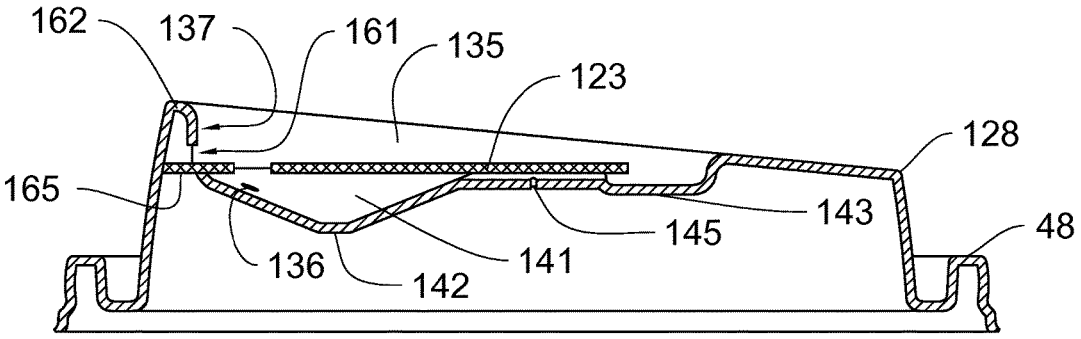
FIG. 63 is a first anterior-posterior longitudinal cross-sectional view of the fifth beverage container lid assembly according to the present invention as sectioned from FIG. 62.
Figure 64:
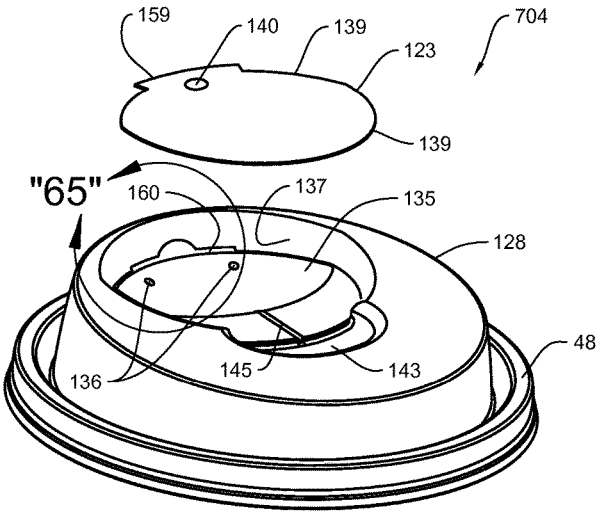
FIG. 64 is an exploded top perspective view of the fifth beverage container lid assembly according to the present invention.
Figure 65:
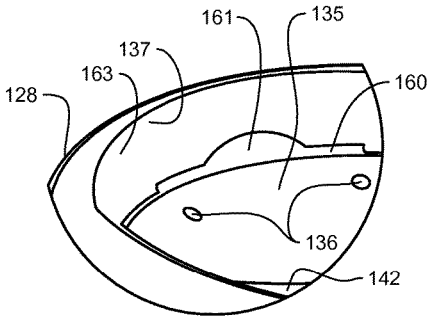
FIG. 65 is an enlarged fragmentary sectional view of anterior portions of the fifth primary lid form of the fifth beverage container lid assembly according to the present invention to show in greater detail those anterior portions.
Figure 66:
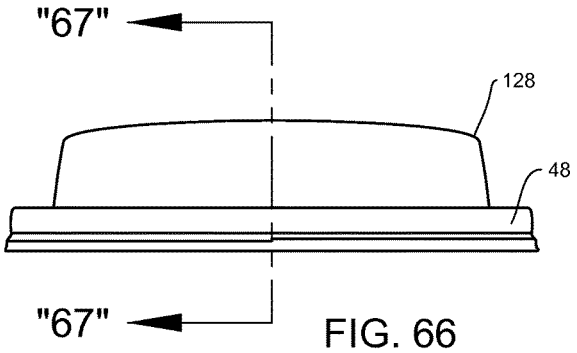
FIG. 66 is a second anterior view of the fifth beverage container lid assembly according to the present invention.
Figure 67:
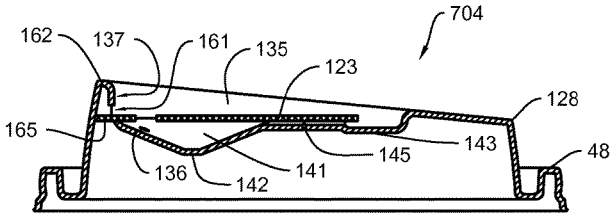
FIG. 67 is a second anterior-posterior longitudinal cross-sectional view of the fifth beverage container lid assembly according to the present invention as sectioned from FIG. 66.

Comparatively referencing FIGS. 59-60, the reader will there consider that the crescent-shaped insert or secondary lid attachment 122 may be preferably formed by cutting from a material having sufficient width such that the front side 155 of the crescent-shape resembles the back side 156 of the next crescent-shaped form as at junction 157. Stamping or cutting the material may thus be achieved by a single-sided stamp knife.

The main letting aperture 140 of the secondary lid attachment 122 may be preferably and completely sealed at the time of delivery to the user or consumer. The user may be provided with a structural option to tear off the pre-manufactured or perforated seal at perforated structure or line 146 for forming letting aperture 140, which form and function is also applicable to lid assemblies 701-704. The crescent-shaped insert or secondary lid attachment 122 may also be removed from the primary lid form 127 by pulling from the back side or edge 156 at cutout 158 in substantially a similar manner as shown in connection with the secondary depressions 143 of assemblies 701-704.

Referencing FIGS. 61-67, the reader will there consider lid assembly 704 more particularly. The secondary lid attachment 123 of lid assembly 704 preferably comprises an anterior extension element as at 159, which anterior extension element 159 is insertable into a horizontally sliced or otherwise formed opening as at 160 in the raised anterior portion 162 of the primary lid form 128. Together, the anterior extension element 159 and the opening 160 form a liquid-damming bridge 165, which bridge 165 blocks liquid or beverage from directly exiting through an arch-shaped opening 161 located on the interior vertical wall 163 of the raised anterior portion 162 of the primary lid form 128.

Liquid diverted (as at 164) around the damming bridge 165 and then through the arch shaped opening 161 mixes with incoming beverage flow otherwise proceeding through apertures 136 formed in the beverage-damming structure of the secondary lid attachment 122 in superior adjacency to the liquid-receiving compartment 141 and through the letting aperture 140 located at the top surface of the secondary lid attachment 122. FIGS. 68-70 generally depict a sequential set of views schematically showing these dynamics.

Referencing FIGS. 71-81, the reader may there consider lid assembly 702 more particularly. As earlier stated, lid assembly 702 preferably comprises a primary lid form as at 125 and a secondary lid attachment as at 120. Bearing in mind certain physical properties of liquid or beverage movable through the lid assembly 702, the reader will note that there is a relatively narrow or tight space as at space 151 between flat or planar material layer of the secondary lid attachment or insert 122 and the opposite flat or planar portion 188 of the liquid-receiving/trapping compartment 141. The flat or planar portion 188 has been outfitted with shade lines in FIG. 71 for ease of inspection.

FIGS. 76 and 79 comparatively depict liquid 60 penetrating in the narrow or tight space 151 under liquid pressure from the main compartment 152 and relative velocity as at arrow 189 of the liquid 60. The radial groove 190 surrounding the flat or planar portion 188 of the liquid-receiving compartment 141 helps liquid 60 to pass easily from apertures 136 letting beverage 60 into the liquid-receiving compartment 141 and penetrating into the substantially tight space 151 between two hydrophilic material layers of the upper secondary lid attachment 120 and the lower primary lid form 125.

FIGS. 77 and 80 comparatively depict liquid 60 trapped between the two hydrophilic material layers of the upper secondary lid attachment 120 and the lower primary lid form 125 within the narrow or tight space 151 and liquid viscosity resists flow and certain physical properties of the liquid 60 holds the liquid 60 in engagement with hydrophilic upper and lower material layers of the upper secondary lid attachment 120 and the lower primary lid form 125 while in a horizontal position.

When in this position, the liquid 60 disperses on the relatively enlarged surface area between the hydrophilic upper and lower material layers and thus significantly increasing surface contact area of between the hydrophilic upper material layer (i.e. an exterior wall) and the hydrophilic lower material layer (i.e. an interior wall). The relatively increased surface contact area has an immediate or rapid heat transfer 82 or cooling effect. Liquid 60, as received within the liquid-receiving compartment 141, is attractively engaged with the hydrophilic upper and lower material layers for limiting liquid movement.

Departing from the set of embodiments depicted and exemplified at assemblies 701, 702, 703, 704, and 800, the beverage container lid assembly 900 according to the present invention is generally and comparatively depicted in FIGS. 82-85 and basically provides an outer shroud structure in adjacency to a recessed or inner lid structure for enabling greater control over beverage movement prior to consumption, again for the purpose of spillage prevention and heat transfer prior to beverage consumption. In this regard, the beverage container lid assembly 900 basically provides a beverage container lid shroud as at 173 for use in combination with a beverage container lid as generically referenced at 174.

When outfitted upon a beverage container lid 174, the lid shroud 173 enables a user to selectively control beverage flow or beverage movement relative to the beverage container lid 174. The beverage container lid 174 usable in combination with the lid shroud 173 essentially comprises a lid wall as at 175, upper-outer container lid surfacing as at 176, and a primary beverage outlet as at 177. The beverage container lid shroud 173 according to the present invention preferably comprises a shroud wall as at 178; lower-inner shroud surfacing as at 179, and at least one letting aperture as at 180.

The shroud wall 178 and lower-inner shroud surfacing 179 being contoured for respectively mimicking the lid wall 175 and upper-outer lid surfacing 176 and either permanently attachable thereto or frictionally seatable in superior adjacency to the beverage container lid 174 for forming (1) a first beverage-receiving compartment as at 181 and (2) beverage-trapping compartment or substantially narrow or tight space 151 intermediate the upper-outer container lid surfacing 176 and the lower-inner shroud surfacing 179.

The primary beverage outlet 177 of the beverage container lid 174 outlets as at arrow 182 beverage 60 from a lid-outfitted beverage container 46 via the aperture 177 into the beverage-receiving compartment 181 in which compartment 181 spillage is prevented by beverage-redirecting (as at arrows 183) structure of the lower-inner shroud surfacing 179 and heat transfer 82 is effected/caused by beverage re-direction 183 and the at least one letting aperture 180 outlets (as at vector heads 184) beverage received in the beverage-receiving compartment 181 for beverage consumption. More particularly, a first portion of redirected flow 183 exits apertures 180 as at flow 184, and a second portion of re-directed flow 183 passes apertures 180 and permeates into the substantially tight space 151 creating flow 250 which exits through aperture 280.

In this last regard, the letting aperture(s) 180 is/are preferably formed so as to be in non-alignment with the primary beverage outlet 177 for preventing direct beverage flow(s) or movement from the primary beverage outlet 177 through the letting aperture(s) 180 of the lid shroud 173. The beverage container lid shroud 173 may further be preferably used in combination with a beverage container lid 174 having a wall-to-rim junction groove as at 185 (i.e. that space between lid wall and structure 48). In this regard, the beverage container lid shroud 173 may further preferably comprise a shroud wall hem as at 186, which shroud wall hem 186 is insertable into the wall-to-rim junction groove 185 for enhancing attachment to the lid 174 or shroud-to-lid frictionally seated engagement as generally depicted in FIG. 83 at 187.

FIGS. 84 and 85 attempt to depict in arrow form liquid or beverage flow or movement via the container lid shroud 173. The container lid shroud 173 may preferably comprise at least two laterally offset letting apertures 180, which apertures 180 are located laterally offset from the primary beverage outlet 177 for diverting flow laterally as it exits through the primary beverage outlet 177. An additional letting aperture 280 located medially lets liquid trapped in the substantially tight or narrow space (as at 151) from the beverage-receiving compartment 181 to flow out and mix with incoming diverted flow from main compartment 152.

More particularly, the two laterally offset letting apertures 180 are preferably located in the raised part or substantially vertical portion 281 of the container lid shroud 173 laterally offset from the primary beverage outlet 177 of the beverage container lid 174. The medially located third letting aperture 280 is preferably located at the anterior center of the container lid shroud 173 in the substantially horizontal portion 282 of the container lid shroud 173 radially inwardly adjacent to the primary beverage outlet 177 of the beverage container lid 174. It will thus be understood that the primary beverage outlet 177 of the beverage container lid 174 and the medially or centrally located third letting aperture 280 are radially separated and liquid is forced to flow from the primary beverage opening 177 and is laterally diverted to the sides through the beverage-receiving compartment 181 radially outward relative to the raised portion 281 of the container lid shroud 173.

First portions of liquid flow 183 exits as at vector heads 184 through the laterally offset letting apertures 180 of the container lid shroud 173. Portions of the liquid flow 184 permeate as at 286 into the narrow or tight space 151 between the upper or interior surfacing of the lid roof 284 of the beverage container lid 174, and the lower or interior surfacing of the shroud floor 285 of the container lid shroud 173. In other words, beverage 60 is received within the narrow or tight space 151 via the central or medial letting aperture 280.

A second portion of the liquid flow 183 passes around apertures 180 formed in the raised portion 281 of the container lid shroud 173 and enters the space 151 as at liquid flow 250 between the lid roof 284 and the shroud floor 285 before exiting through the medial letting aperture 280. The reader should note that the primary beverage outlet 177 is separated from the medial letting aperture 280 only anteriorly. The separation ends laterally near the letting apertures 180. When the first portions of liquid flow 183 exits letting apertures 180, second portions permeate and circulate as at arrows 250 between the shroud floor 285 and lid roof 284, and eventually exit through medial letting aperture 280. The raised portion 281 of the lid shroud 173 is substantially semi-circular in transverse cross-section superiorly and provides a conducting channel for liquid movement.

Residual liquid 60 trapped in the tight or narrow space 151 between the shroud floor 285 and the lid roof 284 and heat transfer 82 occurs rapidly from the liquid 60 received in the space 151 due to a relatively high liquid-to-material contact surface areas of the liquid 60 and the shroud floor 285 and lid roof 284. When the user re-tilts the assembly from this heat transfer configuration as generally depicted in FIGS. 82 and 83, liquid flows are the same as before, but for the addition of liquid flow exiting as at 287 through aperture 280 from the trapped, heat-transfer position within space 151. The container lid shroud 173 thus creates two separate flows as at flow 184 and flow 287 which exit through separate apertures (two laterally offset apertures 180 and the central letting aperture 280, which when mixed provide for a net cooling effect of the consumed liquid.

The container lid shroud element 173 may be constructed to fit existing or state of the art lid designs as generically depicted at lid 174 in order for the customer or merchant to optionally use it as a means to prevent spilling and enhance drinking experience (cooling effect, liquid diverting and delaying (i.e. heat transfer 82) effects) for the purpose of maintaining the use of existing lid designs. Whereas many proprietors of hot beverages currently utilized a container-receiving sleeve of plug for the prevention of spillage and scalds, the lid shroud offers an excellent and viable alternative to such designs. The container lid shroud 173 may also be used as a transitional step mechanism to transition to two-part lids with cooling/damming effect. The container lid shroud 173 may also be permanently attached to the beverage container lid 174 by the lid manufacturer, thereby creating a two-part single lid assembly.

Recalling the set of embodiments depicted and exemplified at assemblies 701, 702, 703, 704, and 800, it will be recalled that a secondary lid attachment was outfitted upon or placed into superior engagement with a primary lid form of those beverage container lid assemblies. Beverage container lid assembly 850 returns structurally to the concept of again attaching a secondary lid attachment as at 230 to a primary lid form 231, but in inferior adjacency thereto as generally depicted in FIGS. 86-95. Certain lid-to-container or container attachment means as again exemplified by a primary rim-receiving or engaging groove or structure 48 function to attach the primary lid form 231 to an upper rim 47 of a beverage container 46.

The primary lid form 231 preferably comprise a primary beverage outlet formation as at 232. The beverage outlet formation 232 is essentially an indentation in the primary lid form 231 when the primary lid form 231 is viewed from a bottom perspective as generally depicted in FIG. 86A and is invertedly analogous to the beverage outlet depressions of assemblies 701, 702, 703, 704, and 800. The beverage outlet formation 232 is thus preferably formed lower surfacing of the primary lid form 231 and comprises at least one primary beverage outlet as at aperture 233 and a primary formation periphery as referenced at 234.

The secondary lid attachment 230 preferably and essentially comprises an attachment-to-form contact edge as at 235 and at least one, but preferably two laterally opposed letting aperture(s) or cutout(s) as at 236. The attachment-to-form contact edge 235 is shaped to snugly attach to the formation periphery 234 in inferior adjacency to the primary beverage outlet 233 for forming a beverage-receiving compartment 237 at the site of the beverage outlet formation 232.

The anterior portion of attachment-to-form contact edge 235 preferably comprises a relatively larger radius of curvature as compared to the posterior portion of attachment-to-form contact edge 235 as generally and comparatively depicted in FIGS. 86 and 86A. The posterior portion of the attachment-to-form contact edge 235 may preferably be received in an edge-receiving groove as at 239 formed in the periphery 234. The anterior portion of the attachment-to-form contact edge 235 may preferably be held in compartment-forming position by inwardly radially extending attachment support protuberances 240 extending from the lid wall 241.

The container attachment means as exemplified by a primary rim-receiving or rim-engaging groove or structure as at 48 attach the primary lid form 231 to an upper rim 47 of a beverage container as at 46 containing beverage as at 60. Beverage 60 from the beverage container 46 is directable through the letting aperture(s) or cutout(s) 236 as at arrow 238 (as depicted in FIGS. 93 and 95) into the beverage-receiving compartment 237. The beverage-receiving compartment 237 effects or causes heat transfer 82 from the compartmentalized beverage 60 prior to outletting (as at arrows 85 depicted in FIGS. 93 and 95) via the primary beverage outlet 233 for beverage consumption.

Referencing FIGS. 86 and 86A, the reader will note that the primary lid form 231 preferably comprises an anterior beverage outlet portion in adjacency to the primary beverage outlet 233. Laterally offset from the primary beverage outlet are two semi-cylindrical indentations as at 247. Comparatively further referencing FIGS. 93-95, the laterally opposed semi-cylindrical indentations 247 provide certain beverage-damming or beverage-redirecting structures for beverage 60 entering (as at arrows 238) the beverage-receiving compartment 237. Beverage 60 entering (238) the compartment 237 via the laterally offset cutouts of apertures 236 passes by the downwardly extending indentations 247 and is redirected thereby for dispersion within the compartment 237 where heat transfer 82 occurs. Prior to outletting (85) the primary beverage outlet 233, beverage 60 is again redirected or met with resistance via the indentations 247 for added heat transfer effect.

Comparatively, referencing FIG. 92 versus FIG. 93, the reader will further consider that the assembly 850 may further preferably and alternatively be provided with a push button structure as at 242 as formed with the primary lid form 231. By pressing as at vector arrow 243 the push button structure 242, the user may thereby remove the secondary lid attachment 230 from engagement with the primary lid form 231 as generally depicted at arrows 244. The push button structure 242 as formed in cooperable association with the primary lid form 231 may thus further exemplify certain secondary lid attachment removal means according to the present invention.

Particularly and comparatively referencing FIGS. 93-95, the reader will again note liquid or beverage 60 trapped in a substantially narrow or tight space 151 between the material constructions of the primary lid form 231 and the secondary lid attachment 230. When the lid assemblies 850 is in a relatively horizontal position as generally depicted in FIG. 99, the liquid or beverage 60 trapped within the substantially tight space 151 is dispersed in a relative wide, thin area around beverage-receiving compartment 237 in relatively great surface contact area with the opposed, upper and lower material layers as at 245 and 246 respectively.

The volume of liquid or beverage 60 is relatively small, and is thinly dispersed within the volume defined between the attachment 230 and form 231. Accordingly, it is exposed to relatively large material surface areas by virtue of the contacts with the engagement points, and the liquid or beverage 60 experiences a rapid heat transfer therefrom as at 82. The primary lid form 231 may preferably further comprise a circular indentation 248 in radial adjacency to the push button structure 242. The circular indentation 248 generally increases the liquid-to-material contact surface area within the liquid-receiving compartment 237 as generally depicted in FIGS. 87 and 93-95 for enhancing heat transfer 82 from liquid or beverage 60 received therein.

When the assembly 850 is tilted for consumption as generally depicted in FIGS. 93 and 95, the weight of the liquid 60 under gravitation force sends the liquid 60 rushing towards the primary beverage outlet 233 where it is mixes with incoming (as at 238) diverted liquid flow from the primary beverage compartment 152 of the container 46 and trapped liquid from beverage-receiving compartment 237. Combining these flows in one flow results in substantial drop of temperature of beverage outflowing as at 85 through the primary beverage outlet 233.

Referencing FIGS. 96-104, the reader will there consider beverage container lid assembly 860. The lid assembly 860 basically depicts an optimized lid assembly 850, and the liquid flow characteristics are the same for lid assemblies 850 and 860. The primary structural and functional differences between lid assembly 850 and lid assembly 860 is that in the latter assembly 860, the push button 242 enables three functions. When the push button 242 is in a compartment-closed or relaxed configuration as at 18 generally depicted in FIGS. 97, 99, 99A, 100 and 101, the relaxed push button 18 provides its default function of enabling beverage-receiving compartment 237.

When the push button 242 is an open or actuated configuration as at 17 generally depicted in FIGS. 98, 102, 102A, 103 and 104, the push button 242 operates to deflect the secondary lid attachment 230 into a compartment opened position or configuration. By structural distinction, the push button 242 of lid assembly 850 basically functions to remove or release the secondary lid attachment 230 from total engagement with the primary lid form 231 when in the actuated, attachment-removing position as at 17.

When in the compartment-closed position, the attachment-to-form contact edge 235 of the secondary lid attachment 230 engages the primary formation periphery 234 of the primary beverage outlet formation 232. The shape of the secondary lid attachment 230 essentially matches that of the primary beverage outlet formation 232 as viewed from a bottom perspective but for the cutouts or apertures 236. The posterior portions (roughly two-thirds) of the attachment-to-form contact edge 235 of the secondary lid attachment 230 of the lid assembly 860 are preferably tightly nested or snapped into locked engagement within the attachment-receiving groove 239 of the primary formation periphery 234 as generally depicted in FIGS. 96, 96A, 97, and 98.

The anterior portions (roughly one-third) of the attachment-to-form contact edge 235 of the secondary lid attachment 230 are tightly nested or engaged with anterior portions of the primary formation periphery 234 as at 10 in FIG. 101. When pressure is applied to the secondary lid attachment 230 in a downward direction when the push button 242 is placed into the actuated, attachment-deflecting configuration 17, however, beverage 60 is unable to pass directly to the primary beverage outlet 233. The anterior portions of the secondary lid attachment 230 rather are rested or supported upon the inwardly extending ledge of protrusion(s) 240, which protrusion(s) 240 in lid assembly 860 (and lid assembly 850) are spaced so as to allow displacement of the secondary lid attachment 230 relative to the primary lid form 231 from the compartment-closed position to the attachment-deflected position as comparatively depicted in FIGS. 97 and 98.

More particularly, and further referencing FIGS. 97 and 98, the reader will note that the secondary lid attachment 230 is angled upwardly at the anterior portions relative to the lid plane 101 when in the compartment-closed position as generally depicted in FIG. 97. When the push button 242 is placed into the actuated, attachment-deflected or attachment-displaced position 17, the anterior portions of the secondary lid attachment 230 is re-positioned or displaced downwardly into a relatively more horizontal position generally depicted in FIG. 98. The displacement of the secondary lid attachment 230 in lid assembly 860 enables liquid entrapment with in the substantially tight or narrow space 151 intermediate the insert floor or lower layer 246 and formation roof or upper layer 245.

The open or attachment-displaced position is achieved by manually pushing push button 242 downwardly as at 17 thereby exerting pressure against the secondary lid attachment 230 at the anterior portions thereof while the posterior portions remain in locked engagement with the formation periphery 234 via the groove or channel formation 239. The anterior most edge 235 is supported by the indentation or inwardly extending formation 240 as generally depicted in FIGS. 98,102, 102A and 104. The laterally opposed apertures or cutouts 236 at the anterior portion of the secondary lid attachment 230 open pass ways on both sides as at 16 for the liquid to pass to liquid-receiving compartment 237 and then to exit through the primary beverage outlet 233 and into the substantially tight space 151 between floor 246 and roof 245.

Further referencing FIGS. 97 and 98, the reader will consider depression 12 of the secondary lid attachment 230 when the push button 242 is in the relaxed position 18. However, when the push button 242 is in the actuated position 17, the depression 12 becomes an extension of push button 242 thereby forming a dipped portion 249. The dipped formation 249 provides for air intake at the time of beverage consumption when a user's mouth engages the primary lid formation 231 at the primary beverage outlet 233.

The push button 242 of the lid assembly 860 can be further pressed in a downward direction to force the attachment-to-form edge 235 at the anterior portion of secondary lid attachment 230 past the indentation 240 so as to completely remove the secondary lid attachment 230 from the primary lid form 231 as in the case of lid assembly 850. Thus the lid assembly 860 preferably provides three functions, including a compartment-closing function when in the relaxed position 18, an attachment opening or attachment-deflecting function when in a first actuated position as at 17; and an attachment-removing function when in a second actuated position substantially as described.

Beverage container lid assembly 870 according to the present invention is generally depicted and referenced in FIGS. 105-112. FIGS. 105 and 106 are respectively top and bottom exploded perspective or isometric views of the lid assembly 870. In order to provide three functional lid positions or states for effecting (1) a "closed" configuration; (2) an "open-restricted/dammed" configuration; and (3) an "open-unrestricted" configuration, the lid assembly preferably comprises first and second push button structures respectively at 242 and 301 formed as part of the primary lid form 251. The secondary lid attachment or insert 252 is tightly nested into the primary beverage outlet formation 232 from the inferior side of the primary lid form 251.

FIGS. 107 and 108 attempt to comparatively depict the default "closed" position or configuration which configuration is preferred at the time the lid-outfitted beverage container is served to the consumer. Comparatively referencing FIGS. 107 and 108, the reader will there note that both push button structures are in a relaxed or unactuated state or configuration and the secondary lid attachment 252 is tightly nested or engaged within the entire primary formation periphery 234 of the primary beverage outlet formation 232.

The secondary lid attachment or insert construction 252 preferably comprises a button-mating aperture as at 302 through which button-mating aperture 302 a lipped for flanged bottom portion 304 of the push button structure 301 protrudes and locks at the inferior side or portion of the secondary lid attachment 252. The push button structure 301 and the aperture 302 are thus preferably mated and create a permanent and unmovable connection. This mated engagement may be alternatively formed by adhesive attachments or by other state of the art means for attaching the secondary lid attachment 252 to the bottom portion of the push button structure 301.

The front or anterior end of the secondary lid attachment or insert 252 preferably comprises a raised portion as at 303, which raided portion functions as a plug as seated in the gap 253 in inferior adjacency to the primary beverage outlet 233 of the primary lid formation 251 as generally depicted and referenced in FIG. 107. In the "closed" position or configuration, the plug 303 is preferably tightly inserted in the gap 253 and creates a liquid tight engagement therewith.

FIGS. 109 and 110 comparatively depict the "open-restricted/dammed" configuration of the lid assembly 870. To structurally achieve the "open-restricted/dammed" configuration of the lid assembly 870, the push button structure 242 is manually pushed into a downwardly bent configuration (as at 17) thereby bending the front or anterior portions of the secondary lid attachment 252 in a downward direction releasing the plug 303 from the gap 253 and opening a channel to the primary beverage outlet 233. Liquid may thus flow through the apertures or cutouts 254 of the secondary lid attachment or insert 252 and to the primary beverage outlet 233.

A portion of the liquid structurally becomes trapped in substantially tight space depicted and referenced at 305. When the lid-outfitted beverage container is tilted, this trapped beverage exits through the primary beverage outlet 233, and in so exiting, mixes with incoming liquid from main beverage compartment with substantially the same liquid flow as described in connection with lid assembly 860. FIGS. 111 and 112 comparatively depict the "open-unrestricted" position or configuration of the lid assembly 870 (as also applicable to lid assemblies 850 and 860). To structurally achieve the "open-unrestricted" position or configuration, the push button structure 301 is depressed thereby moving or displacing the entire secondary lid attachment 252 downwardly and creating unrestricted flow of liquid through the channel 255 to the primary beverage outlet 233.

While the above descriptions contain much specificity, this specificity should not be construed as limitations on the scope of the invention, but rather as an exemplification of the invention. In certain embodiments, the basic invention may be said to essentially teach or disclose a beverage or liquid container lid assembly for enabling a user to selectively control beverage or liquid movement(s) therethrough.

Various beverage container lid assemblies (e.g. lid assemblies 701, 702, 703, 704, and 800) may be said to essentially each comprise a primary lid form, a secondary lid attachment, and certain container attachment means for attaching the primary lid form to an upper rim of a beverage container. The primary lid forms in certain embodiments preferably and essentially comprise a beverage outlet depression formed at upper surfacing of the primary lid form, which beverage outlet depression has at least one primary beverage outlet and a depression periphery.

The secondary lid attachments of those embodiments preferably and essentially comprise an attachment-to-form contact edge and at least one letting aperture. The attachment-to-form contact edges are engaged with the depression peripheries in superior adjacency to the primary beverage outlet for forming a beverage-receiving compartment at the site of the beverage outlet depression.

The container attachment means attach the primary lid forms to an upper rim of a beverage container. Beverage from the beverage container is directable through the primary beverage outlet into the beverage-receiving compartment in which beverage-receiving compartment heat transfer is effected from the beverage prior to outletting via the at least one letting aperture of the secondary lid attachment for beverage consumption.

Lid assemblies 701, 702, 703, 704, and 800 may all further be preferably defined by comprising primary lid forms having a beverage pooling structure in adjacency to the at least one primary beverage outlet for pooling beverage within the beverage-receiving compartment prior to consumption. The at least one letting aperture may preferably be non-aligned relative to the at least one primary beverage outlet such that the secondary lid attachments provide certain beverage flow diversion structure. Certain secondary lid attachment removal means may be further provided for enabling the user to selectively remove the secondary lid attachment from engagement with the primary lid form and consume beverage directly via the at least one primary beverage outlet.

The lid assemblies according to the present invention may all be said to further preferably and essentially comprise secondary lid attachment removal means as variously defined or exemplified by secondary depressions formed in adjacency to the beverage outlet depression, push button structures, perforated structures and/or pull tabs, etc. The secondary depressions enable a user to manually engage an underside of the secondary lid attachment for manually removing those secondary lid attachments. The primary lid forms may further preferably comprise a depression-interconnecting channel extending intermediate the beverage outlet depression and the secondary depression for venting the beverage-receiving compartment.

Viewed from a broader perspective, various container lid assemblies (e.g. lid assemblies 701, 702, 703, 704, 800, 850, 860, and 870) according to the present invention may be said to essentially each comprise a primary lid form, a secondary lid attachment, and certain container attachment means for enabling a user to selectively control liquid movement from a lid-outfitted container through the lid assemblies. The primary lid forms in certain embodiments preferably and essentially comprise a liquid outlet formation having at least one primary liquid outlet and a formation periphery.

The secondary lid attachments comprise an attachment-to-form contact edge and at least one letting aperture. The attachment-to-form contact edges are engaged with the formation peripheries in adjacency to the primary liquid outlet for forming a liquid-receiving compartment at the liquid outlet formation. Certain means are contemplated for inhibiting removal of the secondary lid attachment from engagement with the primary lid form as exemplified by edge-receiving grooves (e.g. grooves 239) or attachment points of the push button structures to the secondary lid attachments.

The container attachment means attach the primary lid form(s) to a liquid container. Liquid or beverage from the liquid container is directable into the liquid-receiving compartment for effecting heat transfer from the liquid prior to outletting via a select letting aperture. Depending on the placement of the secondary lid attachments relative to the primary lid forms, the select letting aperture may be selected from the group consisting of at least one primary beverage outlet of the primary lid formations and at least one letting aperture of the secondary lid attachments.

Lid assemblies 850, 860, and 870 may be said to represent a first subset of those lid assemblies wherein the secondary lid attachments are cooperably engaged with the primary lid forms in inferior adjacency to the primary liquid outlet. The liquid is directable (a) into the liquid-receiving compartment via the at least one letting aperture formed in the secondary lid attachment(s), and (b) from the liquid-receiving compartment via the primary liquid outlet formed in the primary lid formation(s).

The primary lid form or formations of lid assemblies 850, 860, and 870 may further preferably and essentially each comprise laterally opposed liquid-damming structures at the liquid outlet formation. The laterally opposed liquid-damming structures are laterally offset from the primary liquid outlet for redirecting liquid movements prior to outletting via the primary liquid outlet for effecting heat transfer from redirected liquid movements, and thereby enhancing a cooling effect of the lid assemblies.

The primary lid forms may further preferably and essentially comprise at least one push button structure for enabling the user to selectively remove the secondary lid attachment(s) from select engagement(s) with the primary lid form(s) (e.g. partial or entire removals or disengagements). The primary lid forms may further preferably comprise certain indentations or structural depressions in adjacency to the push button structure(s) for increasing liquid-to-material contact surface area within the liquid-receiving compartment and enhancing heat transfer from liquid received therein.

Lid assemblies 701, 702, 703, 704, and 800 may be said to represent a second subset of the broader based definitions of the lid assemblies wherein the secondary lid attachments are cooperably engaged with the primary lid forms in superior adjacency to the primary liquid outlet such that liquid is directable (a) into the liquid-receiving compartment via the at least one primary liquid outlet of the primary lid form(s); and (b) from the liquid-receiving compartment via the at least one letting aperture of the secondary lid attachment(s).

As earlier stated, the primary lid forms may preferably further comprise a liquid pooling structure in adjacency to the at least one primary liquid outlet for pooling liquid within the liquid-receiving compartment prior to outletting via the at least one letting aperture. The at least one letting aperture(s) are preferably non-aligned relative to the at least one primary liquid outlet. The preferred non-alignment of such apertures formed in the secondary lid attachment provide liquid flow diversion structure as liquid is redirected by the material construction(s) of the secondary lid attachment(s).

The container lid shroud according to the present invention is designed for use in combination with a container lid and enables a user to selectively control liquid flow from the container lid, which container lid essentially comprises a lid wall, upper-outer container lid surfacing, and a primary liquid outlet. The container lid shroud according to the present invention preferably and essentially comprises a shroud wall, lower-inner shroud surfacing, and at least one letting aperture.

The shroud wall and lower-inner shroud surfacing are contoured for respectively mimicking the lid wall and upper-outer lid surfacing of the container lid and are seatable in superior adjacency to the container lid for forming a liquid-receiving compartment intermediate the upper-outer container lid surfacing and the lower-inner shroud surfacing. The primary liquid outlet outlets liquid from a lid-outfitted liquid container into the liquid-receiving compartment, and the at least one letting aperture outlets liquid received in the liquid-receiving compartment.

The at least one letting aperture of the container lid shroud is preferably formed so as to be in non-alignment with the primary liquid outlet for preventing direct liquid flow from the primary liquid outlet through the at least one letting aperture. The container lid shroud may be frictionally seatable in superior adjacency to the container lid for forming the liquid-receiving compartment. The lower-inner shroud surfacing of the shroud wall are frictionally engageable with the upper-outer lid surfacing of the lid wall for retaining the lid shroud in engagement with the container lid. The liquid container lid may have a wall-to-rim junction groove, and the container lid shroud may cooperably comprise a shroud wall hem insertable into the wall-to-rim junction groove for enhancing shroud-to-lid frictionally seated engagement.

Although the inventive beverage or liquid container lid assemblies according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

I claim:

1. A beverage container lid assembly for enabling a user to selectively control beverage movement therethrough, the beverage container lid assembly comprising:

a primary lid form, the primary lid form comprising at least one primary beverage outlet and a beverage pooling depression formed at upper surfacing of the primary lid form in adjacency to the at least one primary beverage outlet for pooling beverage in adjacency to the at least one primary beverage outlet when in an upright orientation, the beverage pooling depression having a depression periphery;

a secondary lid attachment, the secondary lid attachment comprising an attachment-to-form contact edge and at least one letting aperture, the attachment-to-form contact edge being engaged with the depression periphery in superior adjacency to the at least one primary beverage outlet for forming a beverage-receiving compartment, a bottom surface of the beverage-receiving compartment being the beverage pooling depression and a top surface of the beverage-receiving compartment being the secondary lid attachment, the bottom and top surfaces being hydrophilic; and container attachment means for attaching the primary lid form to an upper rim of a beverage container for forming a lid-outfitted container, beverage from the beverage container being directable through the primary beverage outlet into the beverage-receiving compartment, the beverage being attractively engaged with the hydrophilic bottom and top surfaces for limiting beverage movement, the beverage-receiving compartment for effecting heat transfer from the beverage prior to outletting via the at least one letting aperture for beverage consumption.

2. The beverage container lid assembly of claim 1 wherein the beverage pooling depression provides a beverage pooling structure in radially inner and inferior adjacency to the at least one primary beverage outlet, the beverage pooling structure for centrally pooling beverage within the beverage-receiving compartment prior to consumption.

3. The beverage container lid assembly of claim 1 wherein the at least one letting aperture is non-aligned axially relative to the at least one primary beverage outlet, the secondary lid attachment thus providing beverage flow diversion structure.

4. The beverage container lid assembly of claim 1 comprising secondary lid attachment removal means for enabling the user to selectively remove the secondary lid attachment from engagement with the primary lid form and consume beverage directly via the at least one primary beverage outlet.

5. The beverage container lid assembly of claim 4 wherein the secondary lid attachment removal means are defined in part by a secondary depression formed in adjacency to the beverage pooling depression, the secondary depression for enabling a user to manually engage an underside of the secondary lid attachment for manually removing said secondary lid attachment.

6. The beverage container lid assembly of claim 5 wherein the primary lid form comprises a depression-interconnecting channel, the depression-interconnecting channel extending intermediate the beverage pooling depression and the secondary depression for venting the beverage-receiving compartment.

7. A container lid assembly for enabling a user to selectively control liquid movement therethrough, the container lid assembly comprising:

a primary lid form, the primary lid form comprising at least one primary liquid outlet and a liquid pooling formation in adjacency to the at least one primary liquid outlet for pooling liquid in adjacency to the at least one primary liquid outlet when in an upright orientation, the liquid pooling formation having a formation periphery;

a secondary lid attachment, the secondary lid attachment comprising an attachment-to-form contact edge and at least one letting aperture, the attachment-to-form contact edge being engaged with the formation periphery in superior adjacency to the at least one primary liquid outlet for forming a liquid-diverting channel, a bottom surface of the liquid-diverting channel being the liquid pooling formation and a top surface of the liquid-diverting channel being the secondary lid attachment;

means for inhibiting removal of the secondary lid attachment from engagement with the primary lid form; and container attachment means for attaching the primary lid form to a liquid container, liquid from the liquid container being directable into the liquid-diverting channel, the primary lid form and the secondary lid attachment being in simultaneous contact with liquid received within the liquid-diverting channel for effecting heat transfer from the liquid prior to outletting via the at least one letting aperture.

8. The beverage container lid assembly of claim 7 wherein the at least one letting aperture is non-aligned axially relative to the at least one primary liquid outlet, the secondary lid attachment thus providing liquid flow diversion structure.

9. The container lid assembly of claim 7 wherein the secondary lid attachment is cooperably engaged with the primary lid form in superior adjacency to the primary liquid outlet, the liquid being directable (a) into the liquid-diverting channel via the primary liquid outlet, and (b) from the liquid-diverting channel via the at least one letting aperture.

10. The container lid assembly of claim 9 wherein the primary lid form comprises at least one push button structure, the at least one push button structure for enabling the user to selectively displace the secondary lid attachment relative to the primary lid form for controlling liquid movement therethrough.

11. The container lid assembly of claim 7 wherein the liquid pooling formation is in radially inner and inferior adjacency to the primary liquid outlet, the liquid pooling structure for pooling liquid centrally within the liquid-diverting channel prior to outletting via the at least one letting aperture.

12. The container lid assembly of claim 7 comprising secondary lid attachment removal means for enabling the user to selectively remove the secondary lid attachment from engagement with the primary lid form and access liquid directly via the at least one primary liquid outlet.

13. The container lid assembly of claim 12 wherein the secondary lid attachment removal means comprise a secondary formation formed in adjacency to the liquid pooling formation, the secondary formation for enabling a user to manually engage an underside of the secondary lid attachment for manually removing said secondary lid attachment.

14. The container lid assembly of claim 13 wherein the primary lid form comprises a formation-interconnecting channel, the formation-interconnecting channel extending intermediate the liquid pooling formation and the secondary formation for venting the liquid-diverting channel.

15. A container lid assembly for enabling a user to selectively control liquid movement therethrough, the container lid assembly comprising:

a primary lid form, the primary lid form comprising at least one primary liquid outlet, a formation-interconnecting channel, and a liquid pooling formation in adjacency to the at least one primary liquid outlet for pooling liquid in adjacency to the at least one primary liquid outlet, the liquid pooling formation having a formation periphery;

a secondary lid attachment, the secondary lid attachment comprising an attachment-to-form contact edge and at least one letting aperture, the attachment-to-form contact edge being engaged with the formation periphery in adjacency to the primary liquid outlet for forming a narrow liquid-receiving space, a bottom surface of the narrow liquid-receiving space being the liquid pooling formation and a top surface of the narrow liquid-receiving space being the secondary lid attachment;

the primary lid form being attachable to a liquid container, liquid from the liquid container being directable into the narrow liquid-receiving space, the primary lid form and the secondary lid attachment being in simultaneous contact with liquid received within the narrow liquid-receiving space for effecting heat transfer from the liquid prior to outletting via the at least one letting aperture, the formation-interconnecting channel extending from the liquid pooling formation for venting the narrow liquid-receiving space.

16. The container lid assembly of claim 15 wherein the at least one letting aperture is non-aligned axially relative to the at least one primary liquid outlet, the secondary lid attachment thus providing liquid flow diversion structure.

17. The container lid assembly of claim 15 wherein the secondary lid attachment is cooperably engaged with the primary lid form in superior adjacency to the primary liquid outlet, the liquid being directable (a) into the narrow liquid-receiving space via the at least one primary liquid outlet, and (b) from the narrow liquid-receiving space via the at least one letting aperture.

18. The container lid assembly of claim 15 comprising secondary lid attachment removal means, the secondary lid attachment removal means comprising a secondary formation formed in adjacency to the liquid pooling formation, the secondary formation for enabling a user to manually engage an underside of the secondary lid attachment for manually removing said secondary lid attachment, the formation-interconnecting channel extending intermediate the liquid pooling formation and the secondary formation for venting the narrow liquid-receiving space.

* * * * *